US007327340B2

(12) United States Patent
Someya et al.

(10) Patent No.: US 7,327,340 B2
(45) **Date of Patent: *Feb. 5, 2008**

(54) LIQUID-CRYSTAL DRIVING CIRCUIT AND METHOD

(75) Inventors: Jun Someya, Tokyo (JP); Masaki Yamakawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 469 days.

This patent is subject to a terminal disclaimer.

(21) Appl. No.: 10/760,461

(22) Filed: Jan. 21, 2004

(65) Prior Publication Data

US 2004/0217930 A1 Nov. 4, 2004

Related U.S. Application Data

(62) Division of application No. 10/234,192, filed on Sep. 5, 2002, now Pat. No. 6,756,955.

(30) Foreign Application Priority Data

Oct. 31, 2001 (JP) ..... 2001-334692
Mar. 8, 2002 (JP) ..... 2002-063394

(51) Int. Cl.
*G09G 3/36* (2006.01)

(52) U.S. Cl. ..... 345/89; 345/98; 345/690

(58) Field of Classification Search ..... 345/87–89, 345/98–100, 204, 690; 382/232, 236, 237
See application file for complete search history.

(56) References Cited

U.S. PATENT DOCUMENTS 5,345,268 A * 9/1994 Matsuta et al. ..... 348/384.1
5,841,475 A * 11/1998 Kurihara et al. ..... 375/240.15
5,909,513 A * 6/1999 Liang et al. ..... 382/253
5,953,488 A * 9/1999 Seto ..... 386/109
6,115,423 A * 9/2000 Shen et al. ..... 375/240.03
6,496,194 B1 * 12/2002 Mikoshiba et al. ..... 345/596
6,661,400 B2 * 12/2003 Sakashita ..... 345/89
6,756,955 B2 * 6/2004 Someya et al. ..... 345/88
2001/0038372 A1 11/2001 Lee
2002/0030652 A1 3/2002 Shibata et al.
2002/0033813 A1 3/2002 Matsumura et al.
2002/0050965 A1 5/2002 Oda et al.

FOREIGN PATENT DOCUMENTS

JP 4-204593 A 7/1992
JP 6-189232 A 7/1994
JP 9-81083 3/1997
JP 11-126052 5/1999

* cited by examiner

*Primary Examiner*—Regina Liang
(74) *Attorney, Agent, or Firm*—Birch, Stewart, Kolasch & Birch, LLP

(57) ABSTRACT

A liquid-crystal driving circuit has an image data processor that, for example, encodes the present image, decodes the encoded image, delays the encoded image by one frame interval, decodes the delayed encoded image, and uses the two decoded images to generate compensation data for adjusting the gray-scale values in the present image. The encoding process reduces the amount of image data, thereby reducing the size of the frame memory needed to delay the image. The compensation data preferably cause the liquid crystal to reach transmissivity values corresponding to the gray-scale values of the present image within substantially one frame interval. This enables the response speed of the liquid crystal to be controlled accurately.

35 Claims, 60 Drawing Sheets

FIG.11A

| | | | |
|---|---|---|---|
| 52 | 152 | 52 | 52 |
| 52 | 152 | 52 | 52 |
| 48 | 148 | 48 | 48 |
| 48 | 148 | 48 | 48 |

FIG.11B

La=100 Lb=100

| | | | |
|---|---|---|---|
| 0 | 1 | 0 | 0 |
| 0 | 1 | 0 | 0 |
| 0 | 1 | 0 | 0 |
| 0 | 1 | 0 | 0 |

FIG.11C

| | | | |
|---|---|---|---|
| 50 | 150 | 50 | 50 |
| 50 | 150 | 50 | 50 |
| 50 | 150 | 50 | 50 |
| 50 | 150 | 50 | 50 |

FIG.11D

| | | | |
|---|---|---|---|
| 52 | 152 | 52 | 52 |
| 52 | 152 | 52 | 52 |
| 48 | 148 | 48 | 48 |
| 48 | 148 | 48 | 48 |

FIG.11E

La=100 Lb=100

| | | | |
|---|---|---|---|
| 0 | 1 | 0 | 0 |
| 0 | 1 | 0 | 0 |
| 0 | 1 | 0 | 0 |
| 0 | 1 | 0 | 0 |

FIG.11F

| | | | |
|---|---|---|---|
| 50 | 150 | 50 | 50 |
| 50 | 150 | 50 | 50 |
| 50 | 150 | 50 | 50 |
| 50 | 150 | 50 | 50 |

FIG.11G

| | | | |
|---|---|---|---|
| 0 | 0 | 0 | 0 |
| 0 | 0 | 0 | 0 |
| 0 | 0 | 0 | 0 |
| 0 | 0 | 0 | 0 |

FIG.11H

| | | | |
|---|---|---|---|
| 52 | 152 | 52 | 52 |
| 52 | 152 | 52 | 52 |
| 48 | 148 | 48 | 48 |
| 48 | 148 | 48 | 48 |

FIG. 73

PRIOR ART

| | A | B | C | D | E | F |
|---|---|---|---|---|---|---|
| a | ADDRESS 0 | | ADDRESS 1 | | ADDRESS 2 | |
| b | | | | | | |
| c | ADDRESS N | | ADDRESS N+1 | | ADDRESS N+2 | |
| d | | | | | | |
| e | ADDRESS 2N+1 | | ADDRESS 2N+2 | | ADDRESS 2N+3 | |

FIG.74A

PRIOR ART

FRAME n+1

| | A | B | C | D |
|---|---|---|---|---|
| a | 50 | 150 | 50 | 50 |
| b | 50 | 150 | 50 | 50 |
| c | 50 | 150 | 50 | 50 |
| d | 50 | 150 | 50 | 50 |

FIG.74B

PRIOR ART

| | A | B | C | D |
|---|---|---|---|---|
| a | 50 | – | 50 | – |
| b | – | – | – | – |
| c | 50 | – | 50 | – |
| d | – | – | – | – |

FIG.74C

PRIOR ART

| | A | B | C | D |
|---|---|---|---|---|
| a | 50 | 50 | 50 | 50 |
| b | 50 | 50 | 50 | 50 |
| c | 50 | 50 | 50 | 50 |
| d | 50 | 50 | 50 | 50 |

FIG.74D

PRIOR ART

FRAME n

| | A | B | C | D |
|---|---|---|---|---|
| a | 50 | 150 | 50 | 50 |
| b | 50 | 150 | 50 | 50 |
| c | 50 | 150 | 50 | 50 |
| d | 50 | 150 | 50 | 50 |

LIQUID-CRYSTAL DRIVING CIRCUIT AND METHOD

This application is a Divisional of application Ser. No. 10/234,192, filed on Sep. 5, 2002, now U.S. Pat. No. 6,756,955 the entire contents of which are hereby incorporated by reference and for which priority is claimed under 35 U.S.C. § 120.

BACKGROUND OF THE INVENTION

1. Field of the Invention

The present invention relates to a liquid-crystal display device employing a liquid-crystal panel and, more particularly, to a liquid-crystal driving circuit and liquid-crystal driving method for improving the response speed of the liquid crystal.

2. Description of the Related Art

Liquid crystals have the drawback of being unable to respond to rapidly changing moving pictures, because their transmissivity changes according to a cumulative response effect. One method of solving this problem is to improve the response speed of the liquid crystal by increasing the liquid-crystal driving voltage above the normal driving voltage when the gray level changes.

FIG. 72 shows an example of a liquid-crystal driving device that drives a liquid crystal by the above method; details are given in, for example, Japanese Unexamined Patent Application Publication No. 6-189232. Reference numeral 100 in FIG. 72 denotes an A/D conversion circuit, 101 denotes an image memory storing the data for one frame of a picture signal, 102 denotes a comparison circuit that compares the present image data with the image data one frame before and outputs a gray-level change signal, 103 denotes the driving circuit of a liquid-crystal panel, and 104 denotes the liquid-crystal panel.

Next, the operation will be described. The A/D conversion circuit 100 samples the picture signal on a clock having a certain frequency, converts the picture signal to image data in digital form, and outputs the data to the image memory 101 and comparison circuit 102. The image memory 101 delays the input image data by an interval equivalent to one frame of the picture signal, and outputs the delayed data to the comparison circuit 102. The comparison circuit 102 compares the present image data output by the A/D conversion circuit 100 with the image data one frame before output by the image memory 101, and outputs a gray-level change signal, indicating changes in gray level between the two images, to the driving circuit 103, together with the present image data. The driving circuit 103 drives the display pixels of the liquid-crystal panel 104, supplying a higher driving voltage than the normal liquid-crystal driving voltage for pixels in which the gray level has increased, and a lower voltage for pixels in which the gray level has decreased, according to the gray-level change signal.

A problem in the image display device shown in FIG. 72 is that as the number of pixels displayed by the liquid-crystal panel 104 increases, so does the amount of image data written into the image memory 101 for one frame, so the necessary memory size increases. In the image display device described in Japanese Unexamined Patent Application Publication No. 4-204593, one address in the image memory is assigned to four pixels, as shown in FIG. 73, to reduce the size of the image memory 101. The size of the image memory is reduced because the pixel data stored in the image memory are decimated, excluding every other pixel horizontally and vertically; when the image memory is read, the same image data are read for the excluded pixels as for the stored pixel, several times. For example, the data at address 0 are read for pixels (a, B), (b, A), and (b, B).

As described above, the response speed of the liquid crystal can be improved by increasing the liquid-crystal driving voltage above the normal liquid-crystal driving voltage when the gray level changes from the gray level one frame before. Since the liquid-crystal driving voltage is increased or reduced, however, only according to changes in the magnitude relationship between the gray levels, if the gray level increases from the gray level one frame before, the same higher driving voltage than the normal voltage is applied regardless of the size of the increase. Therefore, when the gray level changes only slightly, an overly high voltage is applied to the liquid crystal, causing a degradation of image quality.

If the size of the image memory 101 is reduced by decimation of the image data in the image memory 101 as shown in FIG. 73, the problem described below occurs. FIGS. 74A to 74D illustrate the problem caused by decimation. FIG. 74A shows image data for frame n+1, FIG. 74B shows image data for the image in frame n+1 shown in FIG. 74A after decimation, FIG. 74C shows the image data read by interpolation of the decimated pixel data, and FIG. 74D shows the image data for frame n, one frame before. The image for frame n and the image for frame n+1 are identical, as shown in FIGS. 74A and 74D.

If decimation is carried out as shown in FIG. 74C, the pixel data at (A, a) are read as the pixel data for (B, a) and (B, b), and the pixel data at (A, c) are read as the pixel data for (B, c) and (B, d). Thus pixel data with gray level 50 are read as pixel data for a gray level that is actually 150. Therefore, even though the image has not changed from the frame before, pixels (B, a), (B, b), (B, c), and (B, d) in frame n+1 are driven with a higher driving voltage than the normal voltage.

Thus when decimation is carried out, the voltages for the pixels with decimated pixel data are not controlled accurately, and the image quality is degraded by the application of unnecessary voltages.

SUMMARY OF THE INVENTION

The present invention addresses the problem above, with the object of providing a liquid-crystal driving circuit and liquid-crystal driving method capable of accurately controlling the response speed of the liquid crystal in a liquid-crystal display device by appropriately controlling the voltage applied to the liquid crystal.

Another object is to provide a liquid-crystal driving circuit and liquid-crystal driving method capable of accurately controlling the voltage applied to the liquid crystal, even if the capacity of the frame memory for reading the image one frame before is reduced.

The present invention provides a liquid-crystal driving circuit that generates image data from gray-scale values of an input image made up of a series of frames. The image data determine voltages that are applied to a liquid crystal to display the input image.

A first liquid-crystal driving circuit according to the present invention includes:

an encoding unit for encoding a present image corresponding to a frame of the input image and outputting an encoded image corresponding to the present image;

a first decoding unit for decoding the encoded image and outputting a first decoded image corresponding to the present image;

a delay unit for delaying the encoded image for an interval corresponding to one frame;

a second decoding unit for decoding the delayed encoded image and outputting a second decoded image;

a compensation data generator for generating compensation data for adjusting the gray-scale values in the present image according to the first decoded image and the second decoded image; and a compensation unit for generating the image data according to the present image and the compensation data.

The compensation data preferably adjust the gray-scale values of the present image so that the liquid crystal reaches a transmissivity corresponding to the gray-scale values of the present image within substantially one frame interval.

The compensation data generator may include:

a data conversion unit for reducing the number of bits with which the gray-scale values of the first decoded image and the second decoded image are quantized, thereby generating a third decoded image corresponding to the first decoded image and a fourth decoded image corresponding to the second decoded image; and a unit for outputting the compensation data according to the third decoded image and the fourth decoded image.

Alternatively, the compensation data generator may include:

a data conversion unit for reducing the number of bits with which the gray-scale values of the first decoded image or the second decoded image are quantized, thereby generating either a third decoded image corresponding to the first decoded image or a fourth decoded image corresponding to the second decoded image; and a unit for outputting the compensation data according to the third decoded image and the second decoded image, or according to the first decoded image and the fourth decoded image.

The compensation data generator may also include:

an error decision unit for detecting differences between the first decoded image and the present image; and a limiting unit for limiting the compensation data according to the detected differences.

The compensation data generator may also include:

an error decision unit for detecting differences between the first decoded image and the present image;

a data correction unit for adding the detected differences to the first decoded image and the second decoded image, thereby generating a fifth decoded image corresponding to the first decoded image and a sixth decoded image corresponding to the second decoded image; and a unit for using the fifth decoded image and the sixth decoded image to output the compensation data.

Alternatively, the compensation data generator may include:

an error decision unit for detecting differences between the first decoded image and the present image;

a data correction unit for adding the detected differences to the first decoded image or the second decoded image, thereby generating either a fifth decoded image corresponding to the first decoded image or a sixth decoded image corresponding to the second decoded image; and a unit for outputting the compensation data according to the fifth decoded image and the second decoded image, or according to the first decoded image and the sixth decoded image.

The first liquid-crystal driving circuit may also include band-limiting unit for limiting a predetermined frequency component included in the present image, the encoding unit encoding the output of the band-limiting unit.

The first liquid-crystal driving circuit may also include a color-space transformation unit for outputting luminance and chrominance signals of the present image, the encoding unit encoding the luminance and chrominance signals.

A second liquid-crystal driving circuit according to the present invention includes:

a data conversion unit for reducing a present image corresponding to a frame of the input image to a smaller number of bits by reducing the number of bits with which the gray-scale values of the present image are quantized, thereby outputting a first image corresponding to the present image;

a delay unit for delaying the first image for an interval corresponding to one frame and outputting a second image;

a compensation data generator for generating compensation data for adjusting the gray-scale values in the present image according to the first image and the second image; and a compensation unit for generating the image data according to the present image and the compensation data.

The compensation data preferably adjust the gray-scale values of the present image so that the liquid crystal reaches a transmissivity corresponding to the gray-scale values of the present image within substantially one frame interval.

A third liquid-crystal driving circuit according to the present invention includes:

an encoding unit for encoding a present image corresponding to a frame of the input image and outputting a first encoded image corresponding to the present image;

a delay unit for delaying the first encoded image for an interval corresponding to one frame and outputting a second encoded image;

a decoding unit for decoding the second encoded image and outputting a decoded image corresponding to the input image one frame before the present image;

a compensation data generator for generating compensation data for adjusting the gray-scale values in the present image according to the present image and the decoded image; and a compensation unit for generating the image data according to the present image and the compensation data.

The compensation data preferably adjust the gray-scale values of the present image so that the liquid crystal reaches a transmissivity corresponding to the gray-scale values of the present image within substantially one frame interval.

The compensation data generator may also include a limiting unit for setting the value of the compensation data to zero when the first encoded image and the second encoded image are identical.

A fourth liquid-crystal driving circuit according to the present invention includes:

an encoding unit for encoding the image data generated for a frame of the input image one frame before a present image in the series of frames, and outputting an encoded image;

a first decoding unit for decoding the encoded image and outputting a first decoded image;

a delay unit for delaying the encoded image for an interval corresponding to one frame;

a second decoding unit for decoding the delayed encoded image, and outputting a second decoded image;

a compensation data generator for generating compensation data for adjusting the gray-scale values in the image according to the first decoded image and the second decoded image; and a compensation unit for generating the image data according to the present image and the compensation data.

The compensation data preferably adjust the gray-scale values of the present image so that the liquid crystal reaches a transmissivity corresponding to the gray-scale values of the present image within substantially one frame interval.

The present invention also provides a method of driving a liquid crystal by generating image data from gray-scale values of an image made up of a series of frames, and applying voltages to the liquid crystal according to the image data.

A first method of driving a liquid crystal according to the present invention includes:

encoding a present image corresponding to a frame of the image, thereby generating an encoded image corresponding to the present image;

decoding the encoded image, thereby generating a first decoded image corresponding to the present image;

delaying the encoded image for an interval corresponding to one frame;

decoding the delayed encoded image, thereby generating a second decoded image;

generating compensation data for adjusting the gray-scale values in the present image according to the first decoded image and the second decoded image; and generating the image data according to the present image and the compensation data.

The compensation data preferably adjust the gray-scale values of the present image so that the liquid crystal reaches a transmissivity corresponding to the gray-scale values of the present image within substantially one frame interval.

Generating the compensation data may include:

reducing the number of bits with which the gray-scale values of the first decoded image and the second decoded image are quantized, thereby generating a third decoded image corresponding to the first decoded image and a fourth decoded image corresponding to the second decoded image; and outputting the compensation data according to the third decoded image and the fourth decoded image.

Alternatively, generating the compensation data may include:

reducing the number of bits with which the gray-scale values of the first decoded image or the second decoded image are quantized, thereby generating either a third decoded image corresponding to the first decoded image or a fourth decoded image corresponding to the second decoded image; and outputting the compensation data according to the third decoded image and the second decoded image, or according to the first decoded image and the fourth decoded image.

Generating the compensation data may also include limiting the compensation data according to differences between the first decoded image and the present image.

Generating the compensation data may also include:

adding differences between the first decoded image and the present image to the first decoded image and the second decoded image, thereby generating a fifth decoded image corresponding to the first decoded image and a sixth decoded image corresponding to the second decoded image; and using the fifth decoded image and the sixth decoded image to output the compensation data.

Alternatively, generating the compensation data may include:

adding differences between the first decoded image and the present image to the first decoded image or the second decoded image, thereby generating either a fifth decoded image corresponding to the first decoded image or a sixth decoded image corresponding to the second decoded image; and outputting the compensation data according to the fifth decoded image and the second decoded image, or according to the first decoded image and the sixth decoded image.

The first method may also include limiting a predetermined frequency component included in the present image, thereby generating a band-limited image, which is encoded to generate the encoded image.

Encoding the present image may include encoding luminance and chrominance signals of the present image.

A second method of driving a liquid crystal according to the present invention includes:

reducing a present image corresponding to a frame of the input image to a smaller number of bits by reducing the number of bits with which the gray-scale values of the present image are quantized, thereby outputting a first image corresponding to the present image;

delaying the first image for an interval corresponding to one frame and outputting a second image;

generating compensation data for adjusting the gray-scale values in the present image according to the first image and the second image; and generating the image data according to the present image and the compensation data.

The compensation data preferably adjust the gray-scale values of the present image so that the liquid crystal reaches a transmissivity corresponding to the gray-scale values of the present image within substantially one frame interval.

A third method of driving a liquid crystal according to the present invention includes:

encoding a present image corresponding to a frame of the input image and outputting a first encoded image corresponding to the present image;

delaying the first encoded image for an interval corresponding to one frame and outputting a second encoded image;

decoding the second encoded image and outputting a decoded image corresponding to the image one frame before the present image;

generating compensation data for adjusting the gray-scale values in the present image according to the present image and the decoded image; and generating the image data according to the present image and the compensation data.

The compensation data preferably adjust the gray-scale values of the present image so that the liquid crystal reaches a transmissivity corresponding to the gray-scale values of the present image within substantially one frame interval.

Generating the compensation data may include setting the value of the compensation data to zero when the first encoded image and the second encoded image are identical.

A fourth method of driving a liquid crystal according to the present invention includes:

encoding the image data generated for a frame of the input image one frame before a present image in the series of frames, and outputting an encoded image;

decoding the encoded image and outputting a first decoded image;

delaying the encoded image for an interval corresponding to one frame;

decoding the delayed encoded image, and outputting a second decoded image;

generating compensation data for adjusting the gray-scale values in the image according to the first decoded image and the second decoded image; and generating the image data according to the present image and the compensation data.

The compensation data preferably adjust the gray-scale values of the present image so that the liquid crystal reaches a transmissivity corresponding to the gray-scale values of the present image within substantially one frame interval.

Adjusting the gray-scale values of the present image so that the liquid crystal reaches a transmissivity corresponding to the gray-scale values of the present image within substantially one frame interval enables the response speed of the liquid crystal to be controlled accurately.

By coding the image that is delayed, or by reducing the number of bits with which the gray-scale values of the image are quantized, the present invention reduces the capacity of the frame memory needed to delay the image, and avoids inaccuracies caused by decimation.

BRIEF DESCRIPTION OF THE DRAWINGS

In the attached drawings:

FIGS. 11A, 11B, 11C, 11D, 11E, 11F, 11G, and 11H illustrate the effect of coding and decoding errors on the present image data;

FIG. 73 illustrates decimation in the image memory; and

FIGS. 74A, 74B, 74C, and 74D illustrate a problem caused by decimation.

DETAILED DESCRIPTION OF THE INVENTION

Figure 1:
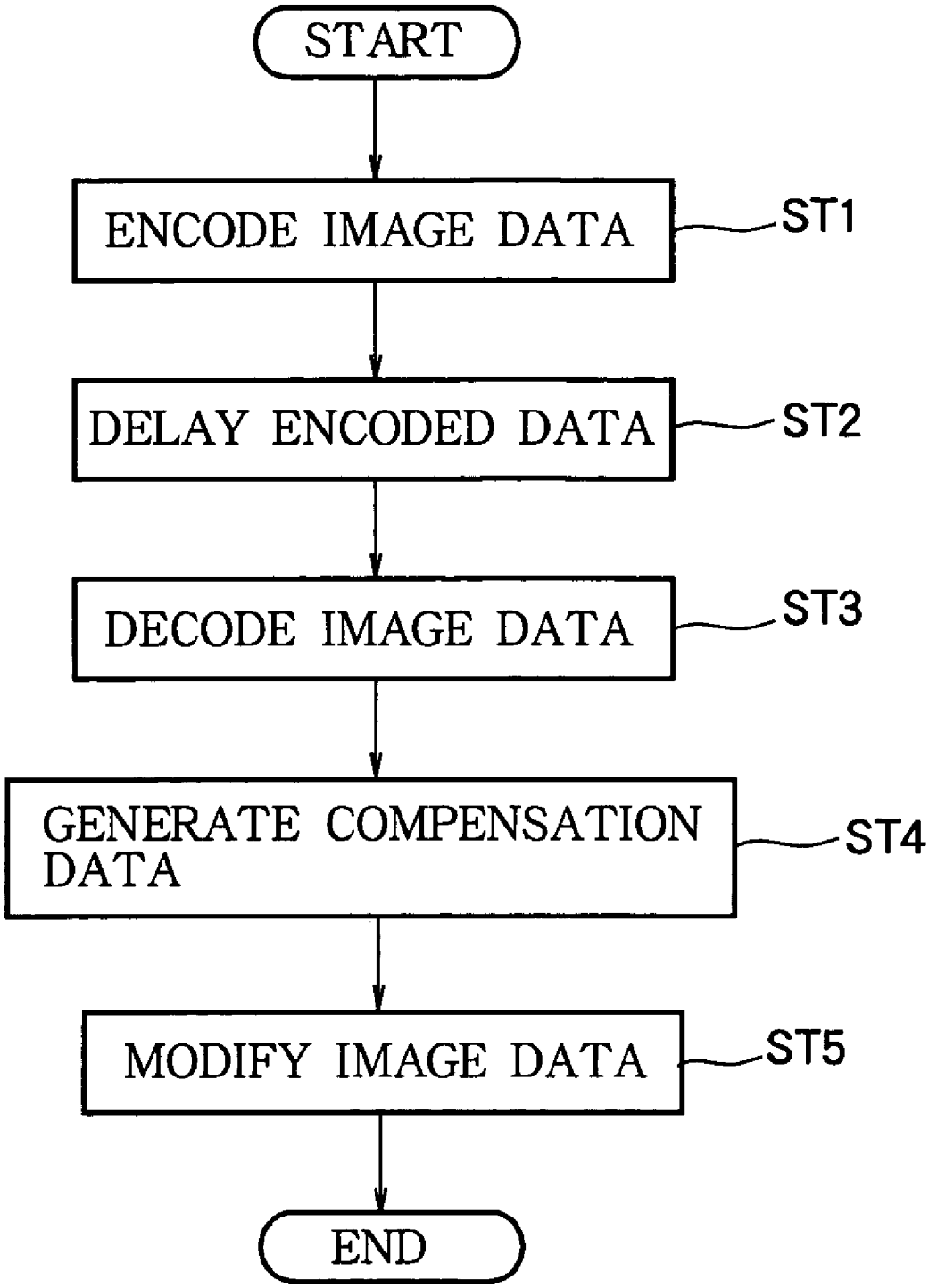
FIG. 1 is a flowchart showing the operation of a liquid-crystal driving circuit according to a first embodiment of the invention.

Embodiments of the invention will now be described with reference to the attached drawings, in which like elements are indicated by like reference characters.

Figure 2:
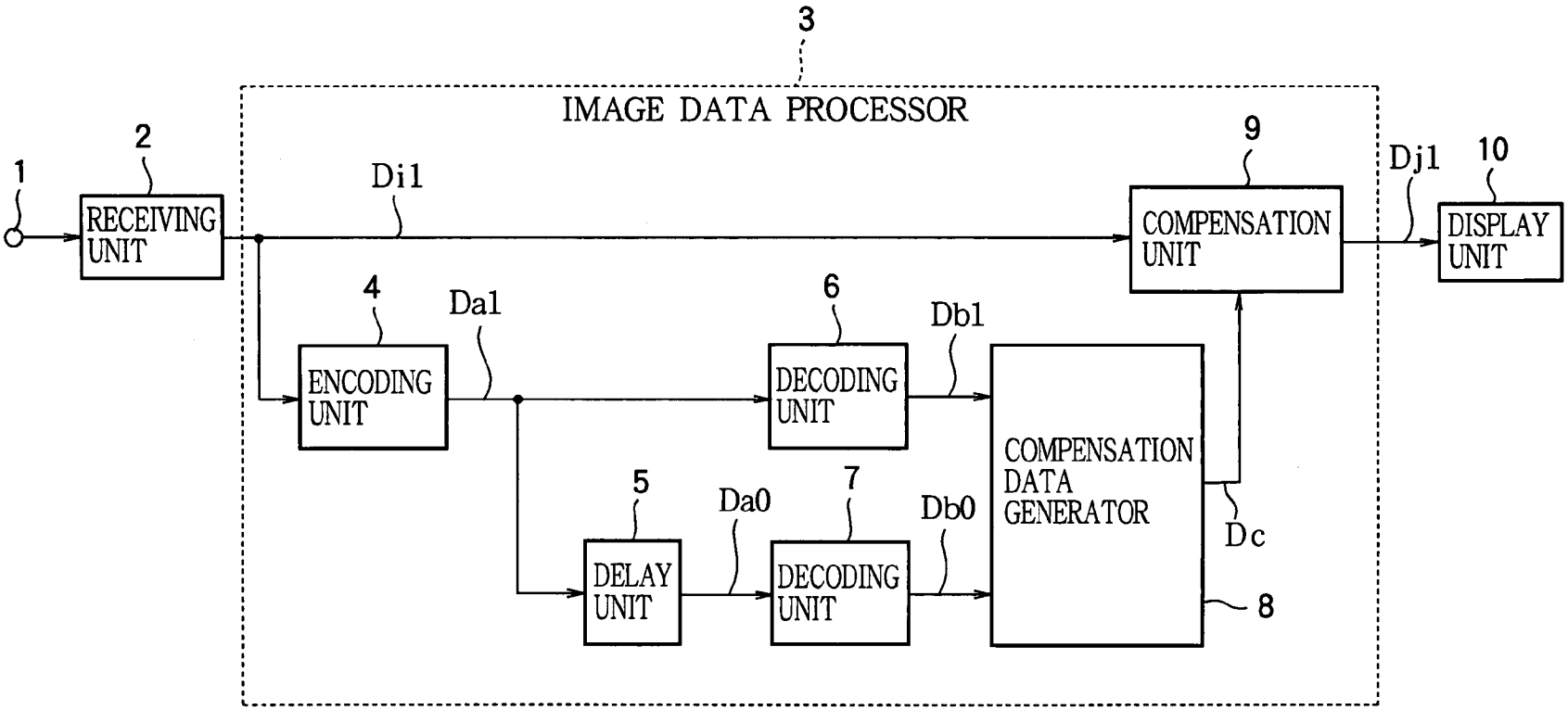
FIG. 2 is a block diagram of a liquid-crystal driving circuit according to the first embodiment.

FIG. 2 is a block diagram showing the structure of a liquid-crystal driving circuit according to a first embodiment of the invention. A receiving unit 2 receives a picture signal through an input terminal 1, and sequentially outputs present image data Di1 representing one image frame (referred to below as the present image). An image data processor 3 comprising an encoding unit 4, a delay unit 5, decoding units 6, 7, a compensation data generator 8, and a compensation unit 9 generates new image data Dj1 corresponding to the present image data Di1. A display unit 10 comprising a generally used type of liquid-crystal display panel performs the display operation by applying voltages corresponding to gray-scale values in the image to a liquid crystal.

The encoding unit 4 encodes the present image data Di1 and outputs encoded data Da1. Block truncation coding methods such as FBTC or GBTC can be used to encode the present image data Di1. Any still-picture encoding method can also be used, including two-dimensional discrete cosine transform encoding methods such as JPEG, predictive encoding methods such as JPEG-LS, and wavelet transform methods such as JPEG2000. These still-image encoding methods can be used even if they are non-reversible, so that the image data before encoding and the decoded image data are not completely identical.

The delay unit 5 delays the encoded data Da1 for one frame interval, thereby outputting the encoded data Da0 obtained by encoding the image data one frame before the present image data Di1. The delay unit 5 comprises a memory that stores the encoded data Da1 for one frame interval. Therefore, the higher the encoding ratio (data compression ratio) of the present image data Di1, the more the memory size of the delay unit 5 needed to delay the encoded data Da1 can be reduced.

The decoding unit 6 decodes the encoded data Da1, thereby outputting decoded image data Db1 corresponding to the present image represented by the present image data Di1. At the same time, the decoding unit 7 decodes the encoded data Da0 delayed by the delay unit 5, thereby outputting decoded image data Db0 corresponding to the image one frame before of the present image.

If a gray-scale value in the present image changes from one frame before, the compensation data generator 8 outputs compensation data Dc to modify the present image data Di1, according to the decoded image data Db1 and Db0, so as to cause the liquid crystal to reach the transmissivity value corresponding to the gray-scale value in the present image within one frame interval.

The compensation unit 9 adds (or multiplies) the compensation data Dc to (or by) the present image data Di1, thereby generating new image data Dj1 corresponding to the image data Di1.

The display unit 10 applies predetermined voltages to the liquid crystal, according to the image data Dj1, thereby performing the display operation.

FIG. 1 is a flowchart showing the operation of the liquid-crystal driving circuit shown in FIG. 2.

In the image data encoding step (St1), the present image data Di1 are encoded by the encoding unit 4 and the encoded data Da1 are output. In the encoding data delay step (St2), the encoded data Da1 are delayed by the delay unit 5 for one frame interval, the image data one frame before the present image data Di1 are encoded, and the encoded data Da0 are output. In the image data decoding step (St3), the encoded data Da1 and Da0 are decoded by the decoding unit 6 and decoding unit 7, and the decoded image data Db1 and Db0 are output. In the compensation data generation step (St4), the compensation data Dc are output by the compensation data generator 8 according to the decoded image data Db1 and Db0. In the image data compensation step (St5), the new image data Dj1 corresponding to the present image data Di1 are output by the compensation unit 9 according to the compensation data Dc. The operations in steps St1 to St5 above are performed for each frame of the present image data Di1.

Figure 3:
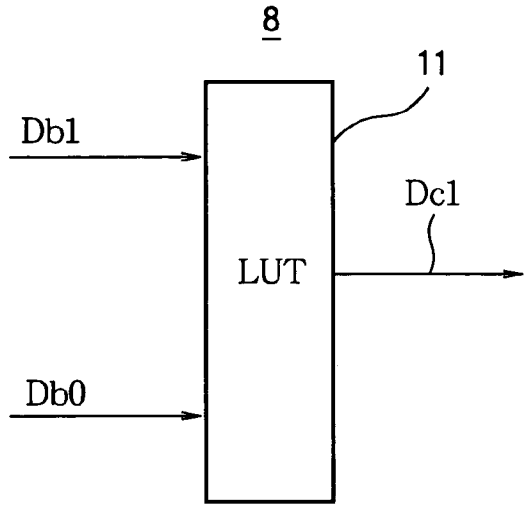
FIG. 3 shows the structure of the compensation data generator in the first embodiment.

FIG. 3 shows an example of the internal structure of the compensation data generator 8. A lookup table (LUT) 11 stores data Dc1 representing the values of the compensation data Dc determined according to the decoded image data Db0 and Db1. The output Dc1 of the lookup table 11 is used as the compensation data Dc.

Figure 4:
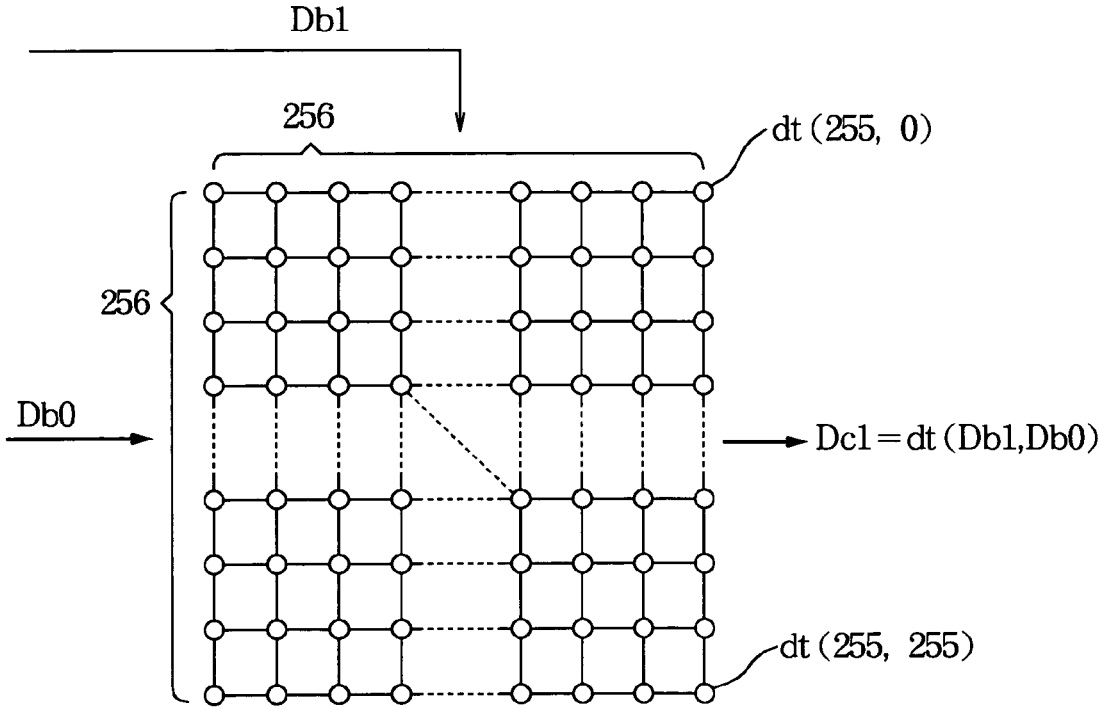
FIG. 4 schematically shows the structure of the lookup table in FIG. 3.

FIG. 4 schematically shows the structure of the lookup table 11. Here, the respective decoded image data Db0 and Db1 are eight-bit image data (256 gray levels) taking values from zero to 255. The lookup table 11 has 256×256 data arrayed two-dimensionally, and outputs the compensation data Dc1=dt(Db1, Db0) corresponding to the two values of the decoded image data Db0 and Db1 as shown in FIG. 4.

Figure 5:
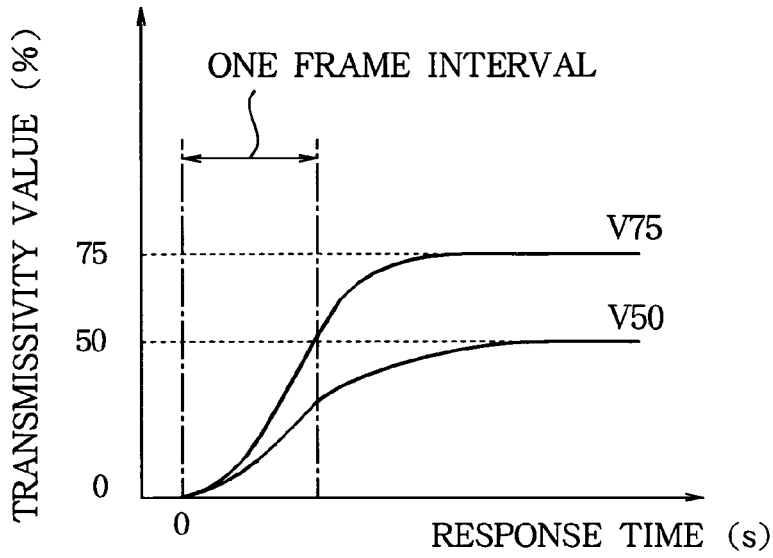
FIG. 5 shows an example of the response speed of a liquid crystal.

The compensation data Dc will be described in detail below. When the present image has an eight-bit gray scale (with gray levels from 0 to 255), if the present image data Di1=127, a voltage V50 is applied to the liquid crystal to reach a 50% transmissivity value. If the present image data Di1=191, a voltage V75 is similarly applied to the liquid crystal to reach a 75% transmissivity value. FIG. 5 shows an example of the response speed of a liquid crystal having a 0% transmissivity value when the voltages V50 and V75 are applied. A longer response time than one frame interval is needed for the liquid crystal to reach the predetermined transmissivity value, as shown in FIG. 5. Therefore, when the gray-scale value in the present image changes, the response speed of the liquid crystal can be improved by applying a voltage that causes the transmissivity value to reach the desired transmissivity value in the elapse of one frame interval.

If voltage V75 is applied, as shown in FIG. 5, the transmissivity value of the liquid crystal becomes 50% at the instant when one frame interval has elapsed. Therefore, if the target transmissivity value is 50%, the liquid crystal can reach the desired transmissivity value within one frame interval if the voltage of the liquid crystal is set to V75. Thus when the present image data Di1 changes from zero to 127, a voltage that causes the liquid crystal to reach the desired transmissivity value within one frame interval is applied to the liquid crystal by outputting the present image data as Dj1=191 to the display unit 10.

Figure 6:
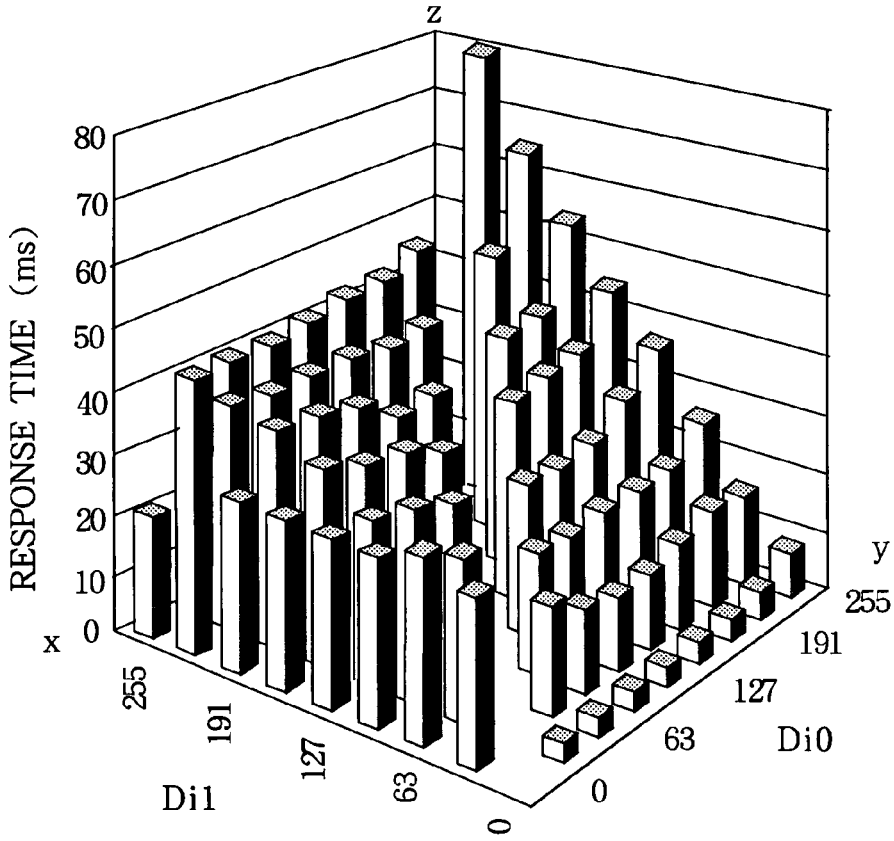
FIG. 6 shows a further example of the response speed of a liquid crystal.

FIG. 6 shows an example of the response speed of a liquid crystal, the x axis showing the value of the present image data Di1 (the gray-scale value in the present image), the y axis showing the value of the image data Dj0 one frame before (the gray-scale value in the image one frame before), and the z axis showing the response time needed for the liquid crystal to reach the transmissivity value corresponding to the gray-scale value in the present image data Di1 from the transmissivity value corresponding to the gray-scale value one frame before. If the present image has an eight-bit gray scale, there are 256×256 combinations of gray-scale values in the present image and the image one frame before, so there are 256×256 different response speeds. For simplicity, FIG. 6 shows only 8×8 response speeds corresponding to representative combinations of gray-scale values.

Figure 7:
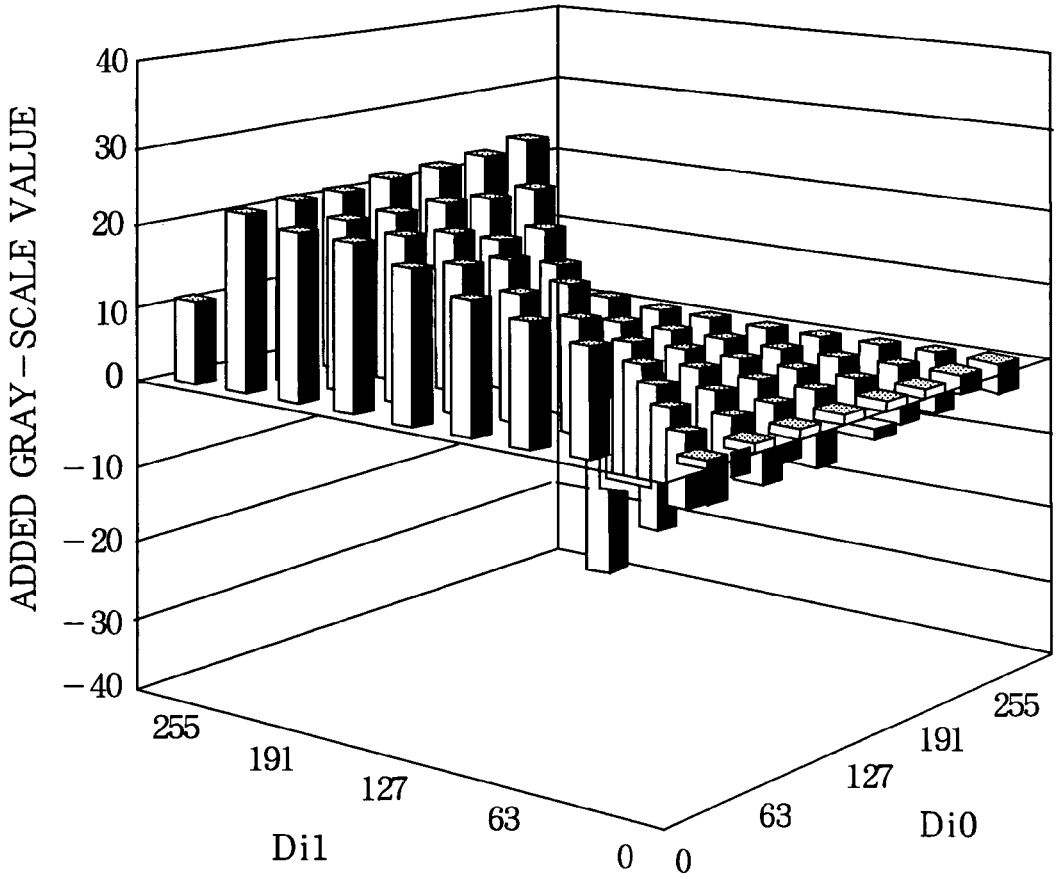
FIG. 7 shows an example of compensation data.

FIG. 7 shows the values of the compensation data Dc added to the present image data Di1 in order for the liquid crystal to reach the transmissivity value corresponding to the value of the present image data Di1 in the elapse of one frame interval. When the present image has an eight-bit gray scale, there are 256×256 values of the compensation data Dc corresponding to the combinations of gray-scale values in the present image and the image one frame before. For simplicity, FIG. 7 shows only 8×8 values of the compensation data corresponding to representative combinations of the gray-scale values.

Since the response speed of the liquid crystal differs for each gray-scale value in the present image and the image one frame before, as shown in FIG. 6, and the value of the compensation data Dc cannot be obtained by a simple equation, the 256×256 values of compensation data Dc corresponding to the two gray-scale values in the present image and the image one frame before are stored in the lookup table 11.

Figure 8:
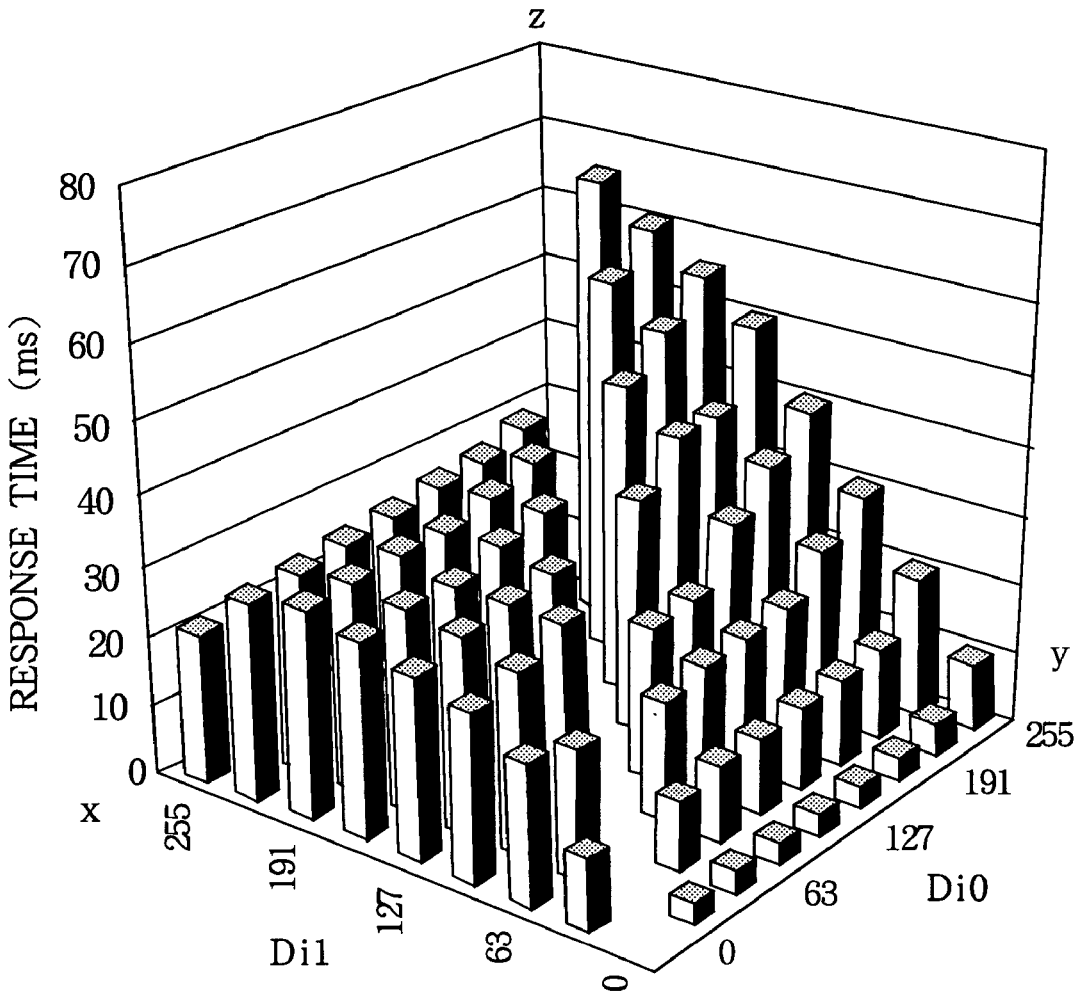
FIG. 8 shows another example of the response speed of a liquid crystal.
Figure 9:
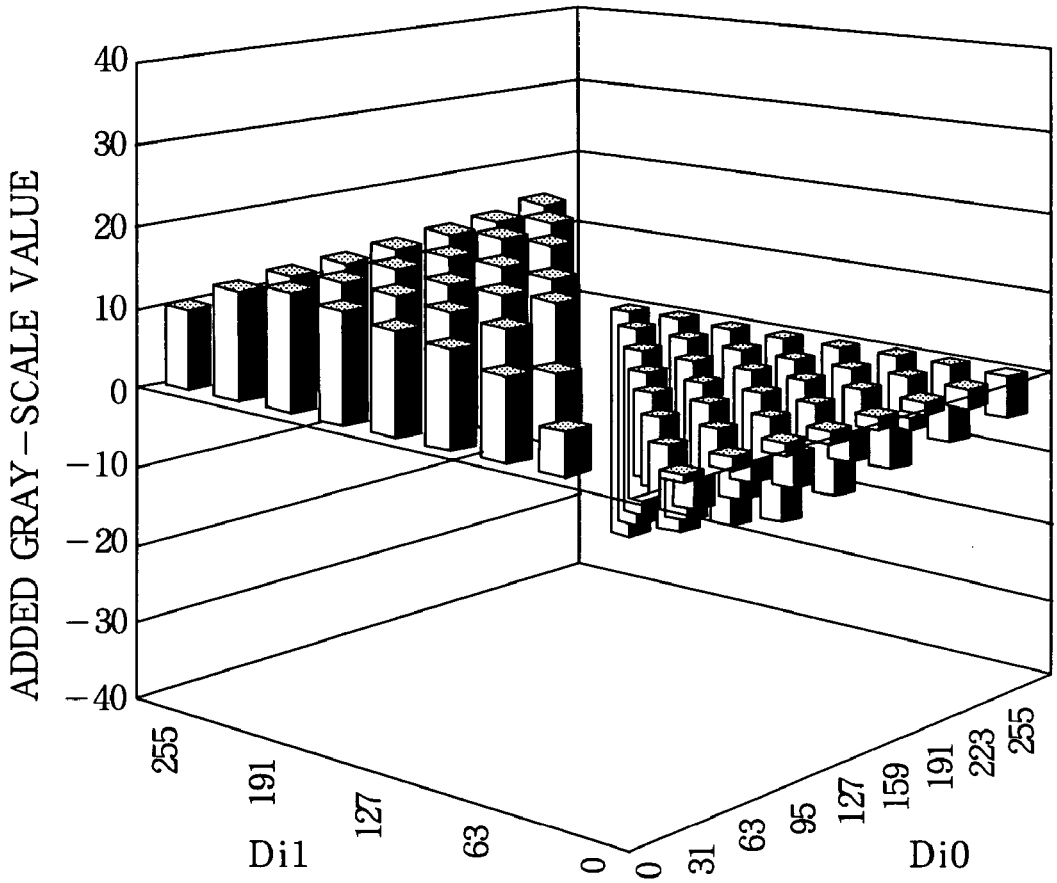
FIG. 9 shows another example of compensation data.

FIG. 8 shows another example of the response speed of a liquid crystal. FIG. 9 shows the values of the compensation data Dc added to the present image data Di1 for a liquid crystal having the response characteristics shown in FIG. 8 to reach the transmissivity value corresponding to the value of the present image data Di1 in the elapse of one frame interval. Since the response characteristics of the liquid crystal change according to the liquid crystal material, electrode shape, temperature, and so on as shown in FIG. 6 and FIG. 8, the response speed can be controlled according to the characteristics of the liquid crystal by using a lookup table 11 supplied with compensation data Dc corresponding to these usage conditions.

The compensation data Dc=dt(Db1, Db0) are arranged so that the size of the compensation increases for combinations of gray-scale values for which the liquid crystal has slower response speeds. The liquid crystal is particularly slow in responding to changes from an intermediate gray level (gray) to a high gray level (white). Therefore, the response speed can be improved effectively by setting the compensation data dt(Db1, Db0) corresponding to decoded image data Db0 representing an intermediate gray level and decoded image data Db1 representing a high gray level to large values.

The compensation data generator 8 outputs the data Dc1 output by the lookup table 11 as the compensation data Dc. The compensation unit 9 adds the compensation data Dc to the present image data Di1, thereby outputting new image data Dj1 corresponding to the present image. The display unit 10 applies voltages corresponding to the gray-scale values in the new image data Dj1 to the liquid crystal, thereby performing the display operation.

Figure 10A:
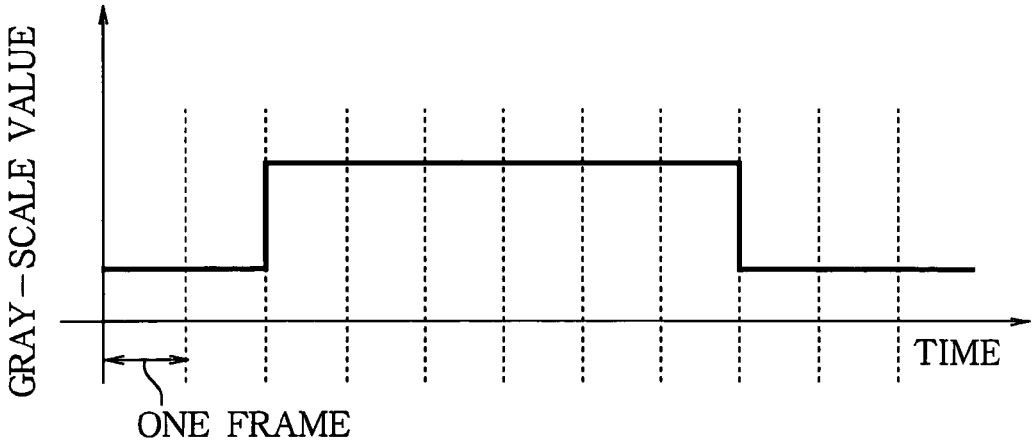
FIGS. 10A, 10B, and 10C illustrate the operation of the first embodiment.
Figure 10B:
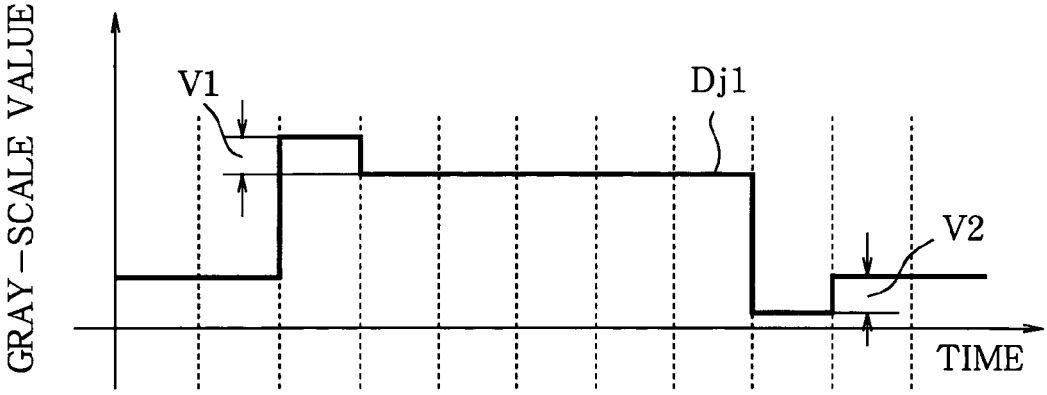
Figure 10C:
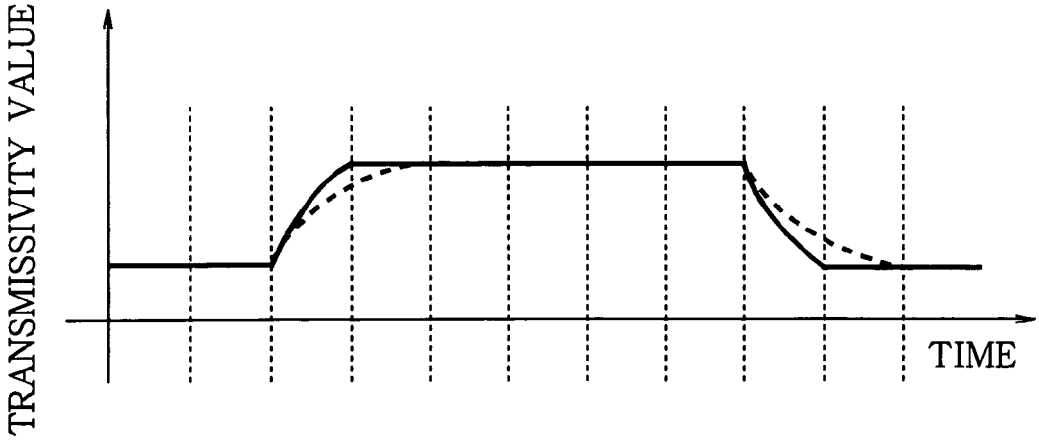

FIGS. 10A to 10C illustrate the operation of the liquid-crystal driving circuit according to this embodiment. FIG. 10A shows the value of the present image data Di1, FIG. 10B shows the value of the image data Dj1 modified according to the compensation data Dc, and FIG. 10C. shows the response characteristics of the liquid crystal when voltage is applied according to the image data Dj1. The characteristic shown by the dashed curve in FIG. 10C. is the response characteristic of the liquid crystal when voltage is applied according to the present image data Di1. When the gray-scale value increases or decreases as shown in FIG. 10B, compensation values V1 and V2 are added to or subtracted from the present image data Di1 according to the compensation data Dc, thereby generating image data Dj1 representing a new image corresponding to the present image. Voltage is applied to the liquid crystal in the display unit 10 according to the image data Dj1, thereby driving the liquid crystal to the predetermined transmissivity value within substantially one frame interval as shown in FIG. 10C.

In the liquid-crystal driving circuit of this embodiment, the memory size needed to delay the present image data Di1 for one frame interval can be reduced because the encoding unit 4 encodes the present image data Di1, compressing the data size, and the compressed data are delayed. Since the pixel information of the present image data Di1 is not decimated, but is encoded and decoded, compensation data Dc with appropriate values are generated and the response speed of the liquid crystal can be controlled accurately.

Since the compensation data Dc are generated according to the decoded image data Db0 and Db1 that have been encoded and decoded by the encoding unit 4 and decoding units 6, 7, the image data Dj1 are not affected by coding and decoding errors, as described below.

FIGS. 11A to 11H illustrate the effect of coding and decoding errors on the image data Dj1. FIG. 11D schematically shows the values of the present image data Di1 representing the present image, and FIG. 11A schematically shows the values of the image data Di0 representing the image one frame before the present image. As FIGS. 11D and 11A indicate, the present image data Di1 are unchanged from the image data Di0 one frame before. FIGS. 11E and 11B schematically show the encoded data corresponding to the present image data Di1 and the image data Di0 one frame before, shown in FIGS. 11D and 11A. FIGS. 11B and 11E show encoded data obtained by the FTBC encoding method, using eight-bit representative values La and Lb, one bit being assigned to each pixel. FIGS. 11C and 11F show the decoded image data Db0 and Db1 obtained by decoding the encoded data shown in FIGS. 11B and 11E. FIG. 11G shows the values of the compensation data Dc generated according to the decoded image data Db0 and Db1 in FIGS. 11C and 11F; FIG. 11H shows the image data Dj1 output from the compensation unit 9 to the display unit 10 at this time.

Even if the encoding and decoding of the present image data Di1 leads to errors, as shown in FIGS. 11D and 11F, when the compensation data Dc are generated according to the decoded image data Db0 and Db1 shown in FIGS. 11C and 11F, the values of the compensation data Dc become zero as shown in FIG. 11G. Thus, the image data Dj1 are not affected by the coding and decoding errors, but are output to the display unit 10 as shown in FIG. 11H.

Although eight-bit data are input to the lookup table 11 in the description above, the number of bits is not limited to eight; any number of bits may be used, provided the number is sufficient for compensation data to be generated by a method such as interpolation.

The values of the compensation data Dc may be used as multipliers by which the present image data Di1 are multiplied. In this case, the compensation data Dc represent scale factor coefficients that vary around 1.0 according to the size of the compensation, and the compensation unit 9 includes a multiplier. The compensation data Dc should be set so that the image data Dj1 do not exceed the maximum gray level that the display unit 10 can display.

Figure 13:
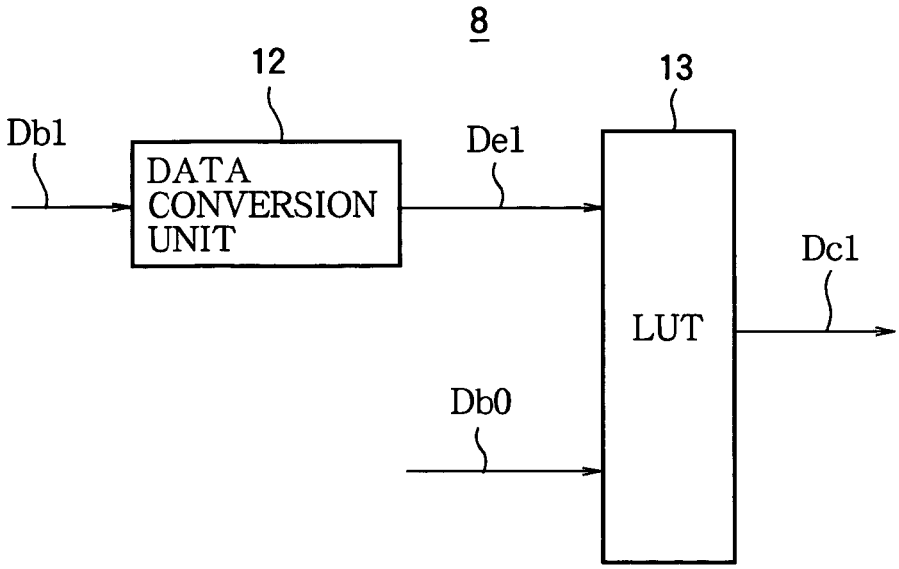
FIG. 13 shows a first structure of the compensation data generator in the second embodiment.

FIG. 13 shows a first structure of the compensation data generator 8 according to a second embodiment of the invention. A data conversion unit 12 converts the number of bits with which decoded image data Db1 are quantized, by reducing the number from eight bits to three bits, for example, and outputs new decoded image data De1 corresponding to the decoded image data Db1. A lookup table 13 outputs the compensation data Dc1 according to decoded image data Db0 and the decoded image data De1 with the converted number of bits.

Figure 12:
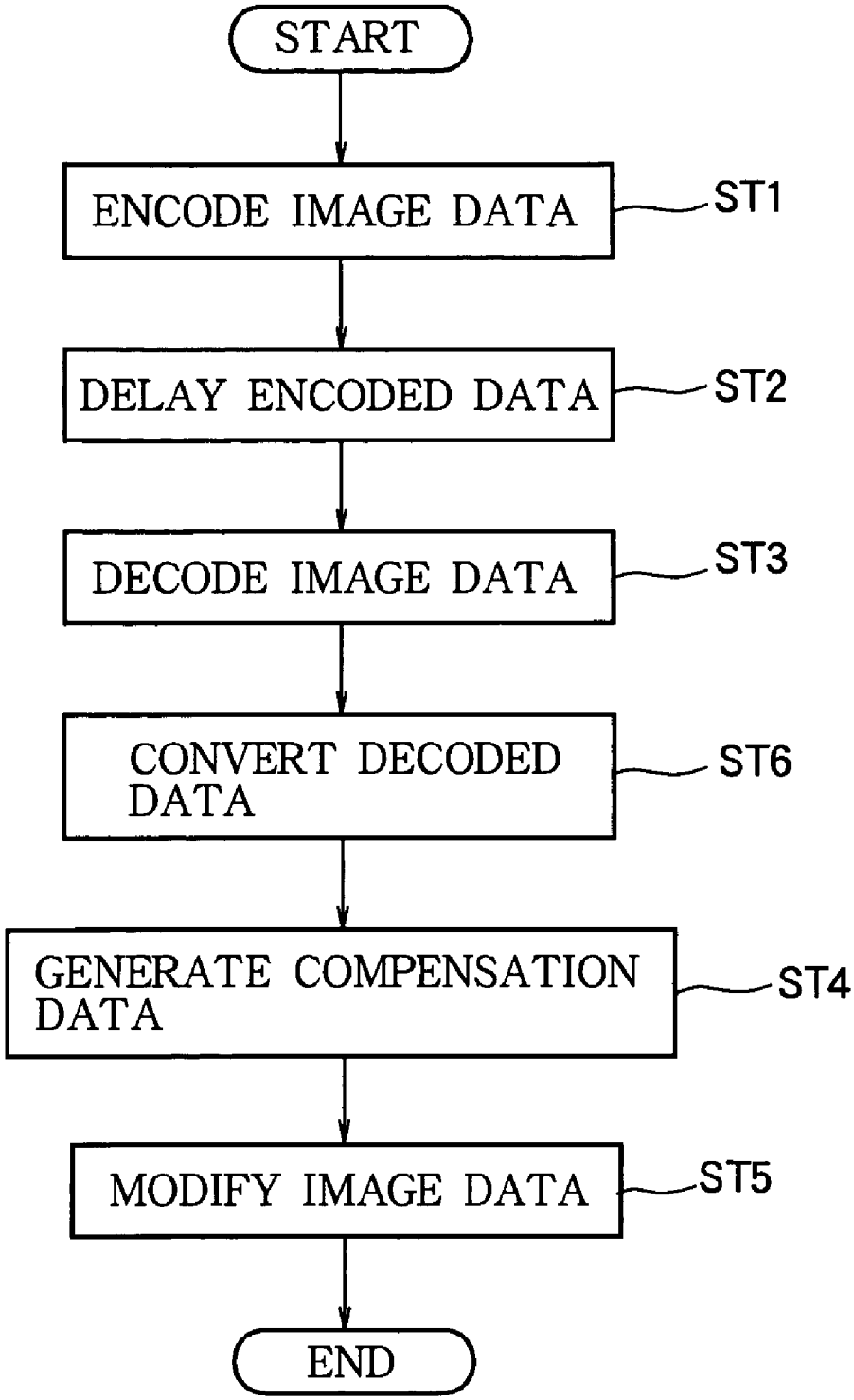
FIG. 12 is a flowchart showing the operation of a liquid-crystal driving circuit according to a second embodiment.

FIG. 12 is a flowchart showing the operation of a liquid-crystal driving circuit having the compensation data generator 8 shown in FIG. 13. In the decoded data conversion step (St6), the number of bits with which the decoded image data Db1 are quantized is reduced by the data conversion unit 12. In the following compensation data generation step (St4), the compensation data Dc1 are output from the lookup table 13 according to decoded image data Db0 and the decoded image data De1 converted to a smaller number of bits. The operations performed in the other steps are as described in the first embodiment.

Figure 14:
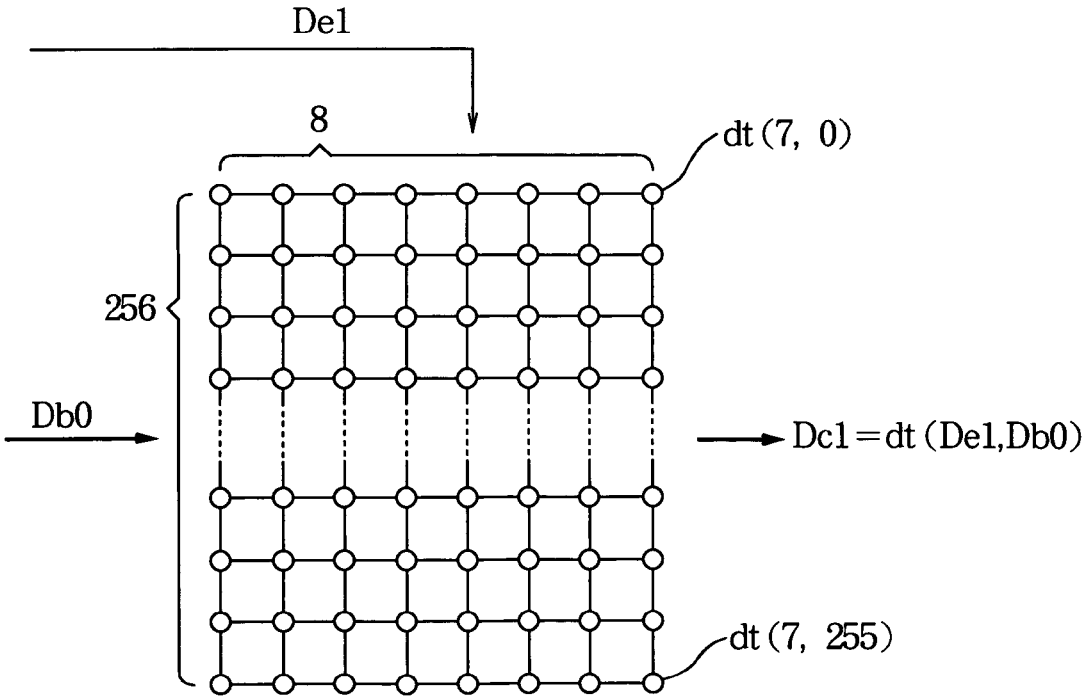
FIG. 14 schematically shows the structure of the lookup table in FIG. 13.

FIG. 14 schematically shows the structure of the lookup table 13 in FIG. 13. Here, the decoded image data De1 with the converted number of bits are three-bit image data (eight gray levels) taking values from zero to seven. The lookup table 13 has 256×8 data arrayed two-dimensionally, and outputs data Dc1=dt(De1, Db0) corresponding to the three-bit value of decoded image data De1 and the eight-bit value of decoded image data Db0.

To convert the number of quantization bits, the data conversion unit 12 may employ either a linear quantization method, or a nonlinear quantization method in which the quantization density of the gray-scale values varies.

Figure 15:
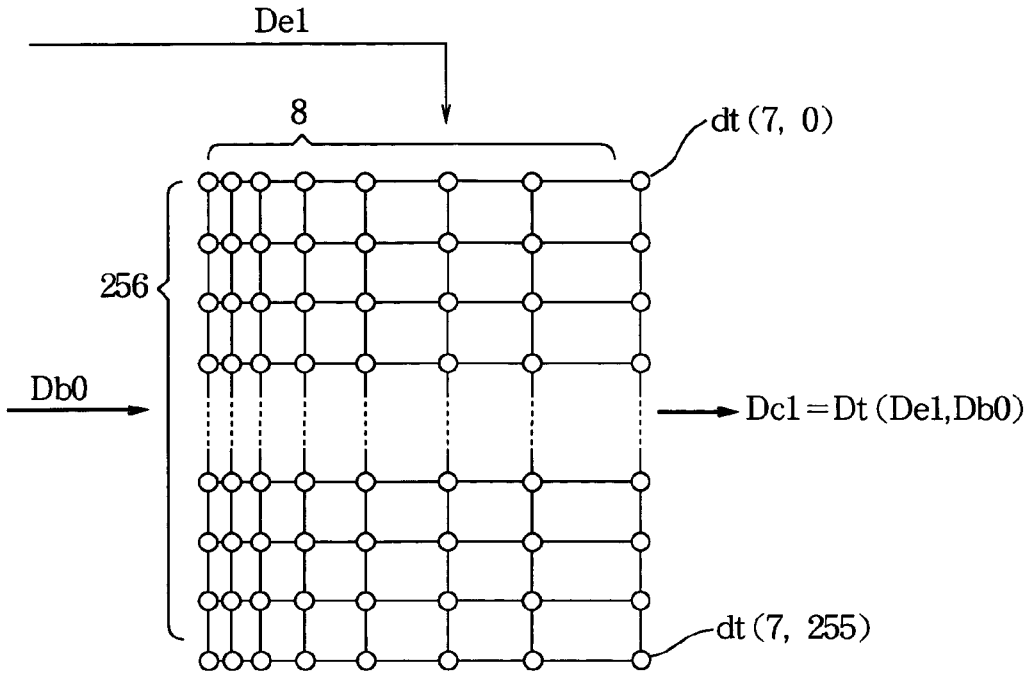
FIG. 15 schematically shows the structure of the lookup table in FIG. 13.

FIG. 15 schematically shows the structure of the lookup table 13 when the decoded image data De1 have been converted to a smaller number of bits by a nonlinear quantization method. In this case, the data conversion unit 12 compares the gray-scale value of the decoded image data Db1 with several threshold values preset corresponding to the number of converted bits, and outputs the nearest threshold value as the decoded image data De1. The horizontal intervals between the compensation data Dc1 in FIG. 15 correspond to the intervals between the threshold values.

When the number of bits is converted by a nonlinear quantization method, the errors in the compensation data Dc1 resulting from reduction of the number of bits can be reduced by setting a high quantization density in areas where the size of the compensation varies greatly.

Figure 16:
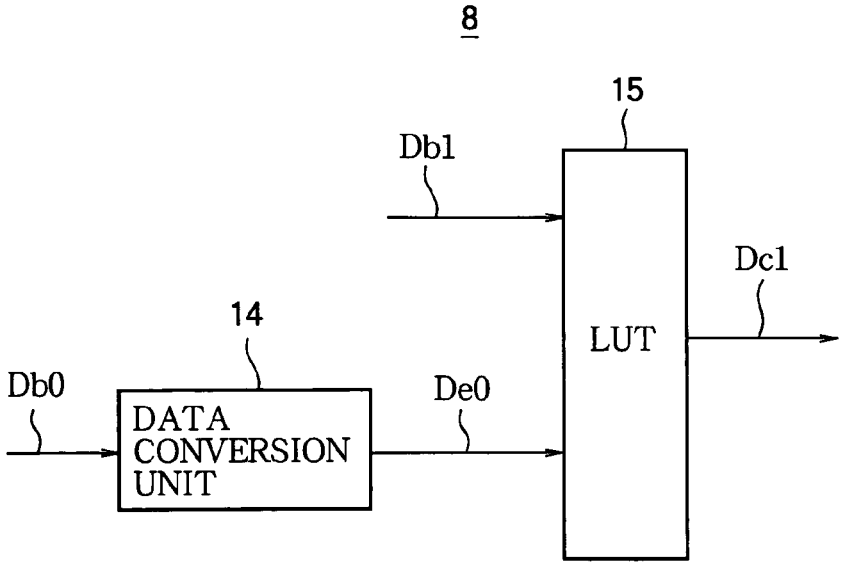
FIG. 16 shows a second structure of the compensation data generator in the second embodiment.

FIG. 16 shows a second structure of the compensation data generator 8 according to this embodiment. A data conversion unit 14 converts the number of bits with which decoded image data Db0 are quantized, by reducing the number from eight bits to three bits, for example, and outputs new decoded image data De0 corresponding to the decoded image data Db0. A lookup table 15 outputs the compensation data Dc1 according to the decoded image data Db1 and the decoded image data De0 with the converted number of bits.

Figure 17:
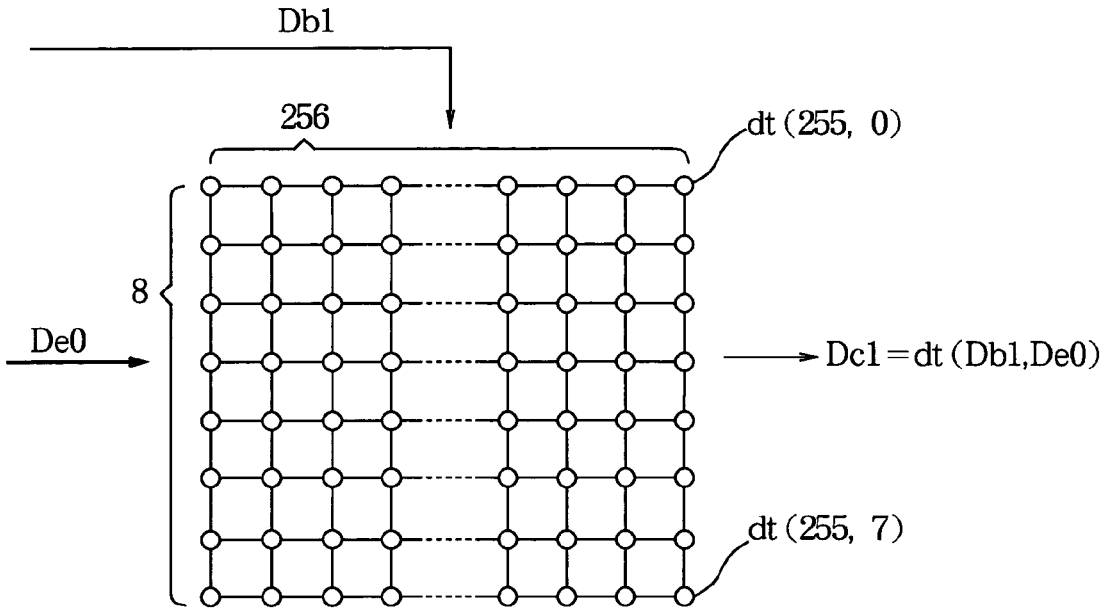
FIG. 17 schematically shows the structure of the lookup table in FIG. 16.

FIG. 17 schematically shows the structure of the lookup table 15 in FIG. 16. Here, the decoded image data De0 with the converted number of bits are three-bit image data (eight gray levels) taking values from zero to seven. The lookup table 15 has 8×256 data arrayed two-dimensionally, and outputs data Dc1=dt(Db1, De0) corresponding to the eight-bit value of decoded image data Db1 and the three-bit value of decoded image data De0.

To convert the number of quantization bits, the data conversion unit 14 may employ either a linear quantization method, or a nonlinear quantization method in which the quantization density of the gray-scale values varies.

Figure 18:
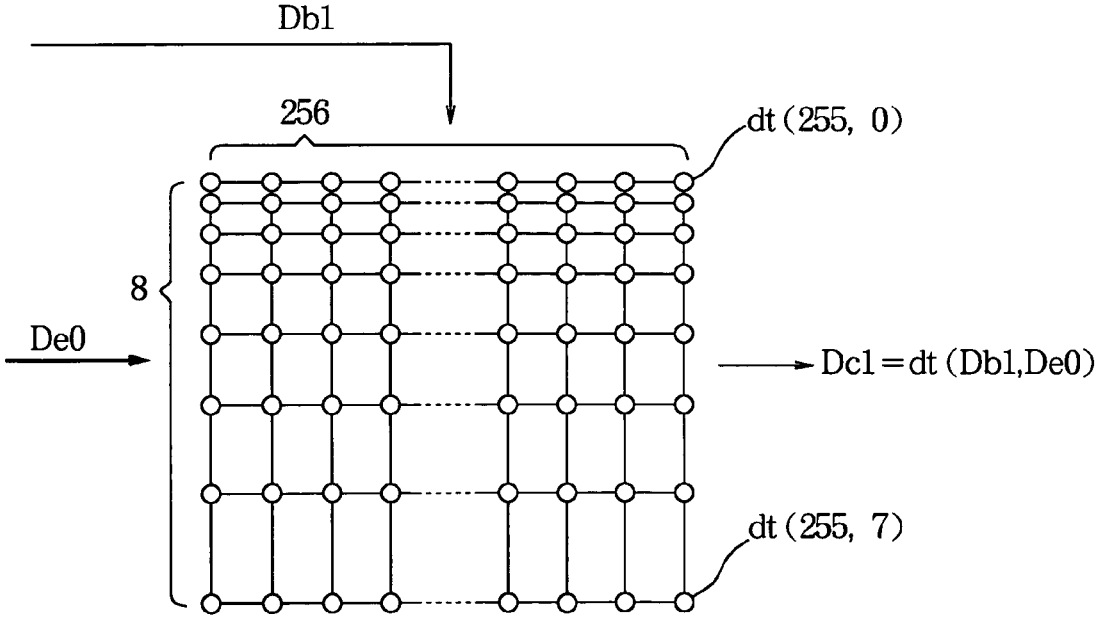
FIG. 18 schematically shows the structure of the lookup table in FIG. 16.

FIG. 18 schematically shows the structure of the lookup table 13 when the decoded image data De0 have been converted to a smaller number of bits by a nonlinear quantization method.

Figure 19:
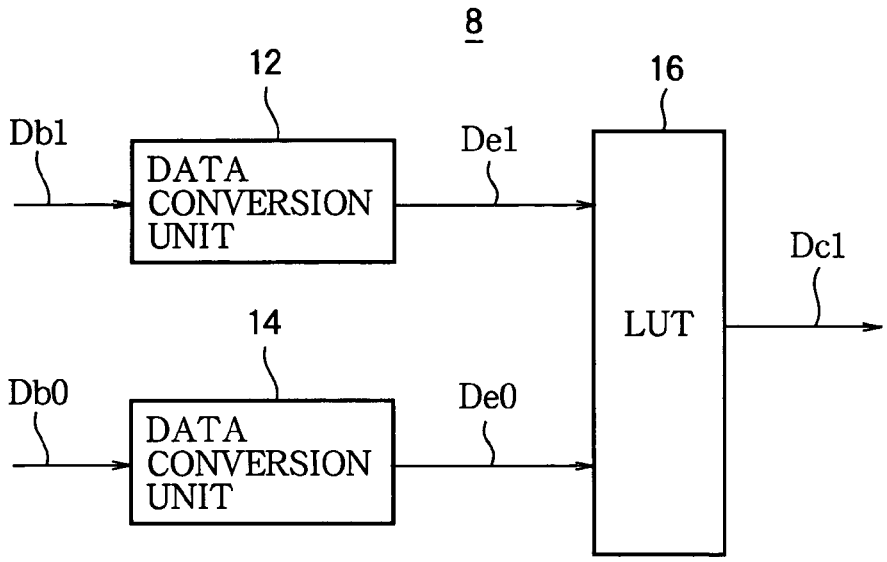
FIG. 19 shows a third structure of the compensation data generator in the second embodiment.

FIG. 19 shows a third structure of the compensation data generator 8 according to this embodiment. Data conversion units 12, 14 convert the number of bits with which decoded image data Db1 and Db0 are quantized, by reducing the number from eight bits to three bits, for example, and output new decoded image data De1 and De0 corresponding to the decoded image data Db1 and Db0. A lookup table 16 outputs the compensation data Dc1 according to the decoded image data De0 and De1 with the converted number of bits.

Figure 20:
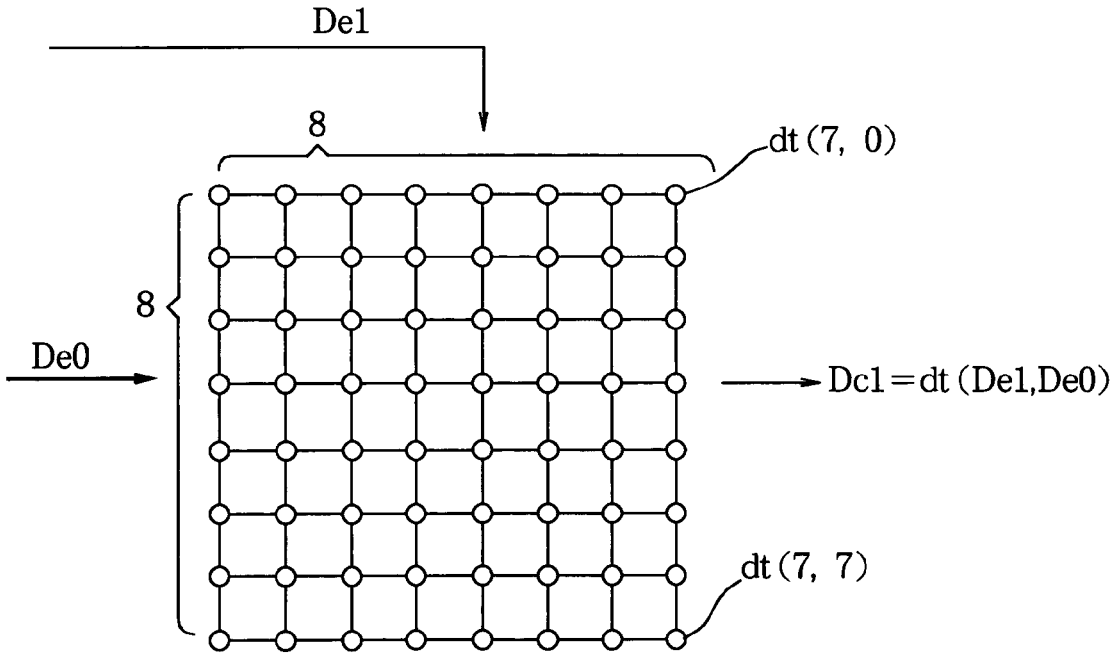
FIG. 20 schematically shows the structure of the lookup table in FIG. 19.

FIG. 20 schematically shows the structure of the lookup table 16 in FIG. 19. The decoded image data De1 and De0 with the converted number of bits are three-bit image data (eight gray levels) taking values from zero to seven. The lookup table 16 has 8×8 data arrayed two-dimensionally, and outputs compensation data Dc1=dt(De1, De0) corresponding to the two three-bit values of the decoded image data De1 and De0.

To convert the number of quantization bits, the data conversion units 12, 14 may employ either a linear quantization method, or a nonlinear quantization method in which the quantization density of the gray-scale values varies.

Figure 21:
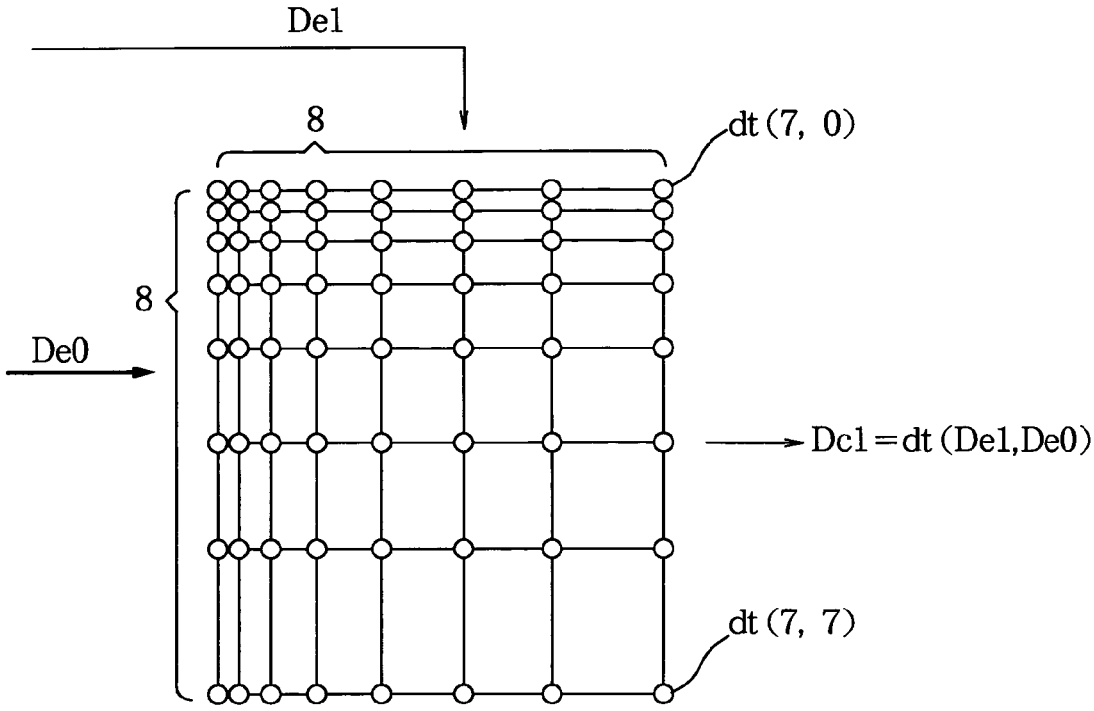
FIG. 21 schematically shows the structure of the lookup table in FIG. 19.

FIG. 21 schematically shows the structure of the lookup table 16 when the decoded image data De1 and De0 are both converted to a smaller number of bits by a nonlinear quantization method.

By reducing the number of bits with which decoded image data Db1 and/or Db0 are quantized as described above, it is possible to reduce the amount of data stored in the lookup table 13, 15, or 16, and simplify the structure of the compensation data generator 8.

Although the number of quantization bits was converted from eight bits to three bits by data conversion units 12, 14 in the description above, the converted number of bits is not limited to three; any number of bits may be used, provided the number is sufficient for compensation data to be generated by a method such as interpolation.

Figure 23:
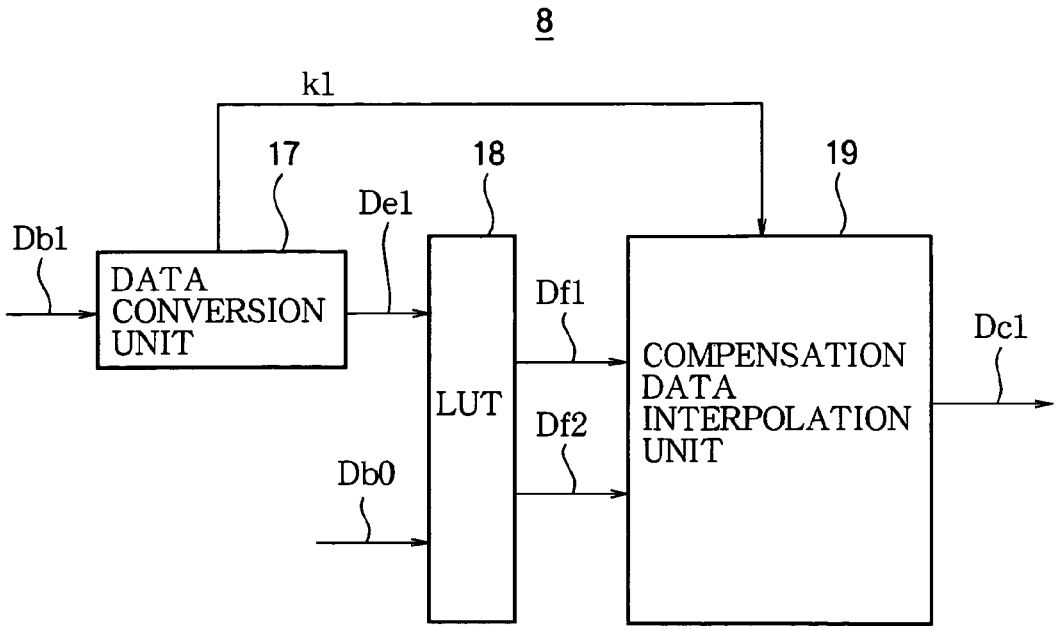
FIG. 23 shows a first structure of the compensation data generator in the third embodiment.

FIG. 23 shows a first structure of the compensation data generator 8 according to a third embodiment of the invention. A data conversion unit 17 quantizes decoded image data Db1 by a linear quantization method, converting the number of bits from eight to three, for example, and outputs new decoded image data De1 with the converted number of bits. At the same time, the data conversion unit 17 calculates an interpolation coefficient k1 described below. A lookup table 18 outputs two internal compensation data values Df1 and Df2 according to the three-bit decoded image data De1 with the converted number of bits and the eight-bit decoded image data Db0. A compensation data interpolation unit 19 generates compensation data Dc1 according to these two compensation data values Df1 and Df2 and the interpolation coefficient k1.

Figure 22:
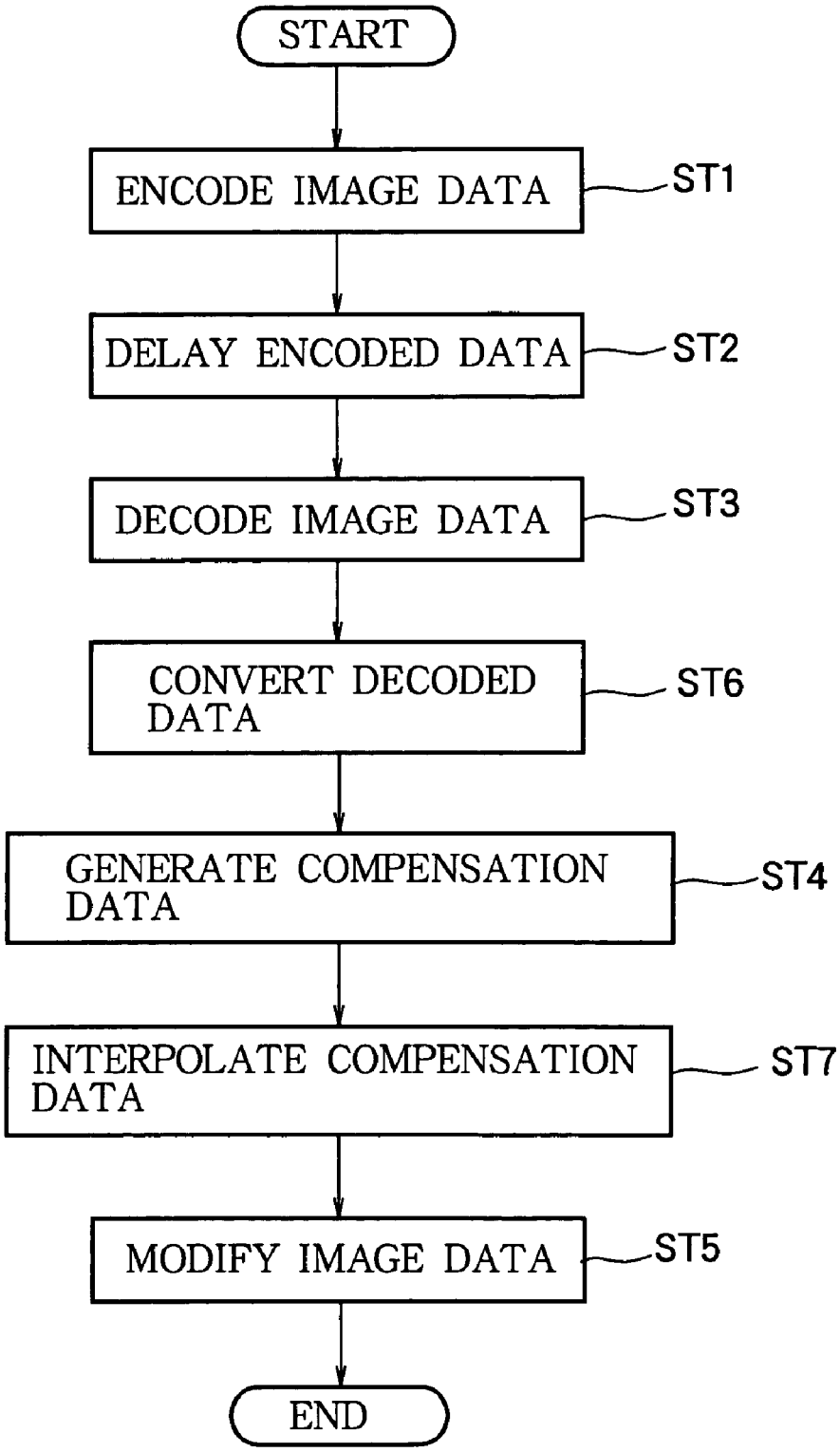
FIG. 22 is a flowchart showing the operation of a liquid-crystal driving circuit according to a third embodiment.

FIG. 22 is a flowchart showing the operation of a liquid-crystal driving circuit having the compensation data generator 8 according to the embodiment in FIG. 23. In the decoded data conversion step (St6), the data conversion unit 17 converts the number of bits by reducing the number of bits with which the decoded image data Db1 are quantized, and outputs the interpolation coefficient k1. In the compensation data generation step (St4), the lookup table 18 outputs the two compensation data values Df1 and Df2 according to the decoded image data Db0 and the decoded image data De1 converted to a smaller number of bits. In the compensation data interpolation step (St7), the compensation data interpolation unit 19 generates the compensation data Dc1 according to the two compensation data values Df1 and Df2 and the interpolation coefficient k1. The operations performed in the other steps are as described in the first embodiment.

Figure 24:
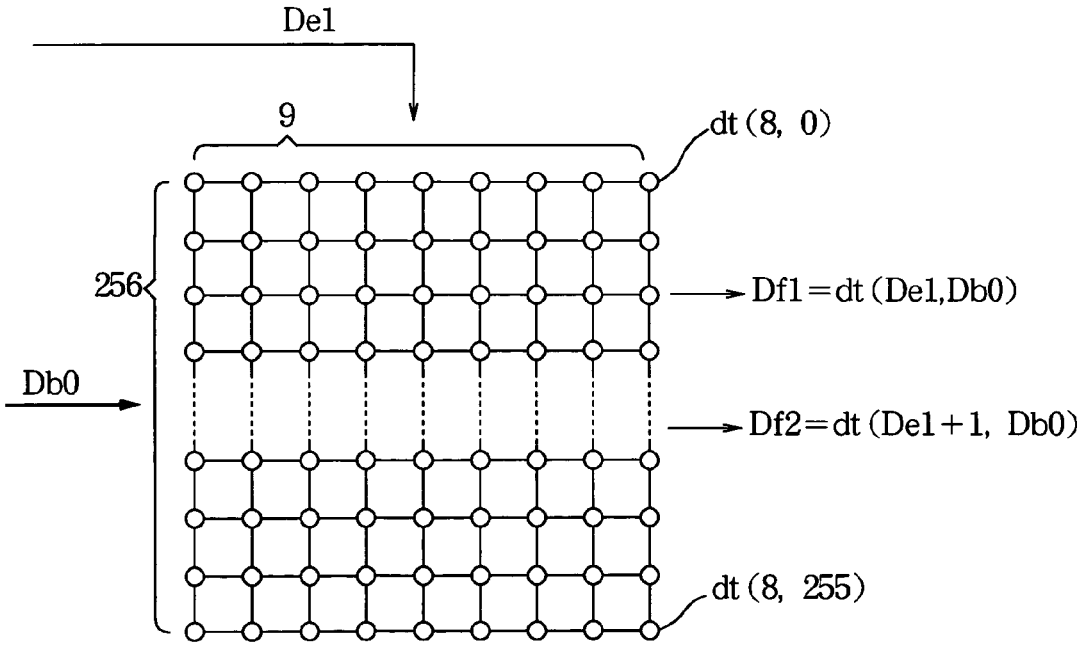
FIG. 24 schematically shows the structure of the lookup table in FIG. 23.

FIG. 24 schematically shows the structure of the lookup table 18. The decoded image data De1 with the converted number of bits are three-bit image data (eight gray levels) taking values from zero to seven. The lookup table 18 has 256×9 data arrayed two-dimensionally, and outputs compensation data dt(De1, Db0) corresponding to the three-bit value of decoded image data De1 and the eight-bit value of decoded image data Db0 as compensation data value Df1, and also outputs compensation data dt(De1+1, Db0) from the position next to compensation data value Df1 as compensation data Df2.

The compensation data interpolation unit 19 uses the internal compensation data values Df1 and Df2 and the interpolation coefficient k1 to calculate the compensation data Dc1 by equation (1) below.

$$Dc1=(1-k1)\times Df1+k1\times Df2 \quad (1)$$

Figure 25:
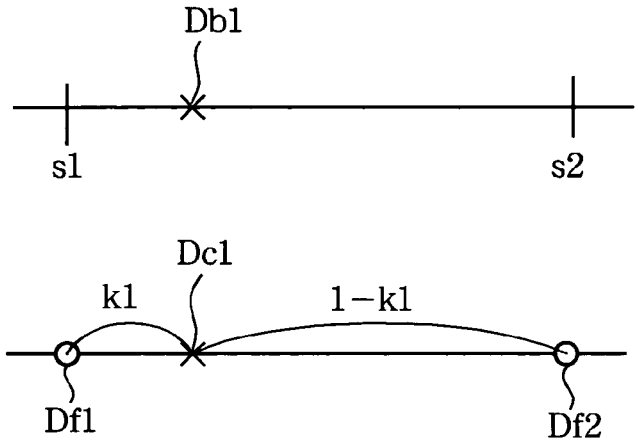
FIG. 25 illustrates the method of calculation of the compensation data.

FIG. 25 illustrates the method of calculation of the compensation data Dc1 represented by equation (1) above. The values s1 and s2 are threshold values used when the number of bits of the decoded image data Db1 is converted by the data conversion unit 17: s1 is the threshold value corresponding to the decoded image data De1 with the converted number of bits, and s2 is the threshold value corresponding to the decoded image data De1+1 that is one gray level (with the converted number of bits) greater than the decoded image data De1.

The interpolation coefficient k1 is calculated by equation (2) below, $$k1=(Db1-s1)/(s2-s1) \quad (2)$$

where, s1<Db1≦s2.

The compensation data Dc1 calculated by the interpolation operation are output from the compensation data generator 8 to the compensation unit 9 as the compensation data Dc in FIG. 2. The compensation unit 9 modifies the present image data Di1 according to the compensation data Dc, and sends the modified image data Dj1 to the display unit 10.

When the compensation data Dc1 are obtained by interpolation from the two compensation data values Df1 and Df2 corresponding to the decoded image data (De1, Db0) and (De1+1, Db0), using the interpolation coefficient k1 that is calculated when the number of bits of the decoded image data Db1 is converted as described above, the effect of quantization errors in the decoded image data De1 on the compensation data Dc can be reduced.

Figure 26:
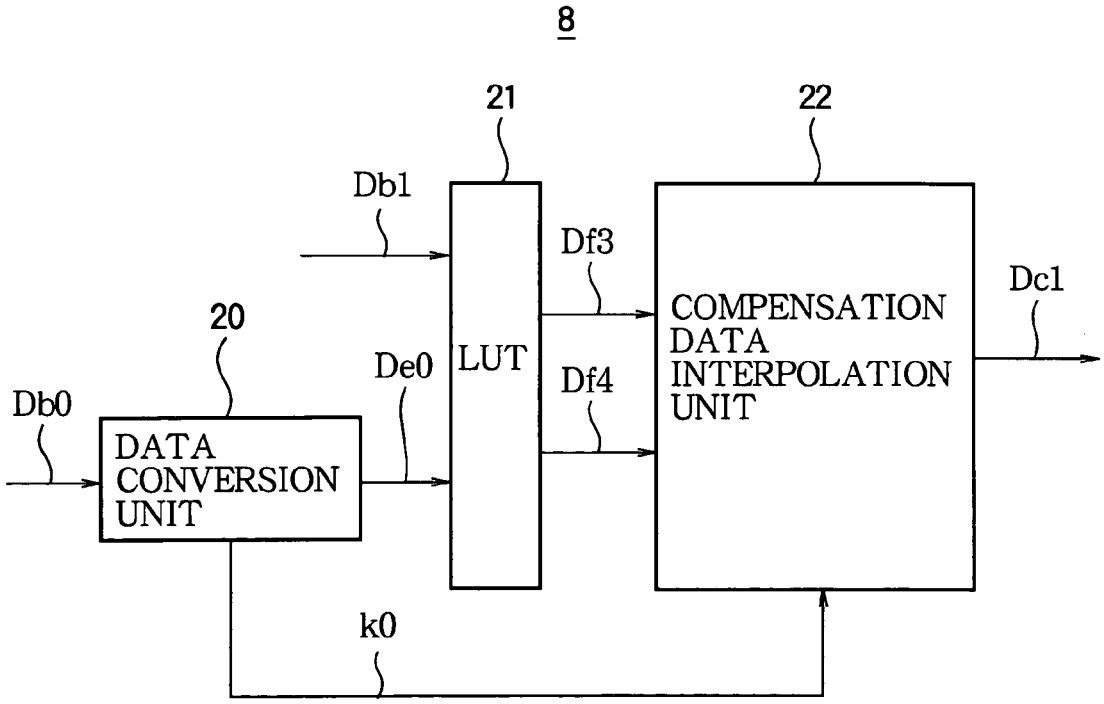
FIG. 26 shows a second structure of the compensation data generator in the third embodiment.

FIG. 26 shows a second structure of the compensation data generator 8 according to the third embodiment. A data conversion unit 20 quantizes decoded image data Db0 by a linear quantization method, converting the number of bits from eight to three, for example, and outputs new decoded image data De0 with the converted number of bits. At the same time, the data conversion unit 20 calculates an interpolation coefficient k0 described below. A lookup table 21 outputs two internal compensation data values Df3 and Df4 according to the three-bit decoded image data De0 with the converted number of bits and the eight-bit decoded image data Db1. A compensation data interpolation unit 22 generates compensation data Dc1 according to these two compensation data values Df3 and Df4 and the interpolation coefficient k0.

Figure 27:
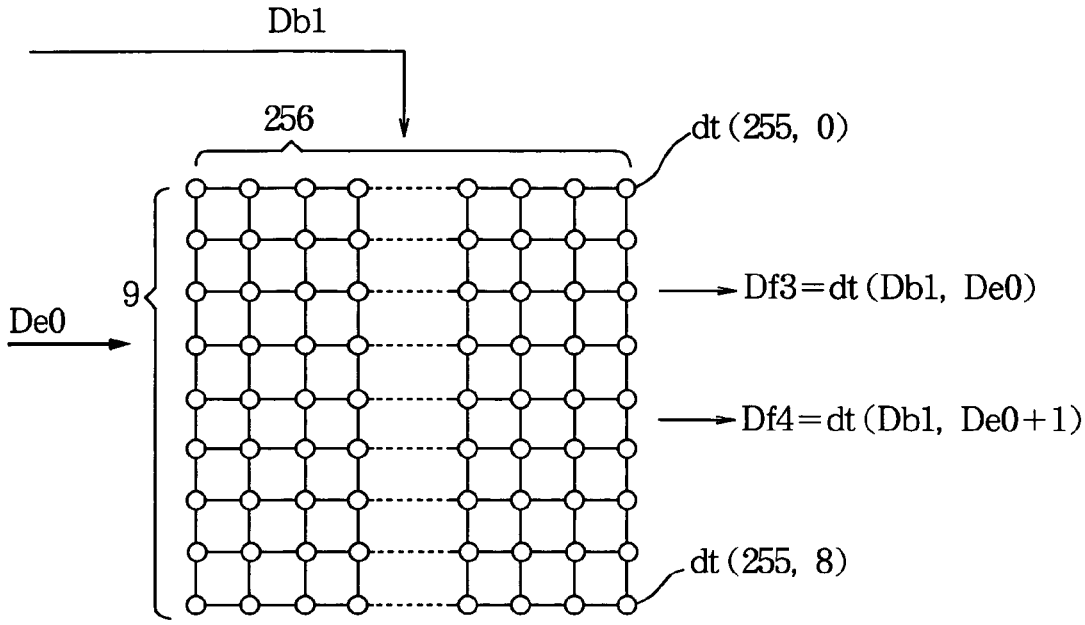
FIG. 27 schematically shows the structure of the lookup table in FIG. 26.

FIG. 27 schematically shows the structure of the lookup table 21. The decoded image data De0 with the converted number of bits are three-bit image data (eight gray levels) taking values from zero to seven. The lookup table 21 has 256×9 data arrayed two-dimensionally, and outputs compensation data dt(Db1, De0) corresponding to the eight-bit value of decoded image data Db1 and the three-bit value of decoded image data De0 as compensation data value Df3, and also outputs compensation data dt(Db1, De0+1) from the position next to compensation data value Df3 as compensation data Df4.

The compensation data interpolation unit 22 uses the internal compensation data values Df3 and Df4 and the interpolation coefficient k0 to calculate the compensation data Dc1 by equation (3) below.

$$Dc1=(1-k0)\times Df3+k0\times Df4 \quad (3)$$

Figure 28:
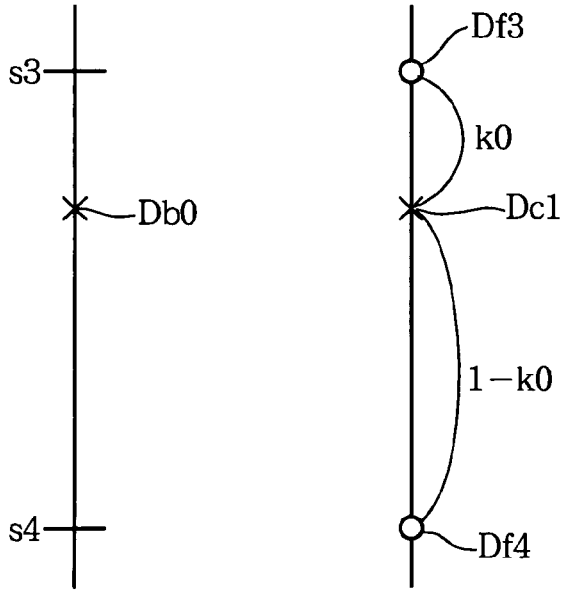
FIG. 28 illustrates the method of calculation of the compensation data.

FIG. 28 illustrates the method of calculation of the compensation data Dc1 represented by equation (3) above. The values s3 and s4 are threshold values used when the number of bits of the decoded image data Db0 is converted by the data conversion unit 20: s3 is the threshold value corresponding to the decoded image data De0 with the converted number of bits, and s4 is the threshold value corresponding to the decoded image data De0+1 that is one gray level (with the converted number of bits) greater than the decoded image data De0.

The interpolation coefficient k0 is calculated by equation (4) below, $$k0=(Db0-s3)/(s4-s3) \quad (4)$$

where, s3<Db0≦s4.

The compensation data Dc1 calculated by the interpolation operation shown in equation (3) above are output from the compensation data generator 8 to the compensation unit 9 as the compensation data Dc. The compensation unit 9 modifies the present image data Di1 according to the compensation data Dc, and sends the modified image data Dj1 to the display unit 10.

When the compensation data Dc1 are obtained by interpolation from the two compensation data values Df3 and Df4 corresponding to the decoded image data (Db1, De0) and (Db1, De0+1), using the interpolation coefficient k0 that is calculated when the number of bits of the decoded image data Db0 is converted as described above, the effect of quantization errors in the decoded image data De0 on the compensation data Dc can be reduced.

Figure 29:
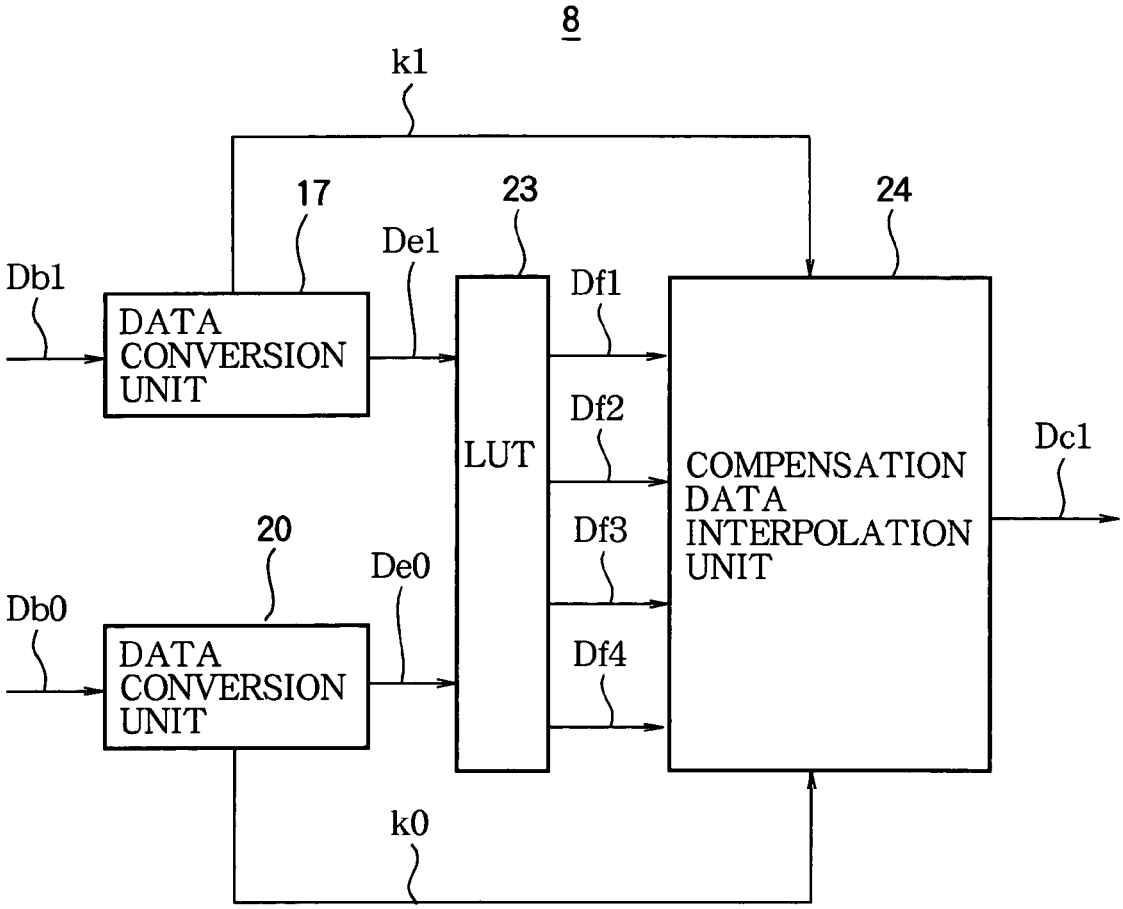
FIG. 29 shows a third structure of the compensation data generator in the third embodiment.

FIG. 29 shows a third structure of the compensation data generator 8 in the third embodiment. The respective data conversion units 17, 20 quantize decoded image data Db1 and Db0 by a linear quantization method, and output new decoded image data De1 and De0 with the number of bits converted from eight to three, for example. At the same time, the data conversion units 17, 20 calculate respective interpolation coefficients k0 and k1. A lookup table 23 outputs compensation data values Df1 to Df4 according to the three-bit decoded image data De1 and De0. A compensation data interpolation unit 24 generates compensation data Dc1 according to compensation data values Df1 to Df4 and the interpolation coefficients k0 and k1.

Figure 30:
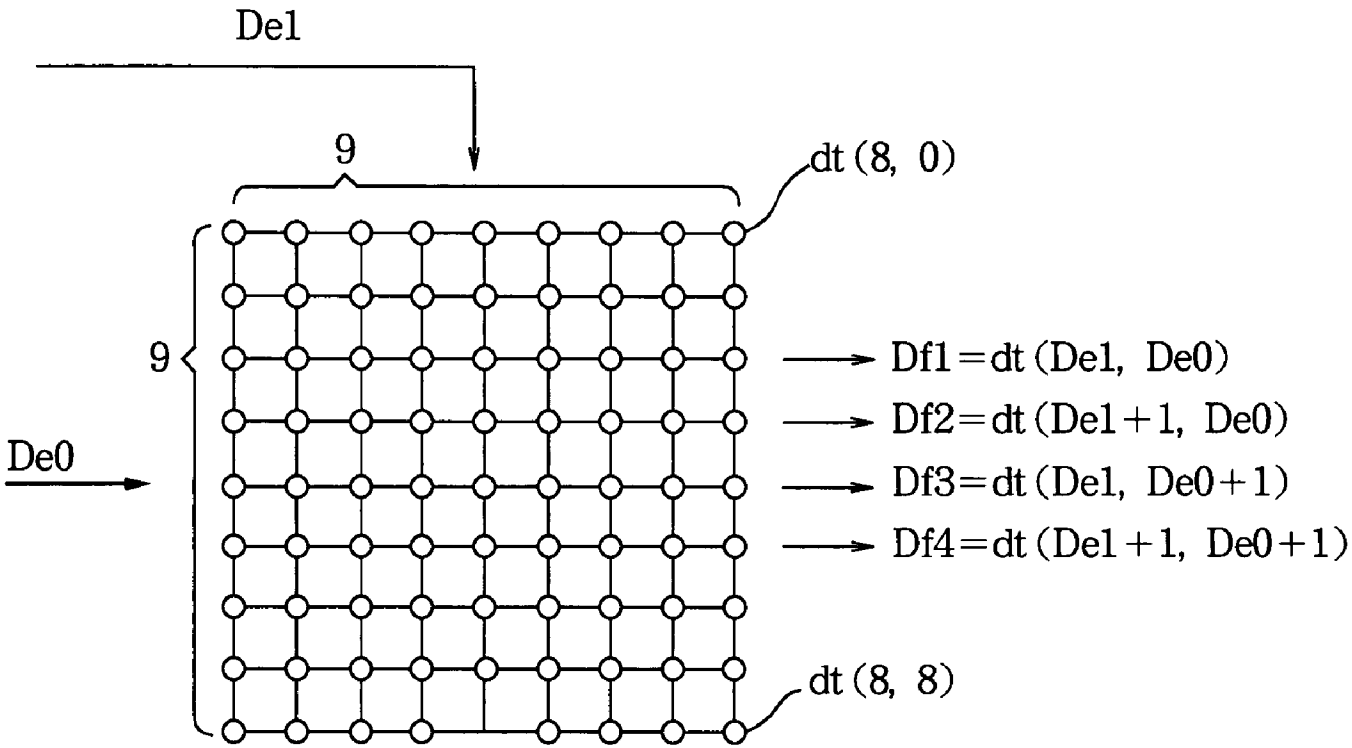
FIG. 30 schematically shows the structure of the lookup table in FIG. 29.

FIG. 30 schematically shows the structure of the lookup table 23. The decoded image data De1, De0 with the converted number of bits are three-bit image data (eight gray levels) taking values from zero to seven. Lookup table 23 has 9×9 data arrayed two-dimensionally, outputs compensation data dt(De1, De0) corresponding to the three-bit values of decoded image data De1 and De0 as compensation data Df1, and also outputs three compensation data dt(De1+1, De0), dt(De1, De0+1), and dt(De1+1, De0+1) from the positions adjacent to compensation data value Df1 as respective compensation data values Df2, Df3, and Df4.

The compensation data interpolation unit 24 uses the compensation data values Df1 to Df4 and the interpolation coefficients k1 and k0 to calculate the compensation data Dc1 by equation (5) below.

$$Dc1=(1-k0)\times\{(1-k1)\times Df1+k1\times Df2\}+k0\times\{(1-k1)\times Df3+k1\times Df4\} \quad (5)$$

Figure 31:
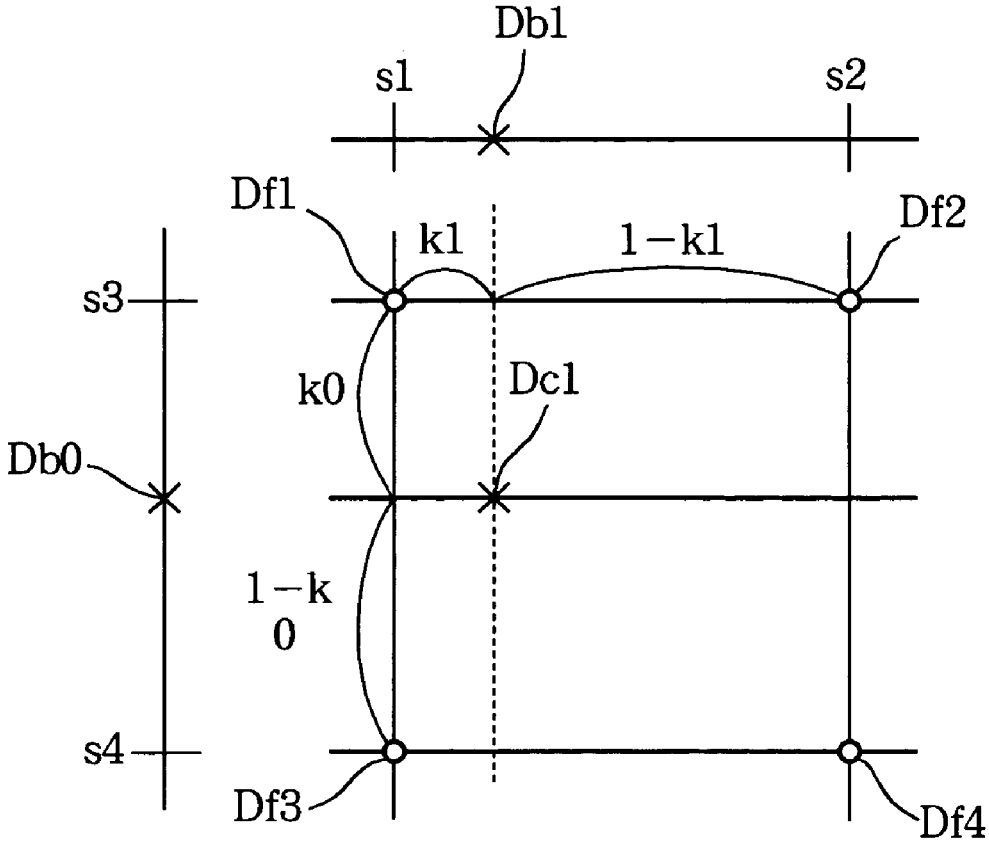
FIG. 31 illustrates the method of calculation of the compensation data.

FIG. 31 illustrates the method of calculation of the compensation data Dc1 represented by equation (5) above. Values s1 and s2 are threshold values used when the number of bits of the decoded image data Db1 is converted by the data conversion unit 17, and values s3 and s4 are threshold values used when the number of bits of the decoded image data Db0 is converted by the data conversion unit 20: s1 is the threshold value corresponding to the decoded image data De1 with the converted number of bits, s2 is the threshold value corresponding to the decoded image data De1+1 that is one gray level (with the converted number of bits) greater than the decoded image data De1, s3 is the threshold value corresponding to the decoded image data De0 with the converted number of bits, and s4 is the threshold value corresponding to the decoded image data De0+1 that is one gray level (with the converted number of bits) greater than the decoded image data De0.

The interpolation coefficients k1 and k0 are calculated by equations (6) and (7) below, $$k1=(Db1-s1)/(s2-s1) \quad (6)$$

where, $s1<Db1\leqq s2$.

$$k0=(Db0-s3)/(s4-s3) \quad (7)$$

where, $s3<Db0\leqq s4$.

The compensation data Dc1 calculated by the interpolation operation shown in equation (5) above are output from the compensation data generator 8 to the compensation unit 9 as the compensation data Dc, as shown in FIG. 2. The compensation unit 9 modifies the present image data Di1 according to the compensation data Dc, and sends the modified image data Dj1 to the display unit 10.

When the compensation data Dc1 are obtained by interpolation from the four compensation data values Df1, Df2, Df3, and Df4 corresponding to the decoded image data (De1, De0), (De1+1, De0), (De1, De0+1), and (De1+1, De0+1), using the interpolation coefficients k0 and k1 that are calculated when the number of bits of the decoded image data Db0 and Db1 is converted as described above, the effect of quantization errors in the decoded image data De0 and De1 on the compensation data Dc can be reduced.

The compensation data interpolation units 19, 22, 24, may also be structured so as to calculate the compensation data Dc1 by using a higher-order interpolation function, instead of by linear interpolation.

Figure 33:
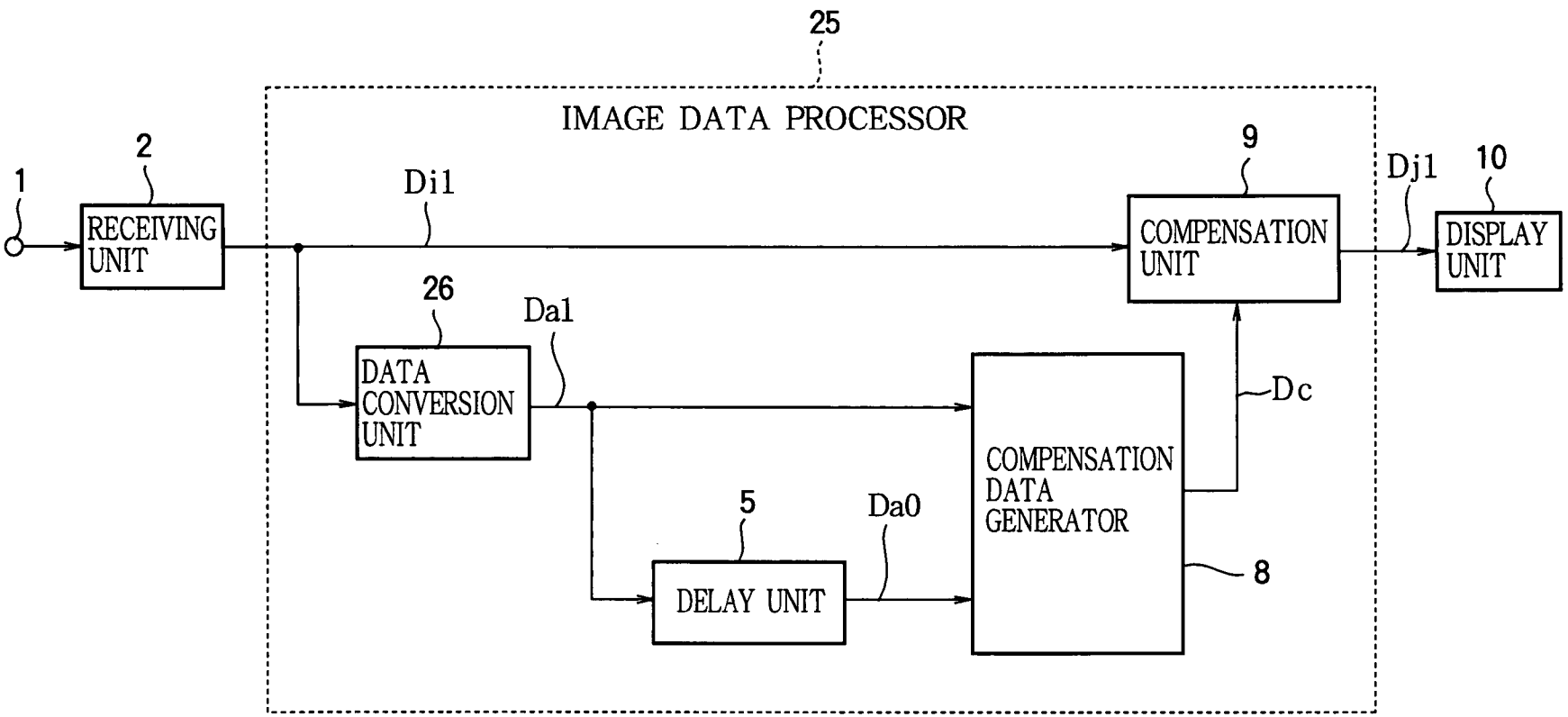
FIG. 33 is a block diagram of a liquid-crystal driving circuit according to the fourth embodiment.

FIG. 33 shows the structure of the liquid-crystal driving circuit according to a fourth embodiment. The image data processor 25 in the fourth embodiment comprises a delay unit 5, a compensation data generator 8, a compensation unit 9, and a data conversion unit. The data conversion unit 26 reduces the amount of data by converting the number of bits with which the present image data Di1 are quantized from eight to three, for example. Either a linear or a nonlinear quantization method may be employed to convert the number of quantization bits. The data conversion unit 26 outputs new image data Da1 with the converted number of bits to the delay unit 5 and the compensation data generator 8. The delay unit 5 delays the image data Da1 with the converted number of bits for one frame interval, thereby outputting image data Da0 corresponding to the image one frame before the present image.

The compensation data generator 8 outputs compensation data Dc according to the image data Da1 and the image data Db0 one frame before. The compensation unit 9 modifies the present image data Di1 according to the compensation data Dc, and outputs modified image data Dj1 to the display unit 10.

Regardless of whether a linear or a nonlinear quantization method is employed, the data conversion unit 26 is not limited to reducing the number of bits with which the image data Da1 are quantized to three bits; the reduction may be to any number of bits. The smaller the number of bits with which the image data Da1 are quantized, the less memory is needed to delay the image data Da1 for one frame interval in the delay unit 5.

The compensation data generator 8 stores compensation data corresponding to the number of bits of the image data Da1 and Da0.

Figure 32:
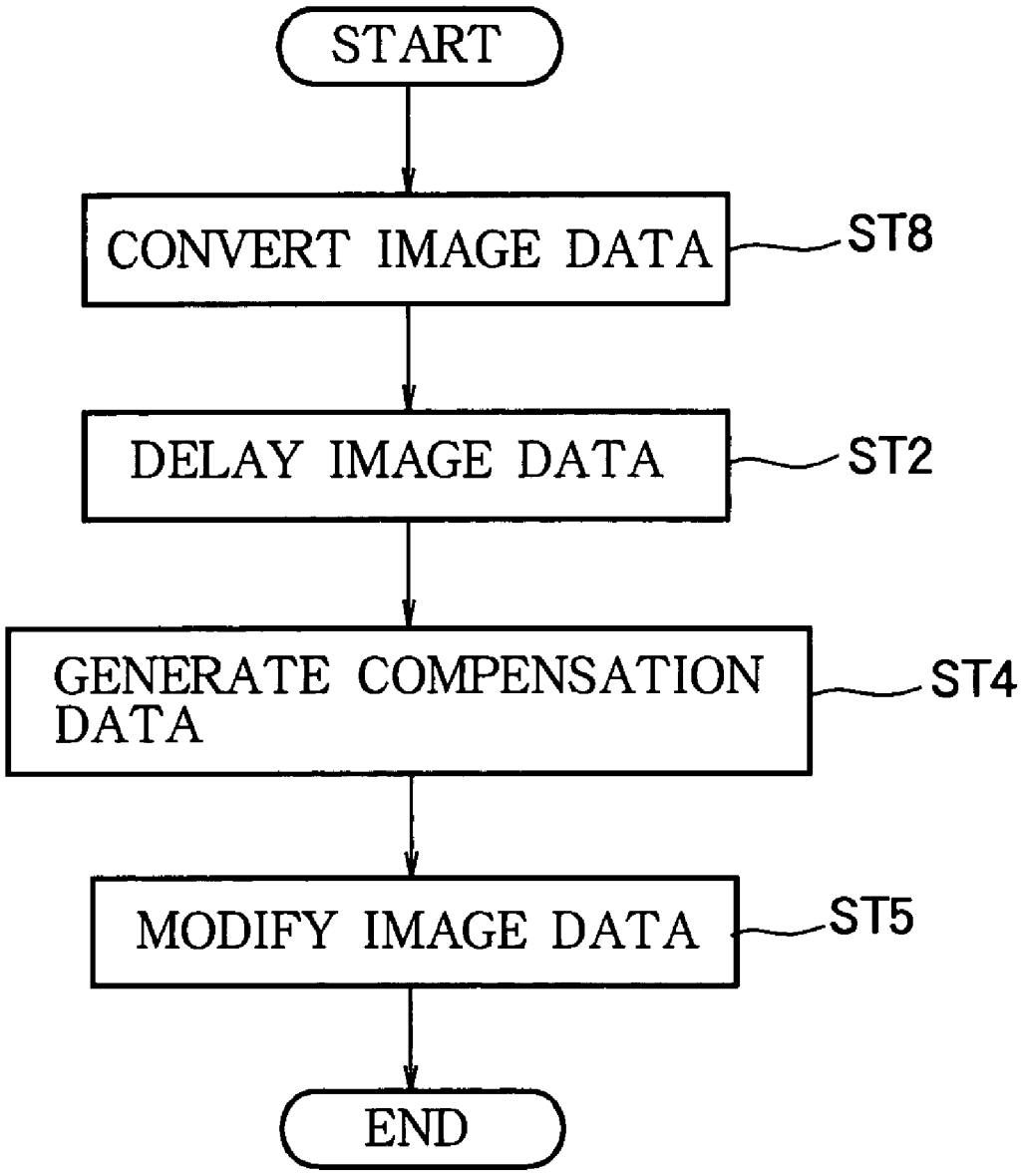
FIG. 32 is a flowchart showing the operation of a liquid-crystal driving circuit according to a fourth embodiment.

FIG. 32 is a flowchart showing the operation of the liquid-crystal driving circuit according to the fourth embodiment. In the image data conversion step (St8), the data conversion unit 26 converts the number of bits by reducing the number of bits with which the present image data Di1 are quantized, and outputs new image data Da1 corresponding to the present image data Di1. In the following image data delay step (St2), the delay unit 5 delays the image data Da1 for one frame interval. In the compensation data generation step (St4), the compensation data generator 8 outputs the compensation data Dc according to the image data Da1 and Da0. In the image data compensation step (St5), the compensation unit 9 generates the image data Dj1 according to the compensation data Dc.

Since the data size is compressed by converting the number of bits with which the present image data Di1 is quantized in the fourth embodiment as described above, it is possible to dispense with decoding means, simplify the structure of the compensation data generator 8, and reduce the circuit size.

Figure 35:
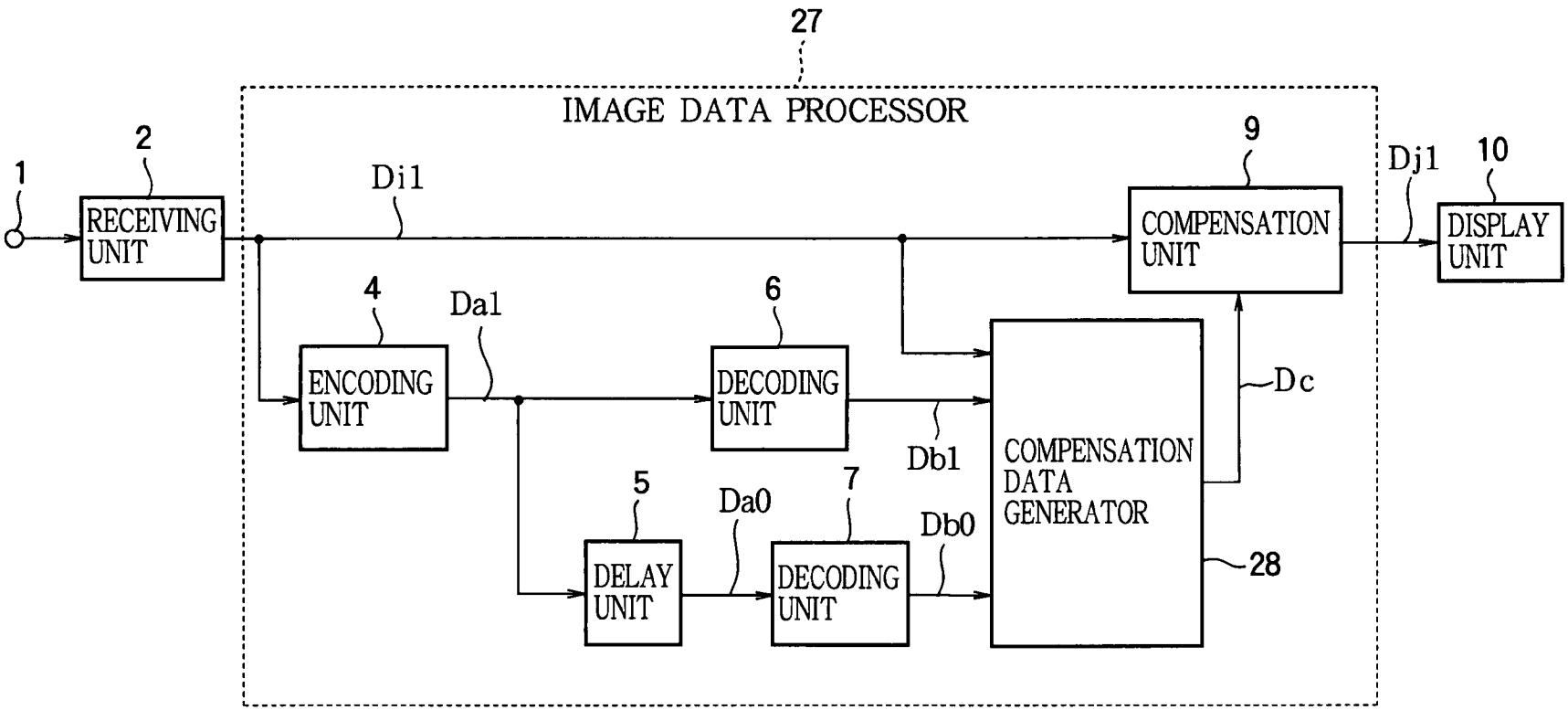
FIG. 35 is a block diagram of a liquid-crystal driving circuit according to the fifth embodiment.

FIG. 35 shows the structure of a liquid-crystal driving circuit according to a fifth embodiment. In the image data processor 27 according to the fifth embodiment, the compensation data generator 28 detects error in the decoded image data Db1 by detecting differences between the present image data Di1 and the decoded image data Db1, and limits the magnitude of the compensation in the compensation data Dc according to the detected error. Other operations are carried out as in the first embodiment.

Figure 36:
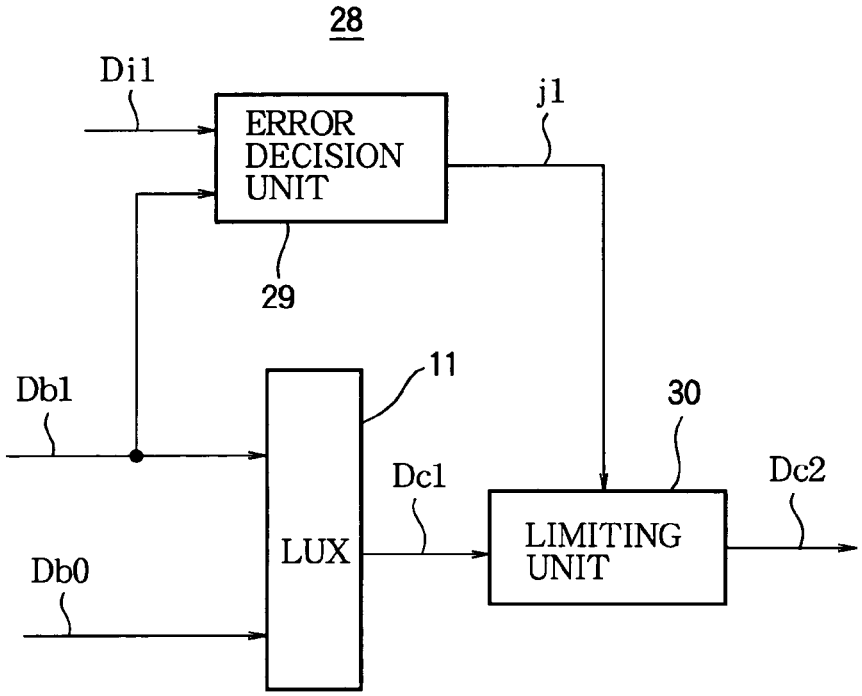
FIG. 36 shows a first structure of the compensation data generator in the fifth embodiment.

FIG. 36 shows a first structure of the compensation data generator 28 according to the fifth embodiment. A lookup table 11 outputs compensation data Dc1 according to the decoded image data Db0 and Db1. By comparing the present image data Di1 with the decoded image data Db1, an error decision unit 29 detects error generated in the decoded image data Db1 by the encoding and decoding processes carried out in the encoding unit 4 and decoding unit 6. When the difference between the present image data Di1 and the decoded image data Db1 exceeds a predetermined value, the error decision unit 29 outputs a compensation-magnitude limitation signal j1 to a limiting unit 30, in order to limit the magnitude of the compensation in the compensation data Dc1.

The limiting unit 30 limits the magnitude of the compensation in the compensation data Dc1 according to the compensation-magnitude limitation signal j1 from the error decision unit 29, and outputs new compensation data Dc2. The compensation data Dc2 output by the limiting unit 30 are output as the compensation data Dc shown in FIG. 35. The compensation unit 9 modifies the present image data Di1 according to the compensation data Dc.

Figure 34:
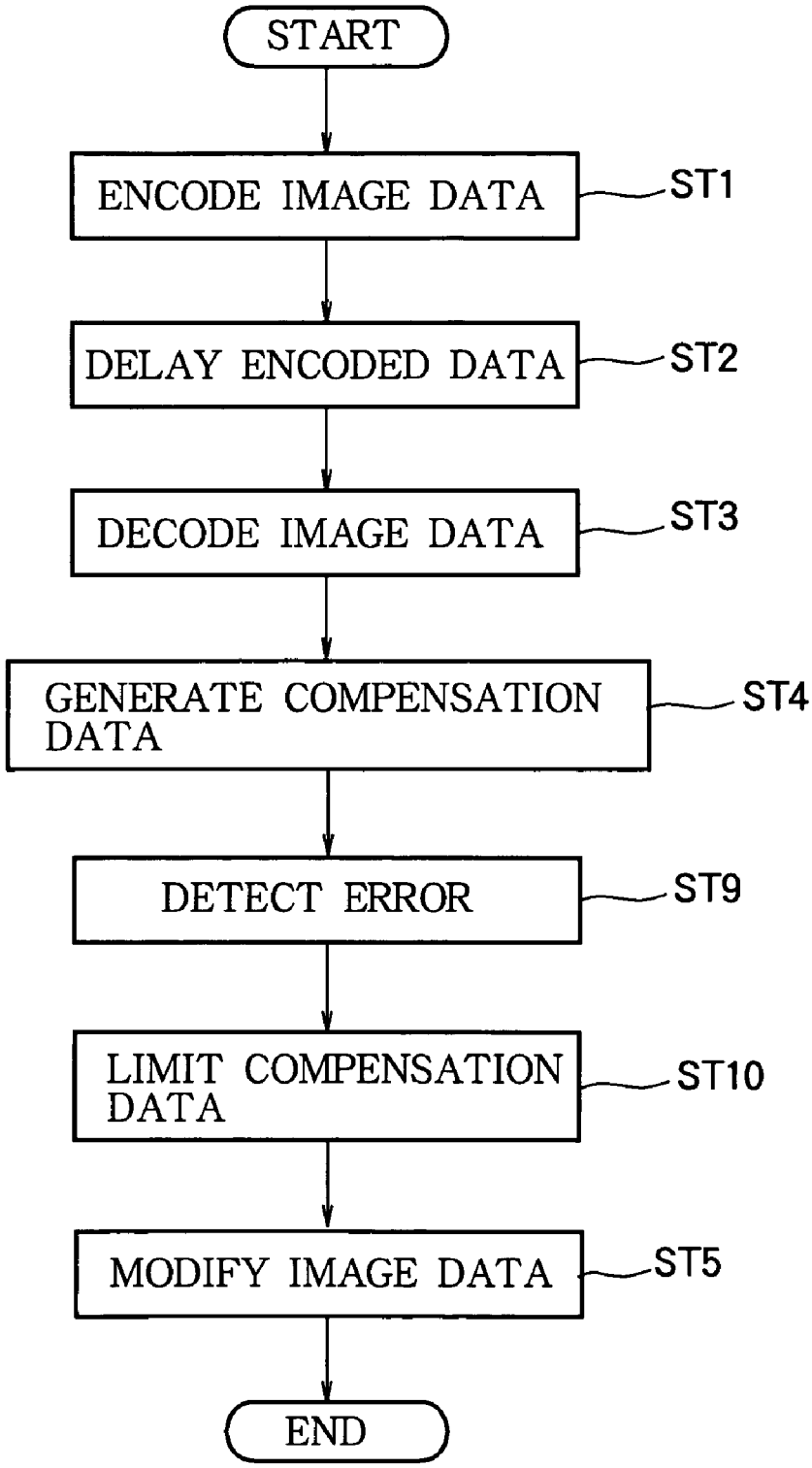
FIG. 34 is a flowchart showing the operation of a liquid-crystal driving circuit according to a fifth embodiment.

FIG. 34 is a flowchart showing the operation of the liquid-crystal driving circuit according to the fifth embodiment in FIG. 35. The compensation data Dc1 are generated by the operations carried out in the steps St1 to St4 as in the first embodiment. In the following error decision step (St9), the error decision unit 29 detects error in the decoded image data Db1 by detecting differences between the present image data Di1 and the decoded image data Db1 for each pixel. In the compensation data limitation step (St10), if the difference detected by the error decision unit 29 exceeds a predetermined value, the limiting unit 30 outputs new compensation data Dc2 by limiting the value of the compensation data Dc1. In the image data compensation step (St5), the compensation unit 9 modifies the image data Dj1 according to the compensation data Dc2.

By reducing the value of the compensation data Dc when the present image data Di1 and the decoded image data Db1 differ greatly as described above, the fifth embodiment can control the response speed of the liquid crystal accurately and prevent degradation of the displayed image due to unnecessary compensation.

Figure 37:
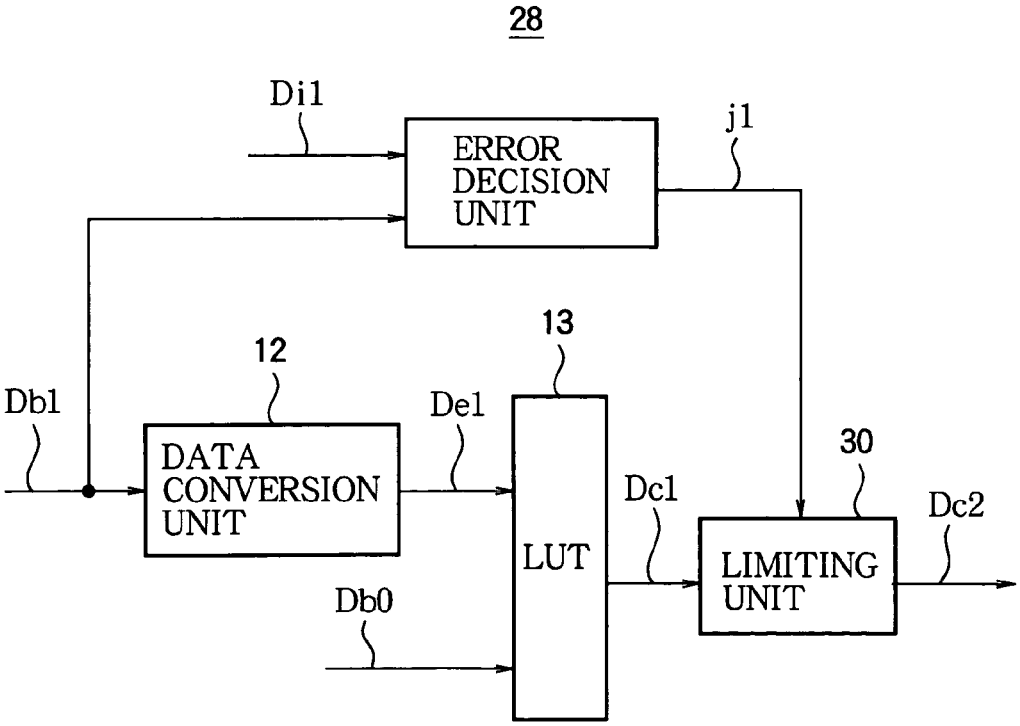
FIG. 37 shows an alternative structure of the compensation data generator in FIG. 36.

FIG. 37 shows an alternative structure of the compensation data generator 28 in FIG. 35. The compensation data generator 28 may include a data conversion unit 12 that converts the number of bits of decoded image data Db1, and may generate compensation data Dc1 according to the decoded image data De1 with the converted number of bits.

Figure 38:
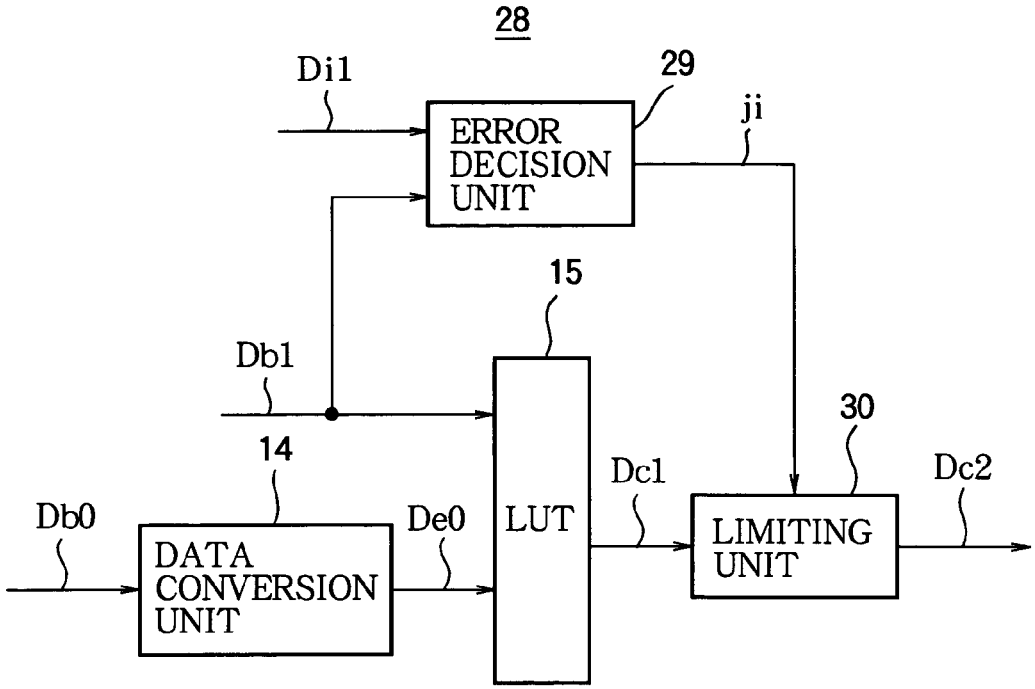
FIG. 38 shows an alternative structure of the compensation data generator in FIG. 36.

As shown in FIG. 38, the compensation data generator 28 may include a data conversion unit 14 that converts the number of bits of decoded image data Db0, and may generate compensation data Dc1 according to the decoded image data De0 with the converted number of bits.

Figure 39:
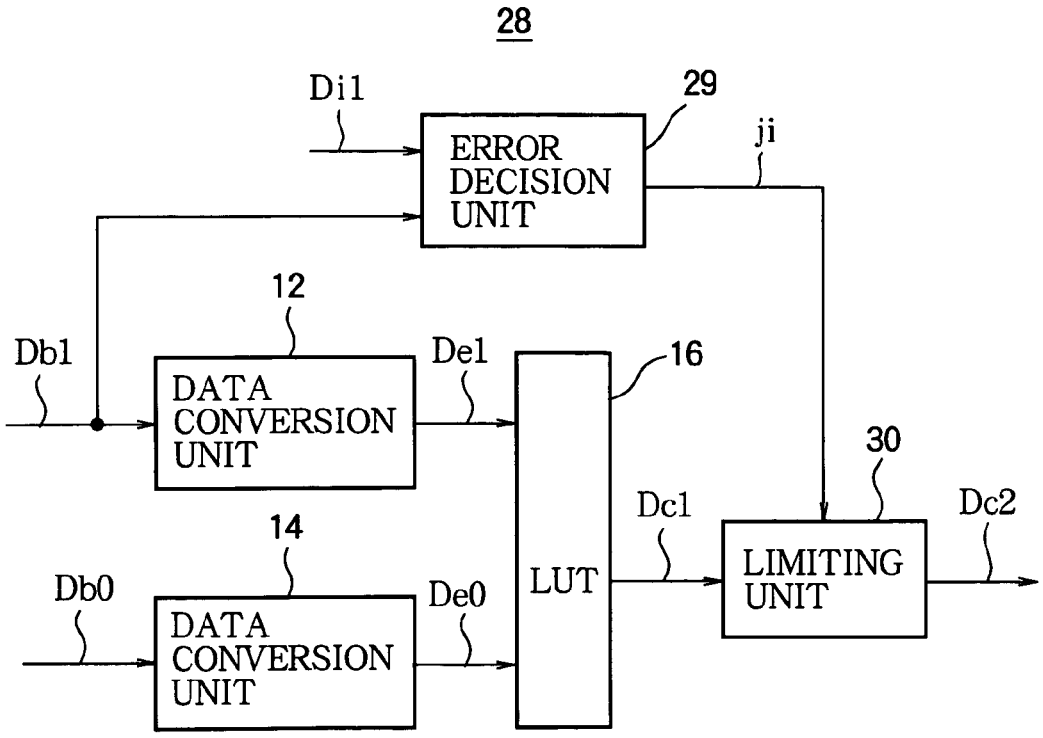
FIG. 39 shows an alternative structure of the compensation data generator in FIG. 36.

As shown in FIG. 39, the compensation data generator 28 may include data conversion units 12, 14 that convert the number of bits of both decoded image data Db1 and Db0, and may generate compensation data Dc1 according to the decoded image data De1 and De0 with the converted number of bits.

The data conversion units 12, 14, and the lookup tables 13, 15, 16 in FIGS. 37 to 39 operate as described in the second embodiment. By use of the structures shown in FIGS. 37 to 39, it is possible to reduce the data size and circuit size of the lookup tables 13, 15, 16.

Figure 40:
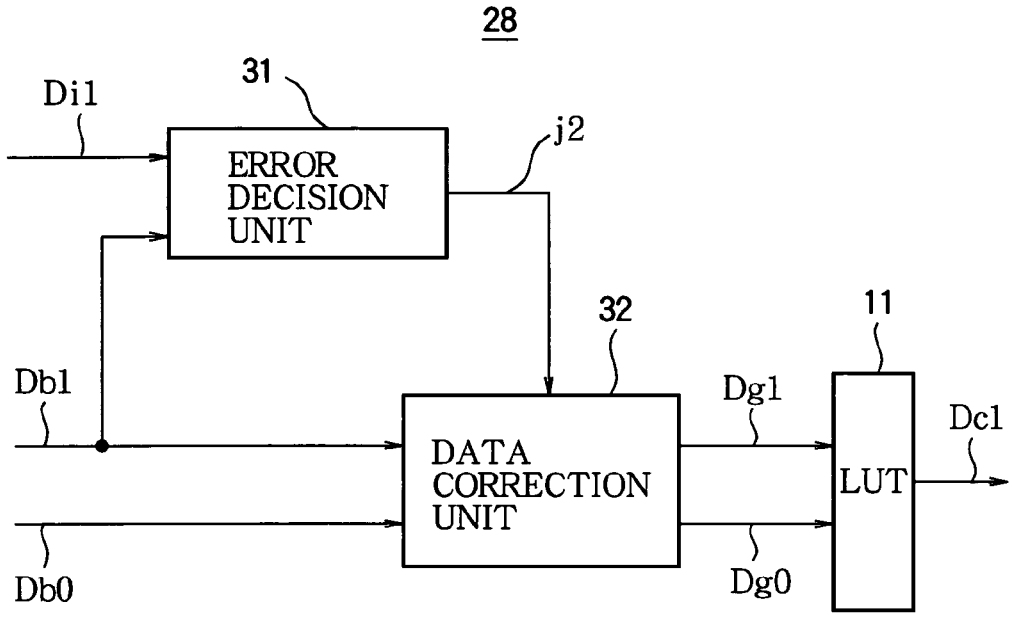
FIG. 40 shows a second structure of the compensation data generator in the fifth embodiment.

FIG. 40 shows a second structure of the compensation data generator 28 according to the fifth embodiment. An error decision unit 31 detects the difference between the present image data Di1 and decoded image data Db1 for each pixel, and outputs the detected difference as a compensation signal j2. A data correction unit 32 modifies the respective decoded image data Db0 and Db1 for each pixel according to the compensation signal j2 output by the error decision unit 31, and outputs the modified decoded image data Dg1 and Dg0 to the lookup table 11.

The decoded image data Db0 and Db1 and the decoded image data Dg0 and Dg1 modified according to the compensation signal j2 are related as indicated in equations (8) to (10) below.

$$Dg1=Db1+j2 \tag{8}$$

$$Dg0=Db0+j2 \tag{9}$$

$$j2=Di1-Db1 \tag{10}$$

By adding the compensation signal j2 (=Di1−Db1) to the respective decoded image data Db1 and Db0 as shown in equations (8) and (9), it is possible to cancel the error component j2 generated in the decoded image data Db1 and Db0 when the encoding and decoding processes are carried out.

The lookup table 11 outputs compensation data Dc1 according to the modified decoded image data Dg1 and Dg0. The compensation data generator 28 outputs the compensation data Dc1 output by the lookup table 11 to the compensation unit 9 as the compensation data Dc shown in FIG. 35.

By adding the difference j2 between the present image data Di1 and the decoded image data Db1 to the respective decoded image data Db1 and Db0 as described above, it is possible to correct the error generated in the decoded image data Db1 and Db0 when the encoding and decoding processes are carried out. Thus, the fifth embodiment can control the response speed of the liquid crystal accurately and prevent degradation of the displayed image due to unnecessary compensation.

The modified decoded image data Dg1 are identical to the present image data Di1, as indicated in equation (11) below.

$$Dg1=Db1+Di1-Db1=Di1 \tag{11}$$

Figure 41:
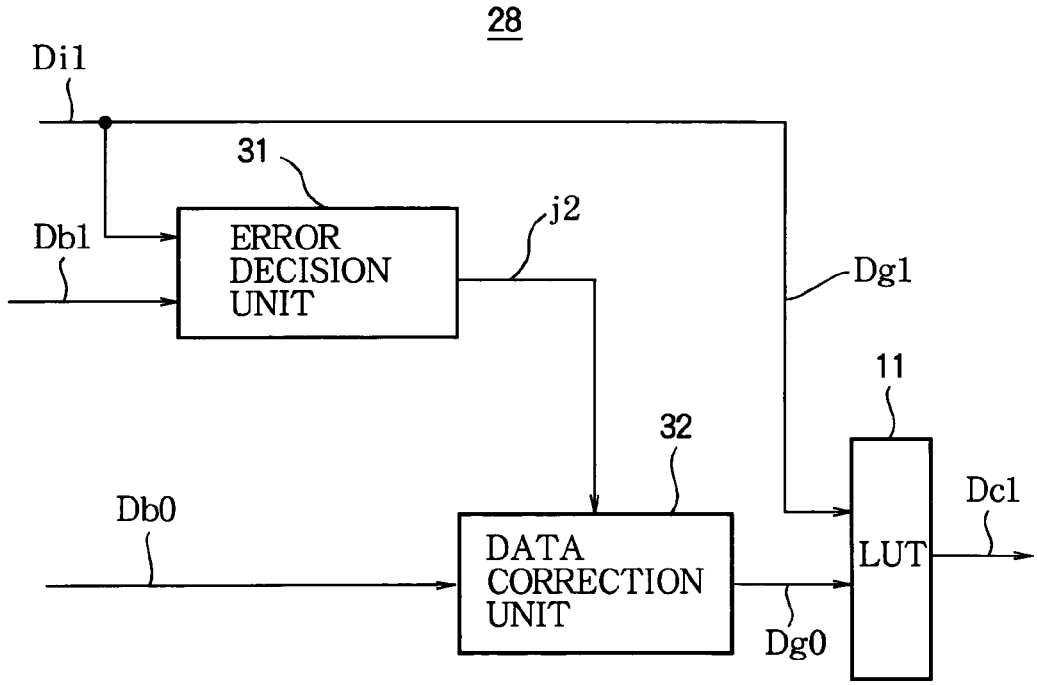
FIG. 41 shows an alternative structure of the compensation data generator in FIG. 40.

Therefore, as shown in FIG. 41, the compensation data generator 28 may also be structured so that the lookup table 11 inputs the present image data Di1 instead of the modified decoded image data Dg1.

Figure 42:
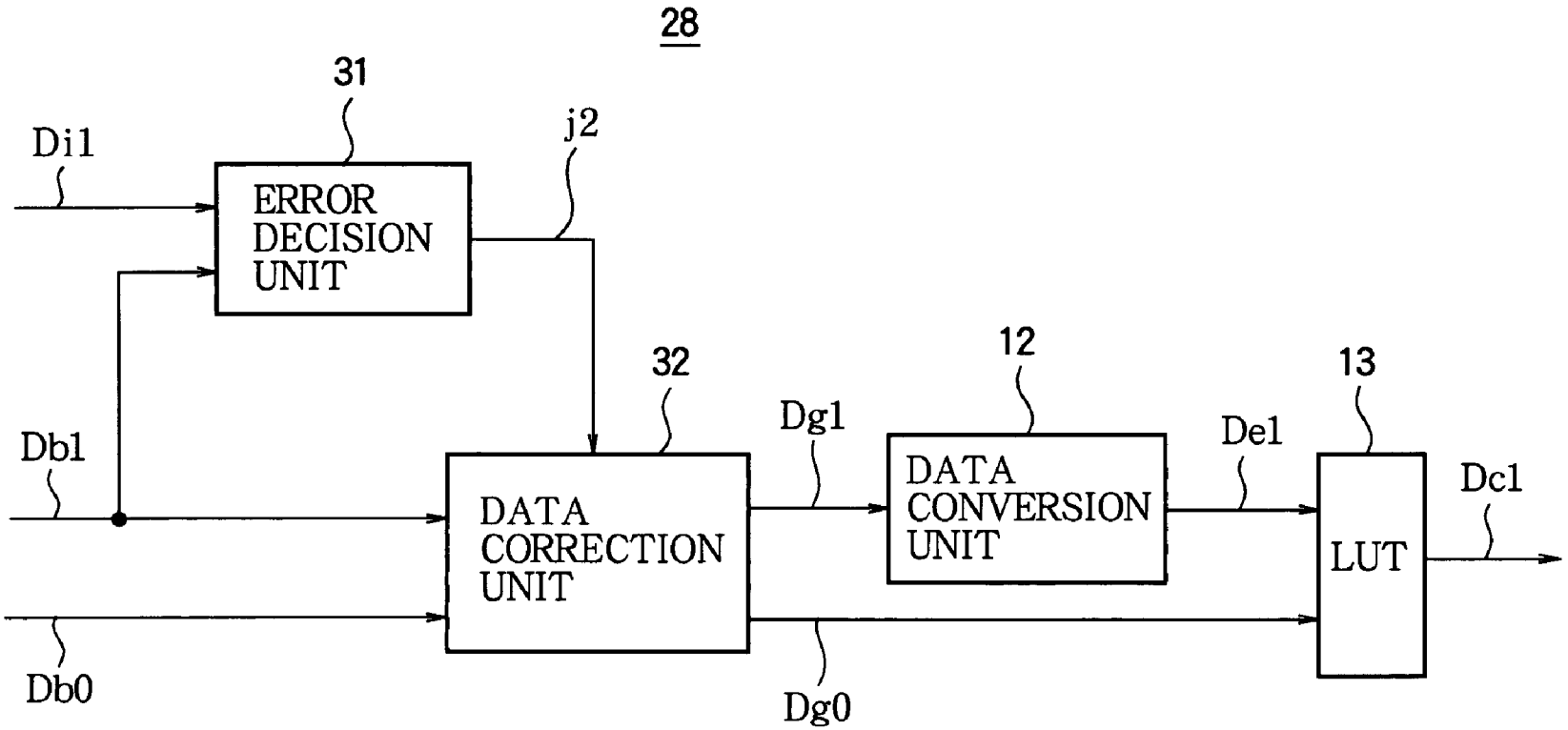
FIG. 42 shows an alternative structure of the compensation data generator in FIG. 40.

FIG. 42 shows an alternative structure of the compensation data generator 28 in FIG. 40. The compensation data generator 28 may include a data conversion unit 12 that reduces the decoded image data Dg1 output by the data correction unit 32 to a smaller number of bits, and may generate compensation data Dc1 according to the decoded image data De1 with the converted number of bits.

Figure 43:
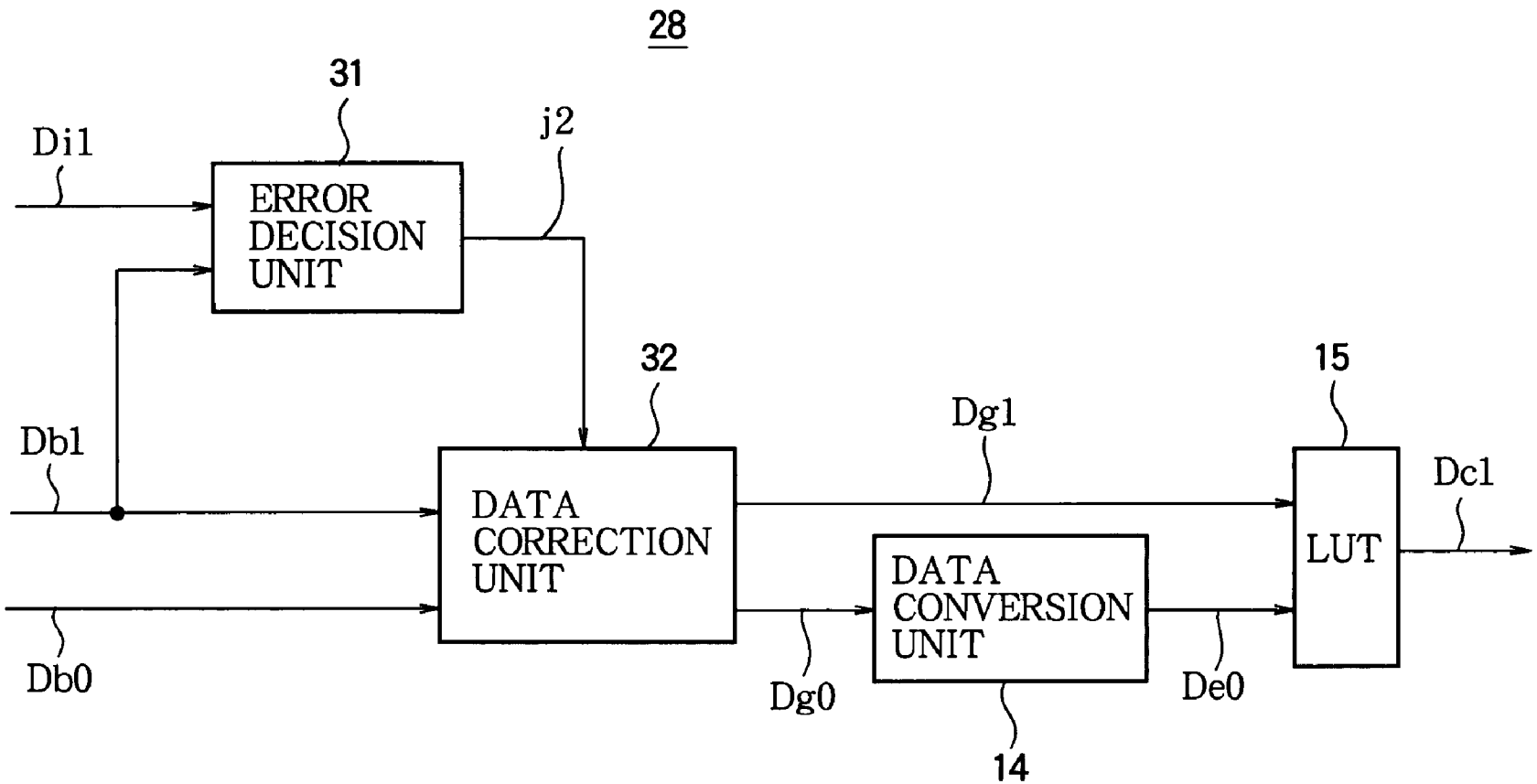
FIG. 43 shows an alternative structure of the compensation data generator in FIG. 40.

As shown in FIG. 43, the compensation data generator 28 may include a data conversion unit 14 that reduces the decoded image data Dg0 output by the data correction unit 32 to a smaller number of bits, and may generate compensation data Dc1 according to the decoded image data De0 with the converted number of bits.

Figure 44:
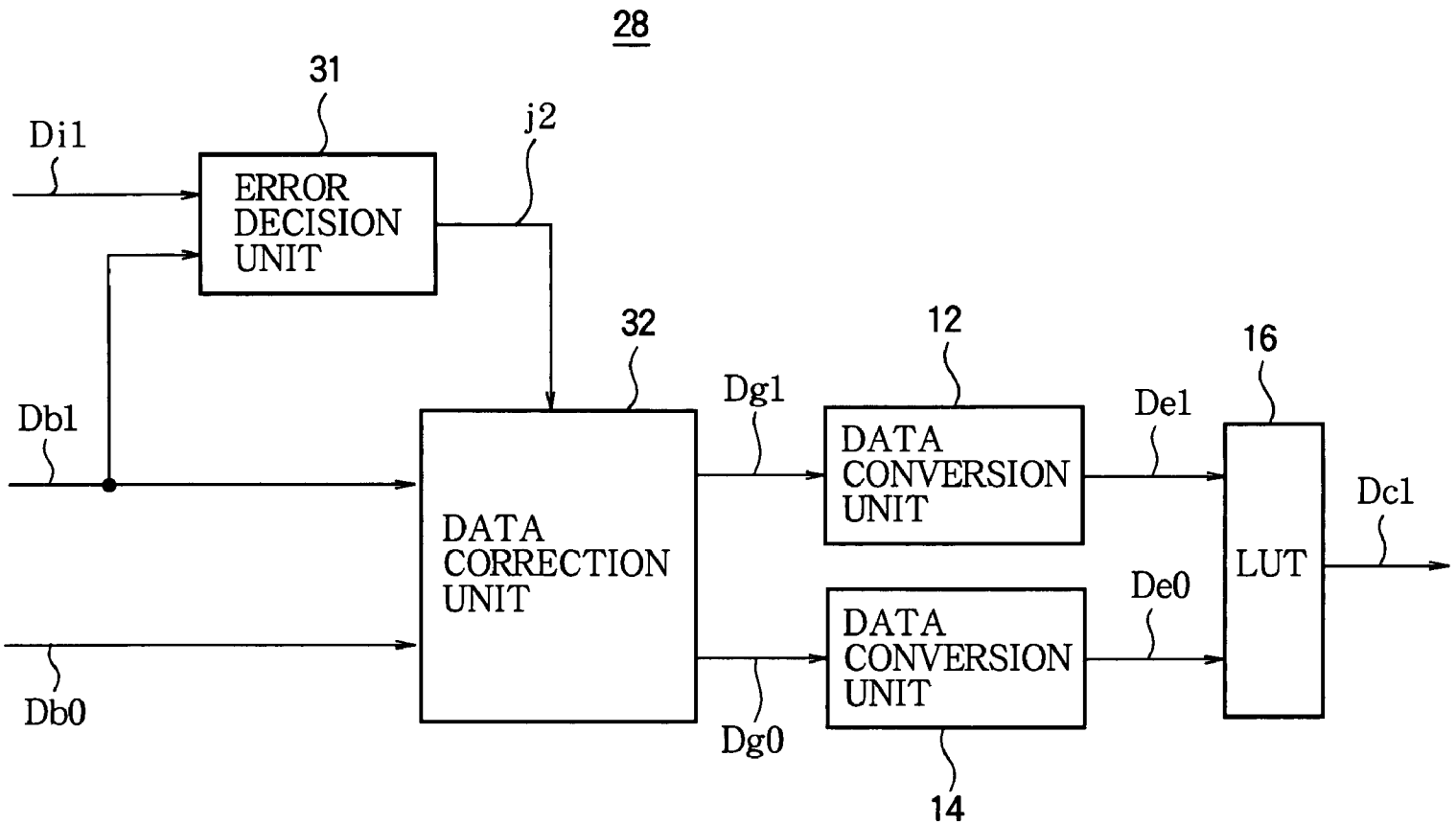
FIG. 44 shows an alternative structure of the compensation data generator in FIG. 40.

As shown in FIG. 44, the compensation data generator 28 may include data conversion units 12, 14 that reduce the number of bits of both decoded image data Dg1 and Dg0 output by the data correction unit 32, and may generate compensation data Dc1 according to the decoded image data De1 and De0 with the converted number of bits.

By use of the structures shown in FIGS. 42 to 44 as described above, it is possible to reduce the data size and circuit size of the lookup tables 13, 15, 16.

Figure 45:
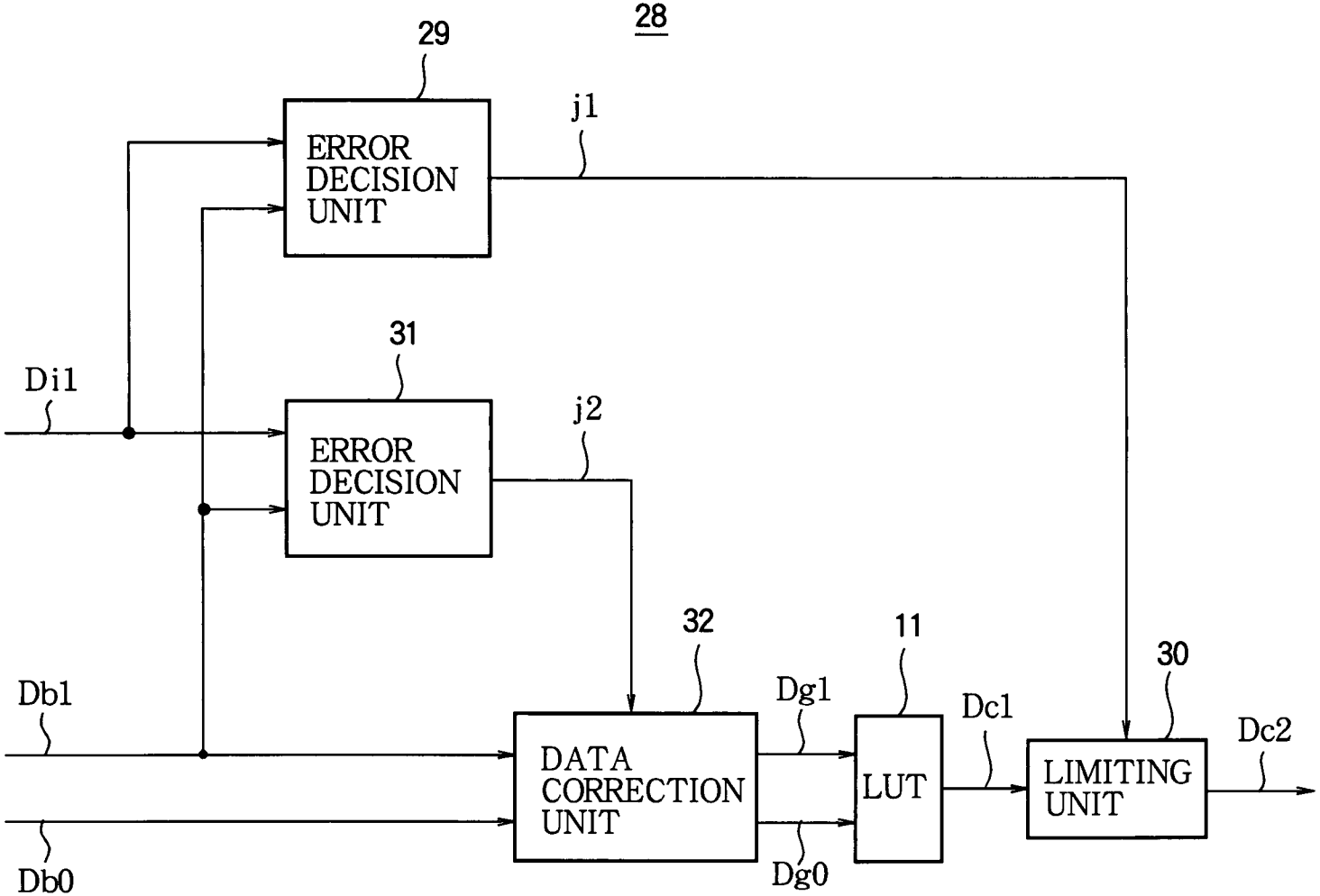
FIG. 45 shows a third structure of the compensation data generator in the fifth embodiment.

FIG. 45 shows a third structure of the compensation data generator 28 according to the fifth embodiment. When the difference between the present image data Di1 and the decoded image data Db1 exceeds a predetermined value, an error decision unit 29 outputs a compensation-magnitude limitation signal j1 to a limiting unit 30, in order to limit the magnitude of the compensation in the compensation data Dc1. An error decision unit 31 detects the difference between the present image data Di1 and decoded image data Db1 for each pixel, and outputs the detected difference as a compensation signal j2 to a data correction unit 32.

The data correction unit 32 modifies the respective decoded image data Db0 and Db1 for each pixel according to the compensation signal j2 output by the error decision unit 31, and outputs the modified decoded image data Dg1 and Dg0 to the lookup table 11. The lookup table 11 outputs compensation data Dc1 according to the modified decoded image data Dg1 and Dg0 and sends the output compensation data Dc1 to the limiting unit 30. The limiting unit 30 limits the magnitude of the compensation in the compensation data Dc1 according to the compensation-magnitude limitation signal j1, and outputs new compensation data Dc2.

By modifying the decoded image data Dg1 and Dg0 and the compensation data Dc1 according to the difference between the present image data Di1 and the decoded image data Db1 as described above, even if the decoded image data Db1 and Db0 include considerable error generated by the encoding and decoding processes, the fifth embodiment can control the response speed of the liquid crystal accurately and prevent degradation of the displayed image due to unnecessary compensation.

Figure 46:
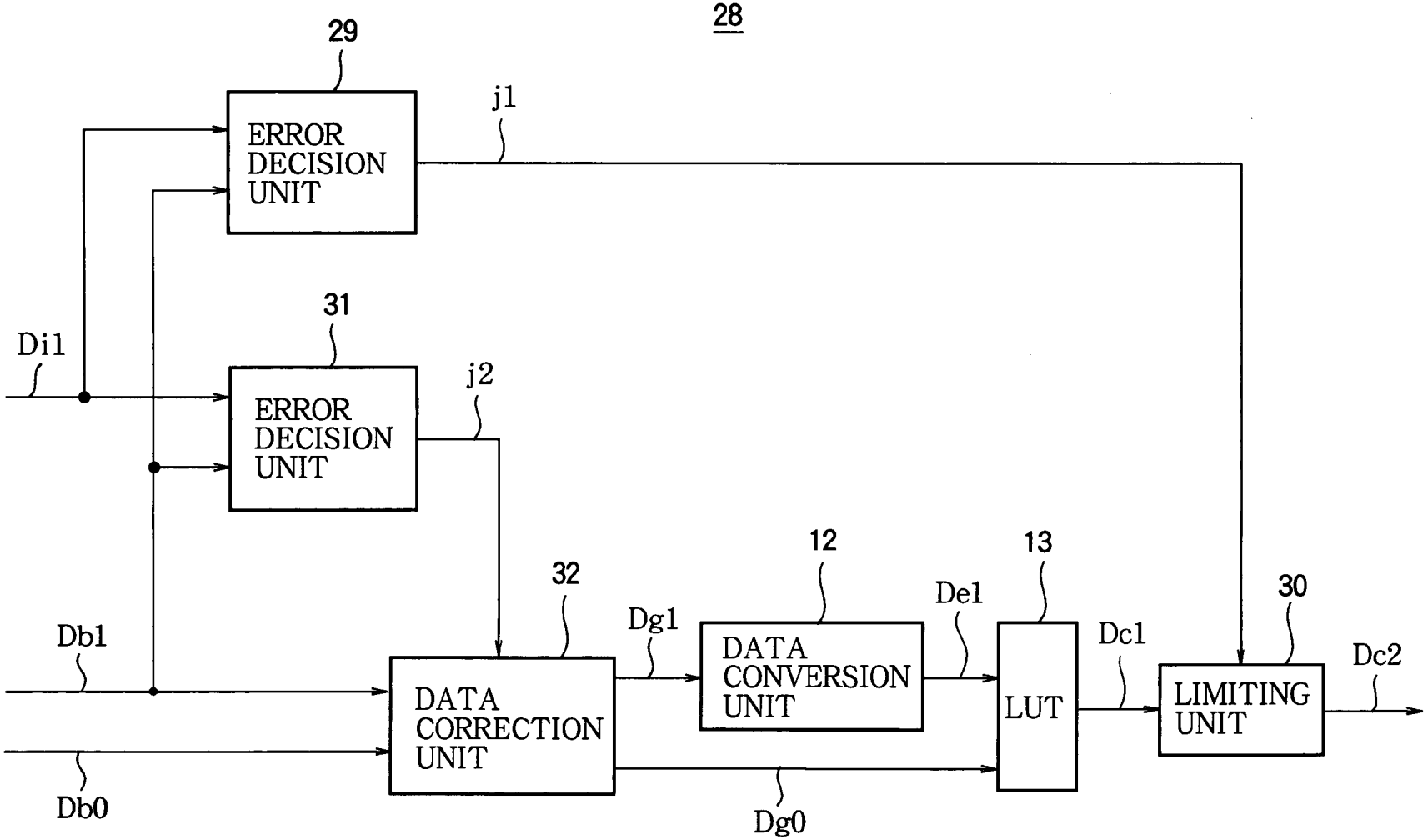
FIG. 46 shows an alternative structure of the compensation data generator in FIG. 45.

FIG. 46 shows an alternative structure of the compensation data generator 28 in FIG. 45. The compensation data generator 28 may include a data conversion unit 12 that reduces the decoded image data Dg1 output by the data correction unit 32 to a smaller number of bits, and may generate compensation data Dc1 according to the decoded image data De1 with the converted number of bits.

Figure 47:
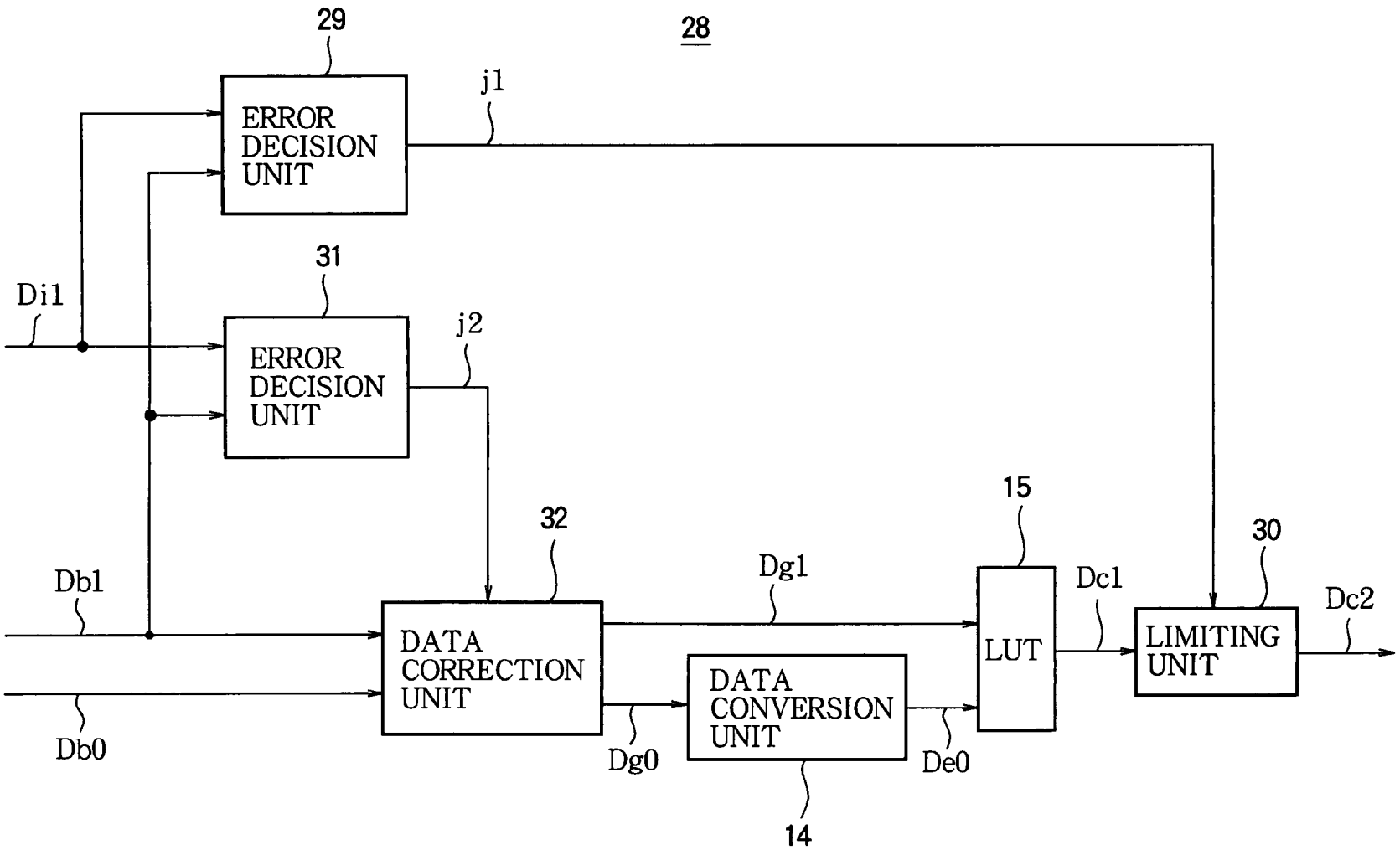
FIG. 47 shows an alternative structure of the compensation data generator in FIG. 45.

As shown in FIG. 47, the compensation data generator 28 may include a data conversion unit 14 that reduces the number of bits with which the decoded image data Dg0 output by the data correction unit 32 are quantized, and may generate compensation data Dc1 according to the decoded image data De0 with the converted number of bits.

Figure 48:
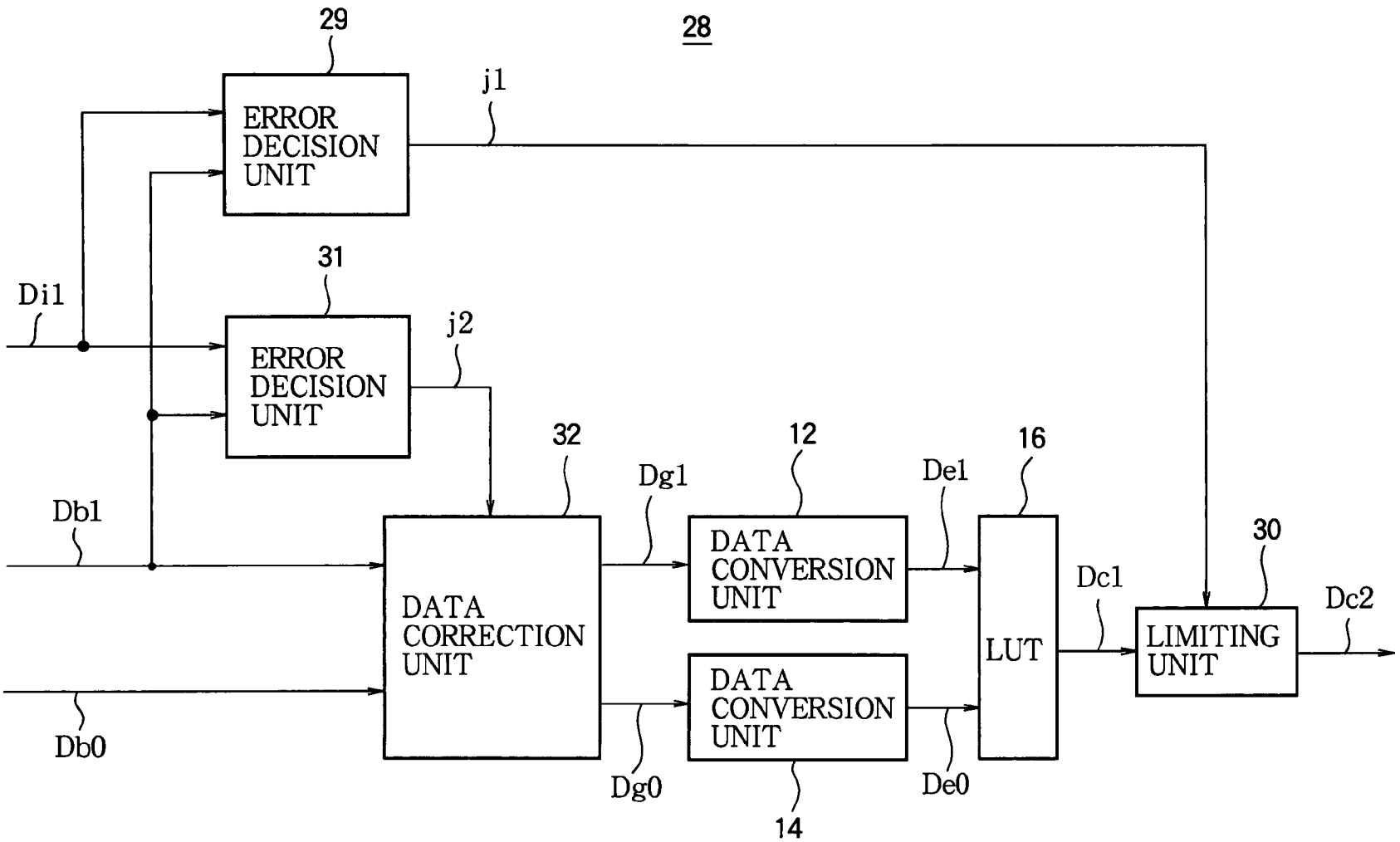
FIG. 48 shows an alternative structure of the compensation data generator in FIG. 45.

As shown in FIG. 48, the compensation data generator 28 may include data conversion units 12, 14 that reduce the number of bits of respective decoded image data Dg1 and Dg0 output by the data correction unit 32, and may generate compensation data Dc1 according to the decoded image data De1 and De0 with the converted number of bits.

By use of the structures of the compensation data generator 28 shown in FIGS. 46 to 48 as described above, it is possible to reduce the data size and circuit size of the lookup tables 13, 15, 16.

Figure 49:
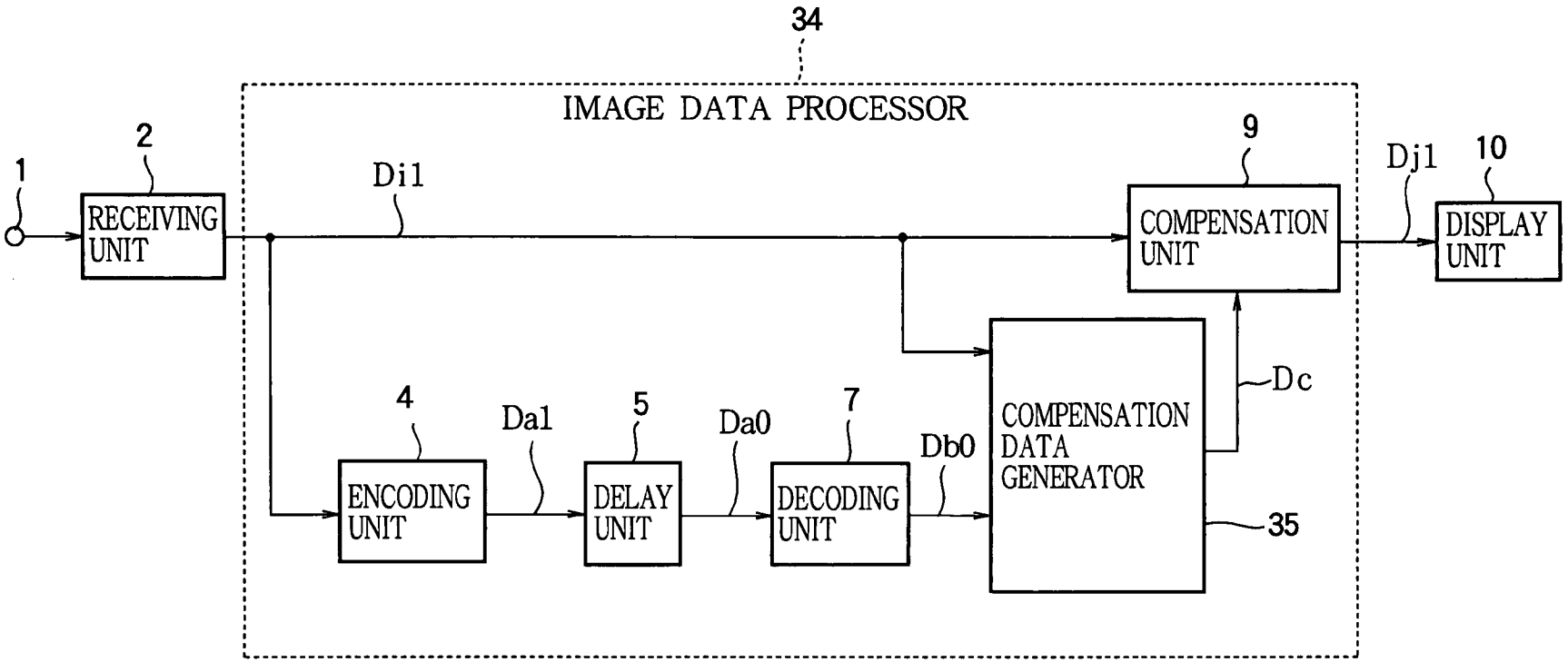
FIG. 49 is a block diagram of a liquid-crystal driving circuit according to a sixth embodiment.

FIG. 49 shows the structure of a liquid-crystal driving circuit according to a sixth embodiment of the invention. The image data processor 34 according to the sixth embodiment comprises an encoding unit 4, a delay unit 5, a decoding unit 7, a compensation data generator 35, and a compensation unit 9. The encoding unit 4 encodes the present image data Di1 and outputs encoded data Da1. The delay unit delays the encoded data Da1 for one frame interval and outputs the delayed encoded data Da0. The encoded data Da0 delayed by the delay unit 5 correspond to the image data one frame before the encoded data Da1. The decoding unit 7 decodes the encoded data Da0 and outputs decoded image data Db0. The compensation data generator 35 generates the compensation data Dc according to the present image data Di1 and the decoded image data Db0 and outputs the compensation data Dc to the compensation unit 9.

By having the compensation data generator 35 generate the compensation data Dc according to the present image data Di1 and the decoded image data Db0, as shown in FIG. 49, it is possible to dispense with a decoding unit 6 for decoding the encoded data Da1 corresponding to the present image data Di1 and to reduce the circuit size.

Figure 51:
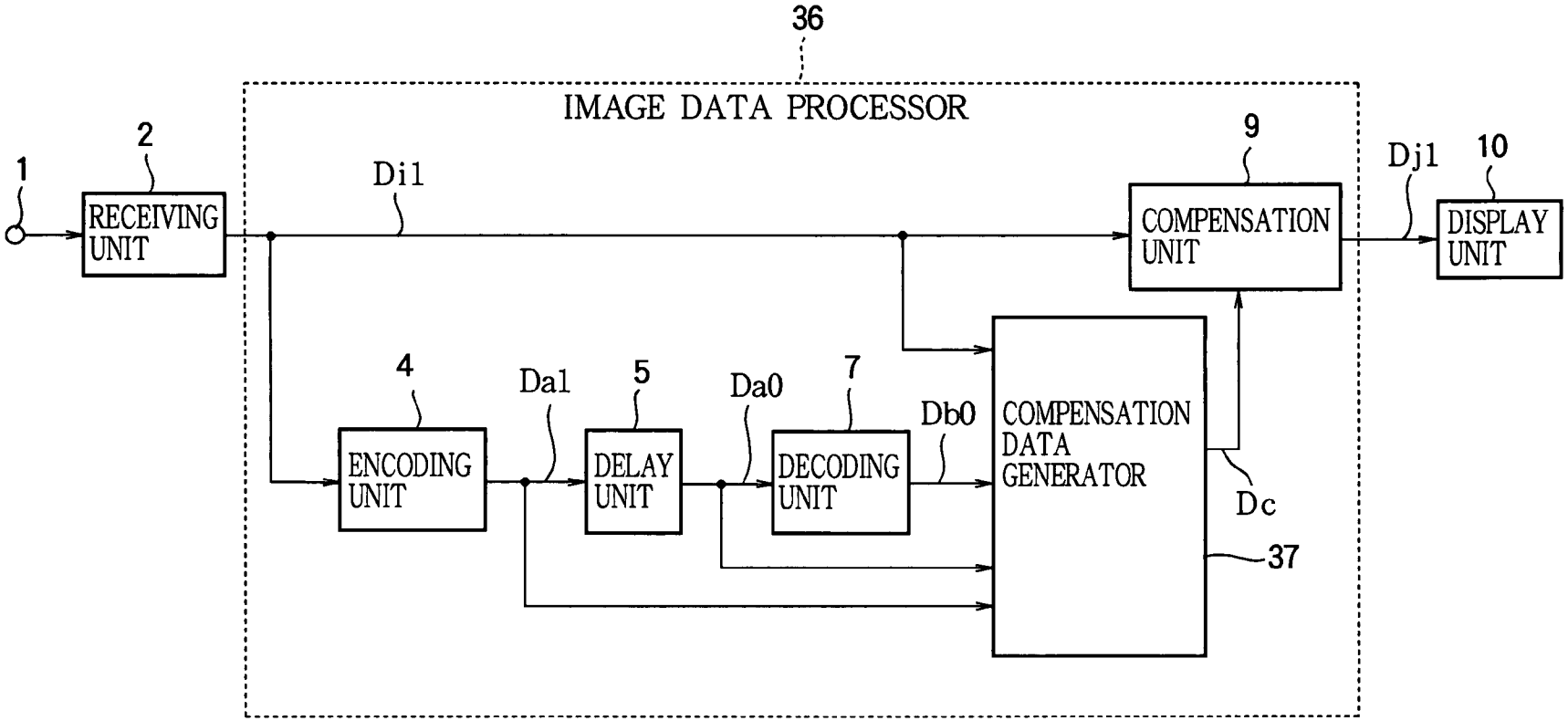
FIG. 51 is a block diagram of a liquid-crystal driving circuit according to the seventh embodiment.

FIG. 51 shows the structure of a liquid-crystal driving circuit according to a seventh embodiment of the invention. The image data processor 36 according to the seventh embodiment comprises an encoding unit 4, a delay unit 5, a decoding unit 7, a compensation data generator 37, and a compensation unit 9. The encoding unit 4 encodes the present image data Di1 and outputs encoded data Da1 to the delay unit 5 and the compensation data generator 37. The delay unit 5 delays the encoded data Da1 for one frame interval and outputs the delayed encoded data Da0 to the decoding unit 7 and the compensation data generator 37. The encoded data Da0 delayed by the delay unit 5 correspond to the image data one frame before the encoded data Da1. The decoding unit 7 decodes the encoded data Da0 and outputs decoded image data Db0 to the compensation data generator 37.

The compensation data generator 37 generates the compensation data Dc according to the present image data Di1, the decoded image data Db0, the encoded data Da1, and the encoded data Da0 output by the delay unit 5. The operation of the compensation data generator 37 will be described in detail below.

Figure 52:
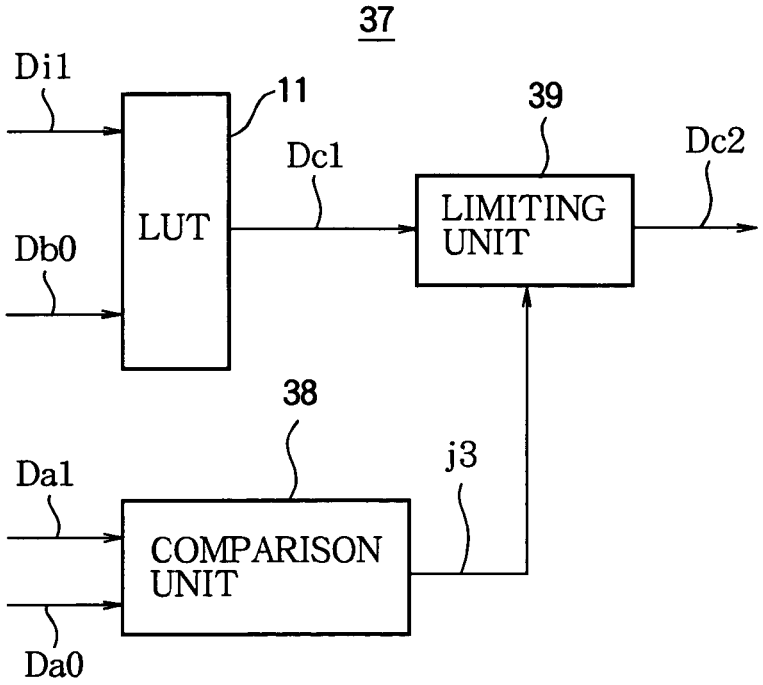
FIG. 52 shows a first structure of the compensation data generator in the seventh embodiment.

FIG. 52 shows a first structure of the compensation data generator 37. A lookup table 11 outputs compensation data Dc1 according to the present image data Di1 and the decoded image data Db0. A comparison unit 38 compares the encoded data Da0 with the encoded data Da1; when both encoded data Da0 and Da1 are identical, there is no need to compensate, so the comparison unit 38 sends a limiting unit 39 a compensation-magnitude limitation signal j3 that sets the value of the compensation data Dc1 to zero.

When the encoded data Da0 and Da1 are identical, the limiting unit 39 outputs new compensation data Dc2 by setting the value of the compensation data Dc1 to zero according to the compensation-magnitude limitation signal j3. The compensation data Dc2 output by the limiting unit 39 are output to the compensation unit 9 as the compensation data Dc shown in FIG. 51. The compensation unit 9 modifies the present image data Di1 according to the compensation data Dc and outputs the modified image data Dj1 to a display unit 10.

Figure 50:
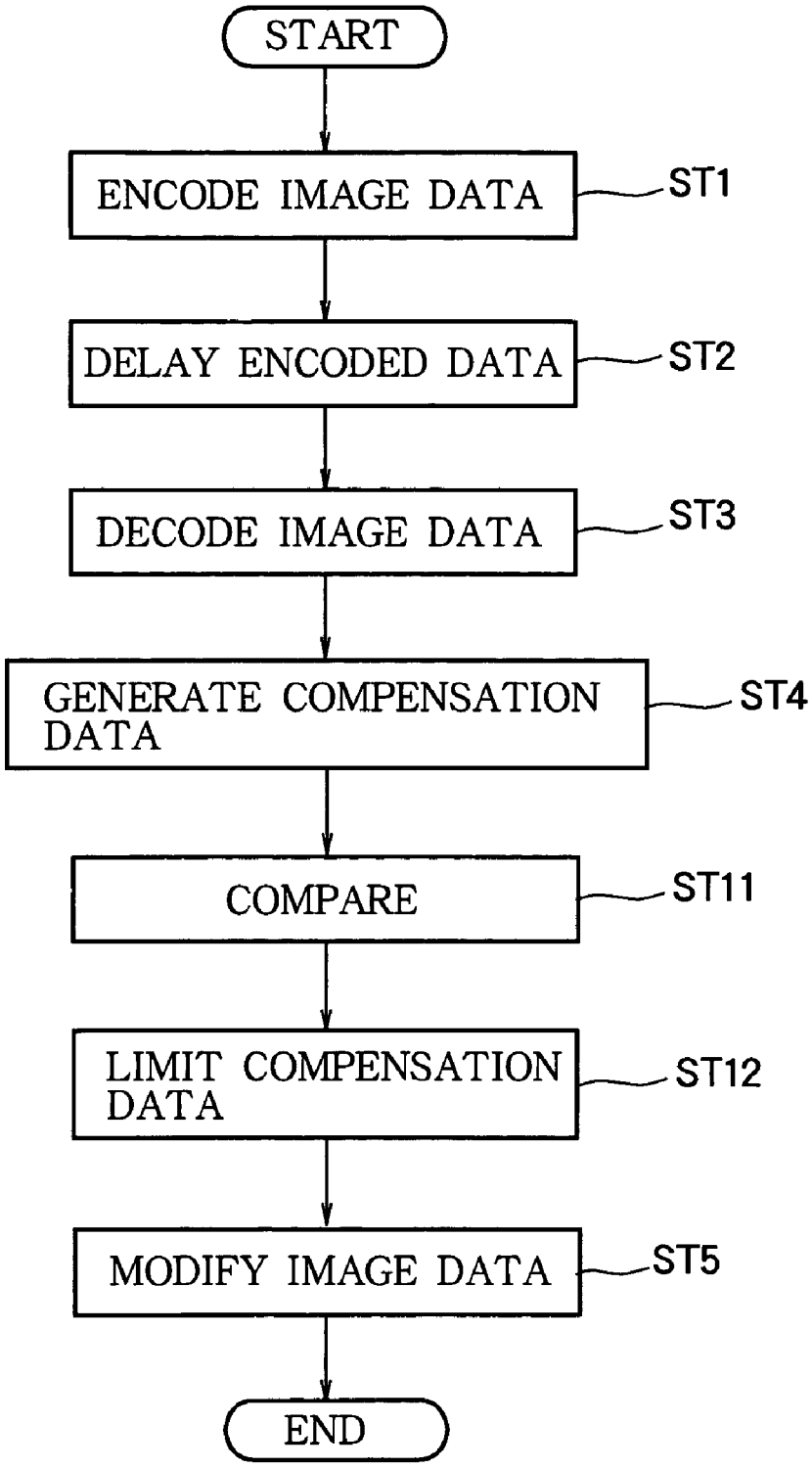
FIG. 50 is a flowchart showing the operation of a liquid-crystal driving circuit according to a seventh embodiment.

FIG. 50 is a flowchart showing the operation of the liquid-crystal driving circuit according to the seventh embodiment in FIG. 51. The compensation data Dc1 are generated by the operations carried out in steps St1 to St4 as in the first embodiment. In the following comparison step (St11), the comparison unit 38 compares the encoded image data Da1 with the encoded image data Da0, and outputs the compensation-magnitude limitation signal j3 when the encoded image data Da0 and Da1 are identical. In the compensation data limitation step (St12), the limiting unit 39 outputs the compensation data Dc2 according to the compensation-magnitude limitation signal j3. In the image data compensation step (St5), the present image data Di1 are modified according to the compensation data Dc2 output by the limiting unit 39.

When the liquid-crystal driving circuit according to the seventh embodiment generates the compensation data Dc according to the present image data Di1 and the decoded image data Db0, as described above, if the encoded data Da0 and Da1 are identical, the seventh embodiment can control the response speed of the liquid crystal accurately and prevent degradation of the displayed image due to unnecessary compensation by setting the value of the compensation data Dc1 to zero.

Figure 53:
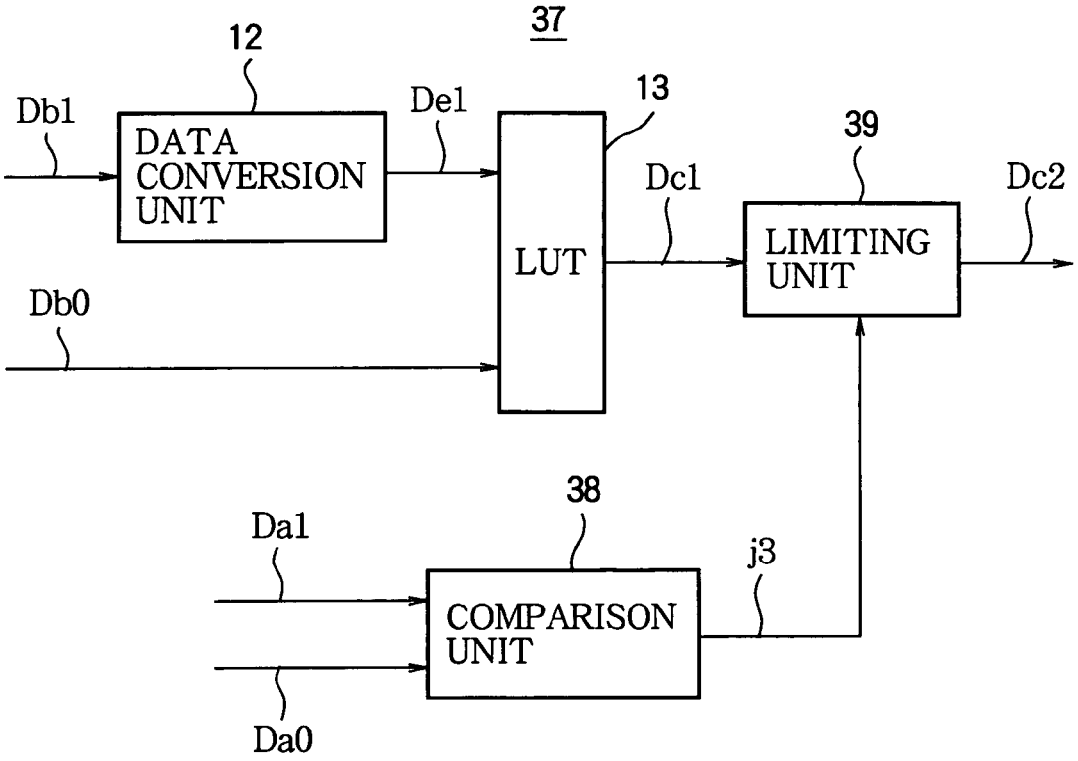
FIG. 53 shows an alternative structure of the compensation data generator in FIG. 52.

FIG. 53 shows an alternative structure of the compensation data generator 37 in FIG. 52. The compensation data generator 37 may include a data conversion unit 12 that reduces the decoded image data Db1 to a smaller number of bits, and may generate compensation data Dc1 according to the decoded image data De1 with the converted number of bits.

Figure 54:
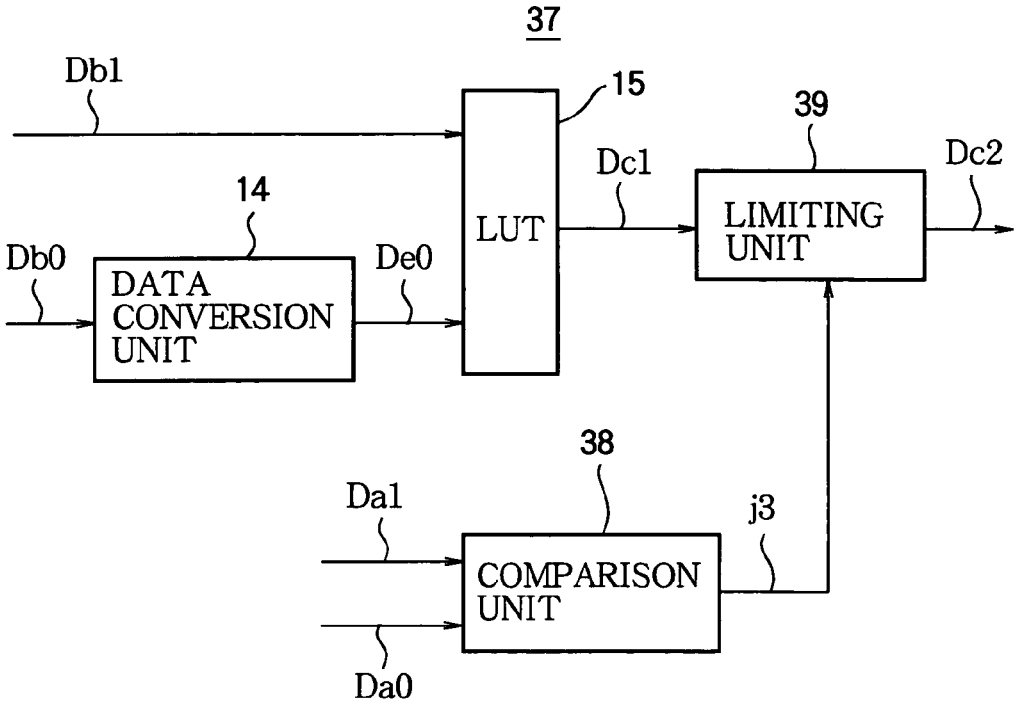
FIG. 54 shows an alternative structure of the compensation data generator in FIG. 52.

As shown in FIG. 54, the compensation data generator 37 may include a data conversion unit 14 that reduces the decoded image data Db0 to a smaller number of bits, and may generate compensation data Dc1 according to the decoded image data De0 with the converted number of bits.

Figure 55:
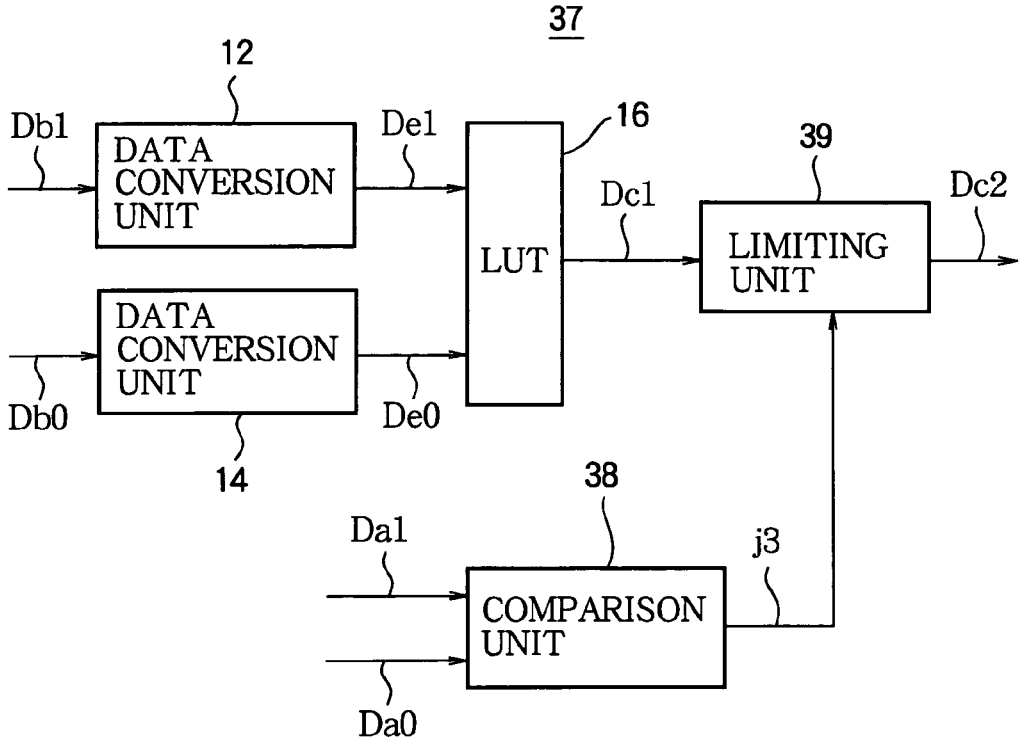
FIG. 55 shows an alternative structure of the compensation data generator in FIG. 52.

As shown in FIG. 55, the compensation data generator 37 may include data conversion units 12, 14 that reduce the number of bits of the decoded image data Db1 and Db0, and may generate compensation data Dc1 according to the decoded image data De1 and De0 with the converted number of bits.

Figure 56:
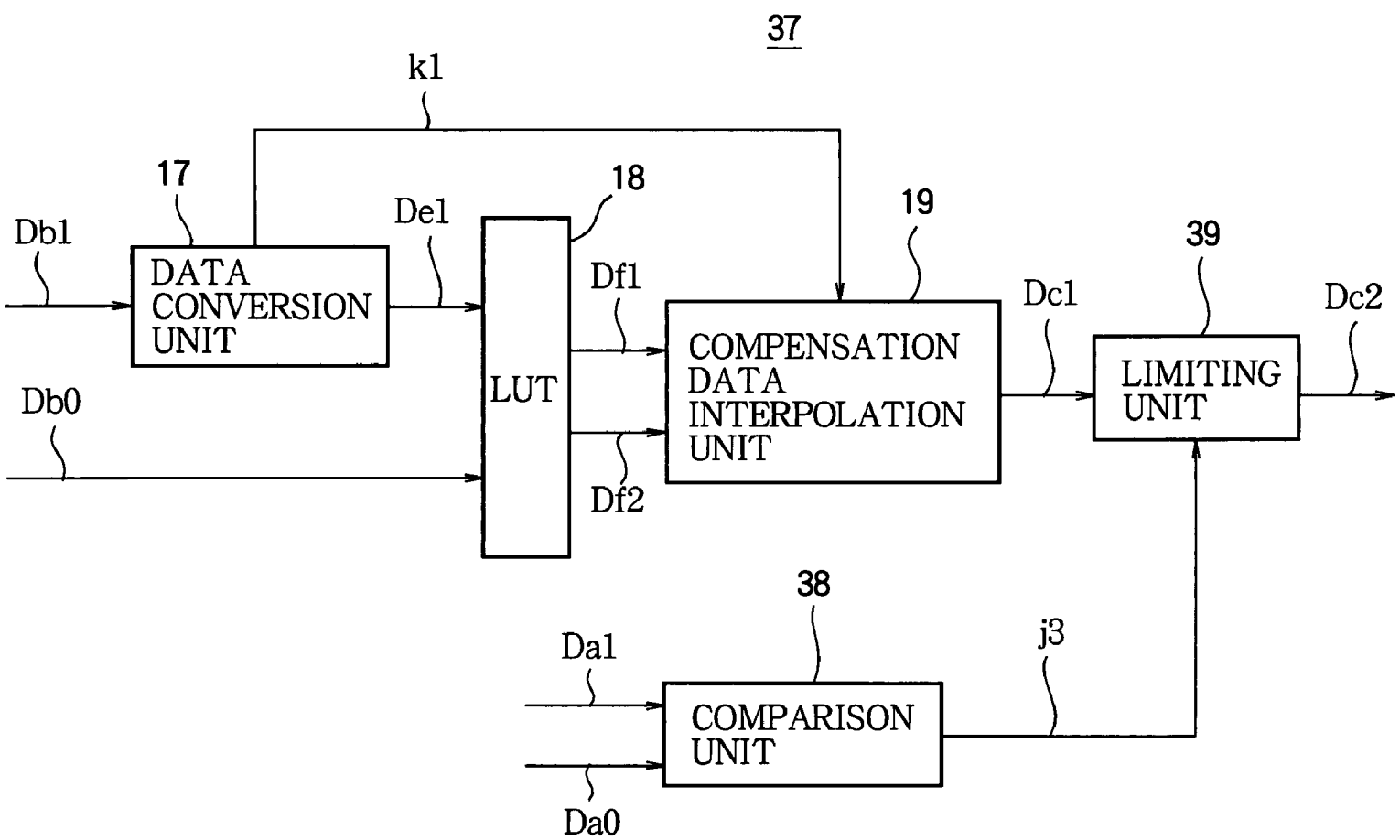
FIG. 56 shows a second structure of the compensation data generator in the seventh embodiment.

FIG. 56 shows a second structure of the compensation data generator 37. A data conversion unit 17 reduces the number of bits with which the decoded image data Db1 are quantized, calculates an interpolation coefficient k1, and sends the calculated interpolation coefficient k1 to a compensation data interpolation unit 19. A lookup table 18 outputs two compensation data values Df1 and Df2 according to the decoded image data Db0 and the decoded image data De1 with the converted number of bits, and sends the compensation data values Df1 and Df2 to the compensation data interpolation unit 19. The compensation data interpolation unit 19 calculates compensation data Dc1 according to the compensation data values Df1 and Df2 and the interpolation coefficient k1, and outputs the compensation data Dc1 to a limiting unit 39. The limiting unit 39 limits the magnitude of the compensation in the compensation data Dc1 according to the compensation-magnitude limitation signal j3 output by the comparison unit 38, and outputs new compensation data Dc2.

The data conversion unit 17, lookup table 18, and compensation data interpolation unit 19 in FIG. 56 operate as described in the third embodiment.

Figure 57:
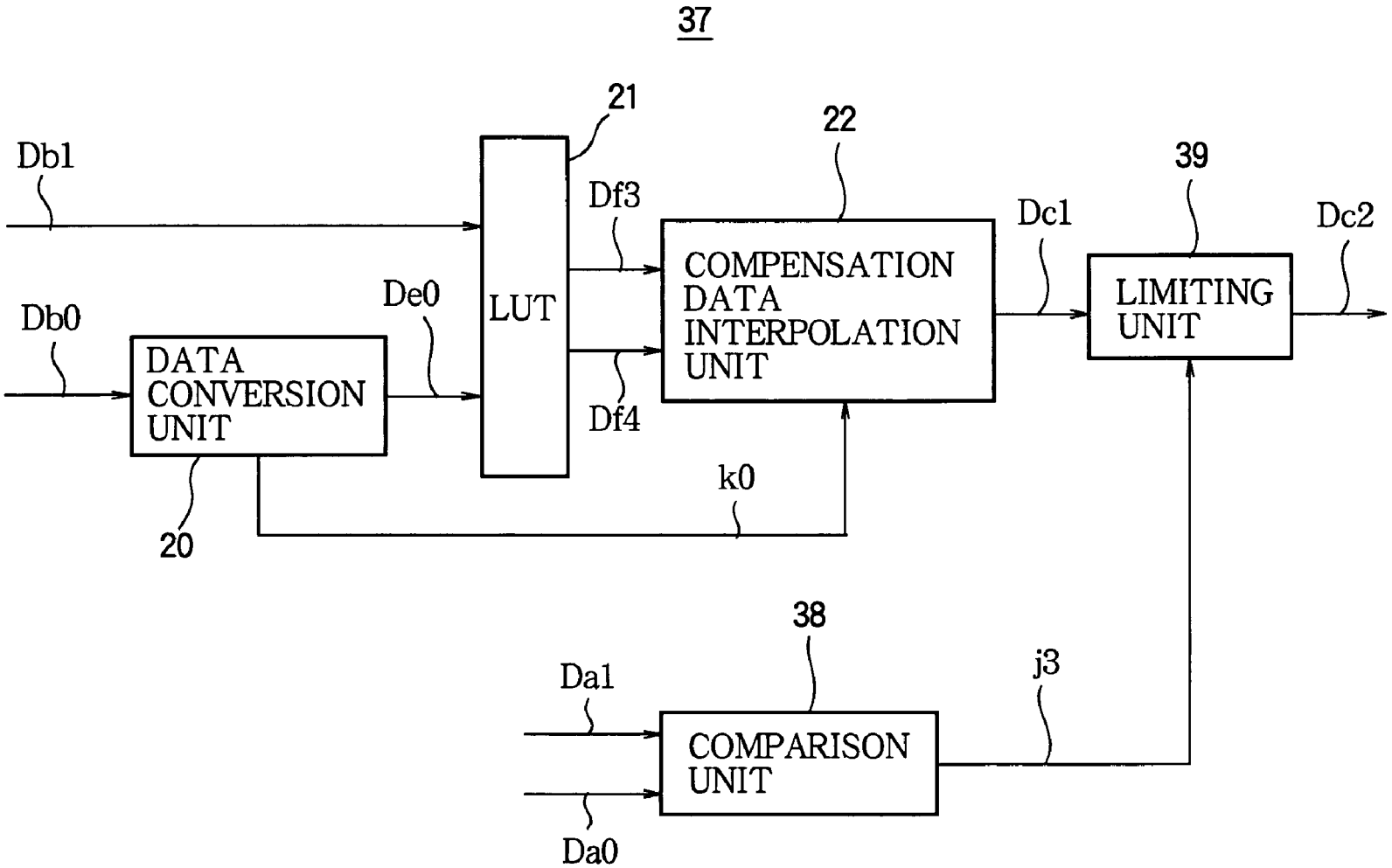
FIG. 57 shows a third structure of the compensation data generator in the seventh embodiment.

FIG. 57 shows a third structure of the compensation data generator 37. A data conversion unit 20 converts the number of bits by reducing the number of bits with which the decoded image data Db0 are quantized, calculates an interpolation coefficient k0, and sends the calculated interpolation coefficient k0 to the compensation data interpolation unit 22. A lookup table 21 outputs two compensation data values Df3 and Df4 according to the decoded image data Db1 and the decoded image data De0 with the converted number of bits, and sends the compensation data values Df3 and Df4 to a compensation data interpolation unit 22. The compensation data interpolation unit 22 calculates compensation data Dc1 according to the compensation data values Df3 and Df4 and the interpolation coefficient k0, and outputs the compensation data Dc1 to a limiting unit 39. The limiting unit 39 limits the magnitude of the compensation in the compensation data Dc1 according to the compensation-magnitude limitation signal j3 output by the comparison unit 38, and outputs new compensation data Dc2.

The data conversion unit 20, lookup table 21, and compensation data interpolation unit 22 in FIG. 57 operate as described in the third embodiment.

Figure 58:
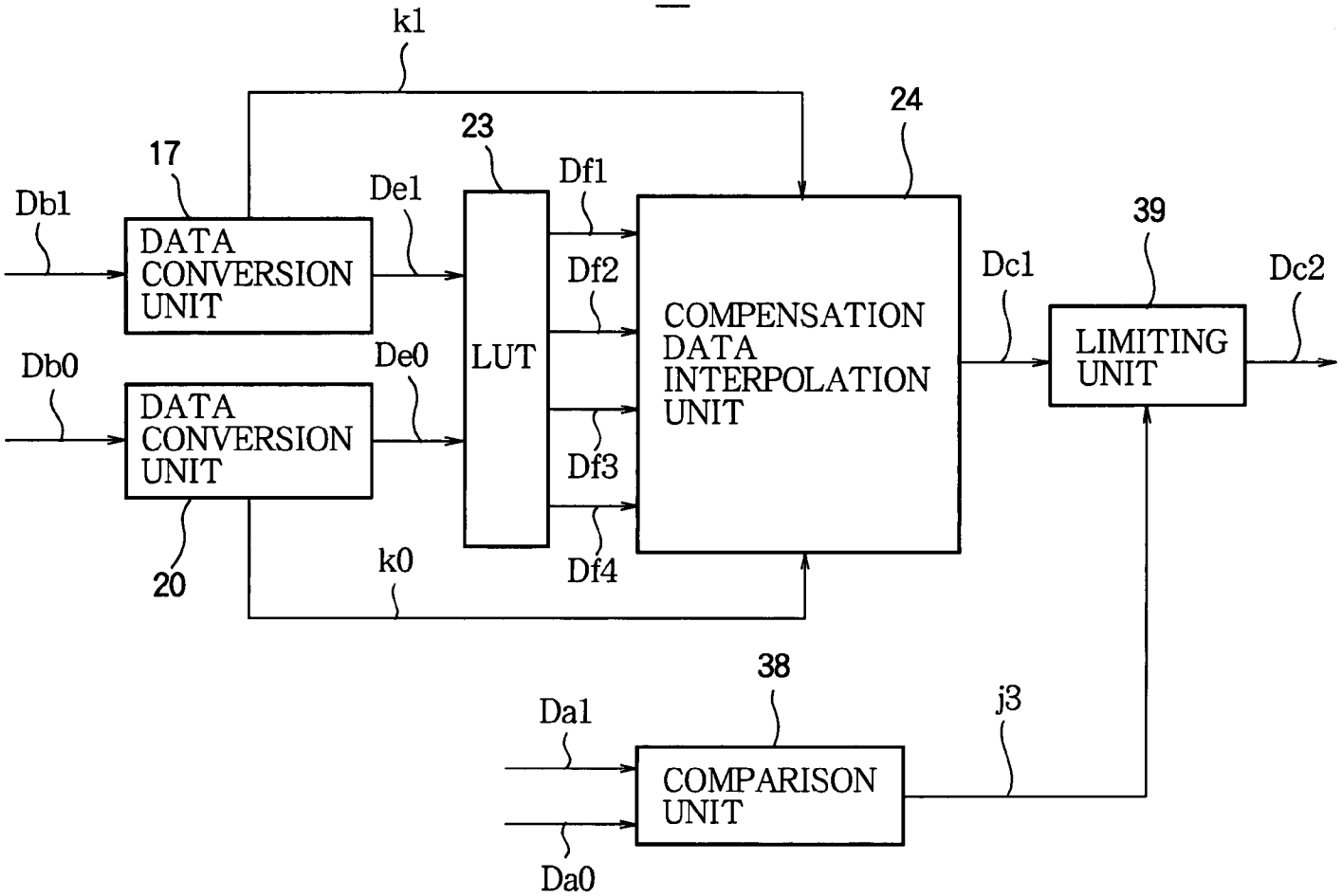
FIG. 58 shows a fourth structure of the compensation data generator in the seventh embodiment.

FIG. 58 shows a fourth structure of the compensation data generator 37. Data conversion units 17, 20 reduce the number of bits with which the respective decoded image data Db1 and Db0 are quantized, calculate interpolation coefficients k1 and k0, and send the calculated interpolation coefficients k1 and k0 to a compensation data interpolation unit 24. A lookup table 23 generates four compensation data values Df1, Df2, Df3, and Df4 according to the decoded image data De1 and De0 with the converted number of bits, and sends the compensation data values Df1, Df2, Df3, and Df4 to a compensation data interpolation unit 24. The compensation data interpolation unit 24 calculates compensation data Dc1 by interpolation according to the compensation data values Df1, Df2, Df3, and Df4 and the interpolation coefficients k1 and k0, and outputs the compensation data Dc1 to a limiting unit 39. The limiting unit 39 limits the magnitude of the compensation in the compensation data Dc1 according to the compensation-magnitude limitation signal j3 output by the comparison unit 38, and outputs new compensation data Dc2.

The data conversion units 17, 20, lookup table 23, and compensation data interpolation unit 24 in FIG. 58 operate as described in the third embodiment.

Figure 60:
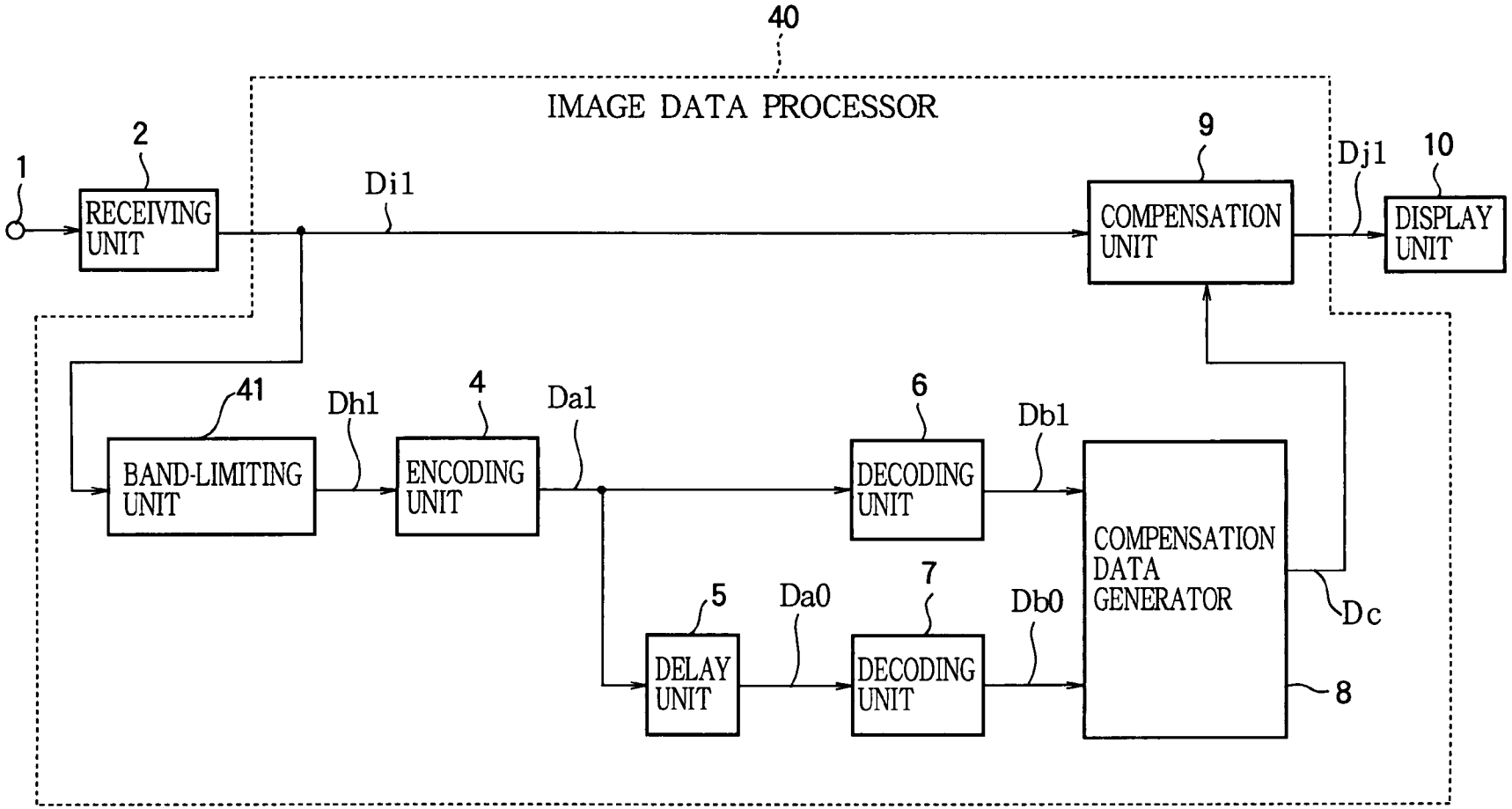
FIG. 60 is a block diagram of a liquid-crystal driving circuit according to the eighth embodiment.

FIG. 60 shows the structure of a liquid-crystal driving circuit according to an eighth embodiment of the invention. The image data processor 40 in the eighth embodiment includes a band-limiting unit 41. The band-limiting unit 41 outputs image data Dh1 obtained by limiting a predetermined frequency component of the present image data Di1. The band-limiting unit 41 comprises, for example, a low-pass filter that limits a high frequency component. An encoding unit 4 encodes the band-limited image data Dh1 obtained from the band-limiting unit 41, and generates encoded data Da1. A delay unit 5 delays the encoded data Da1 for one frame interval and generates encoded data Da0. At the same time, a decoding unit 6 decodes the encoded data Da1, and generates decoded image data Db1. A decoding unit 7 decodes the encoded data Da0, and generates decoded image data Db0. A compensation data generator 8 generates the compensation data Dc according to the image data Db1 and Db0. The encoding unit 4 and the circuit elements downstream thereof operate as in the first embodiment.

Figure 59:
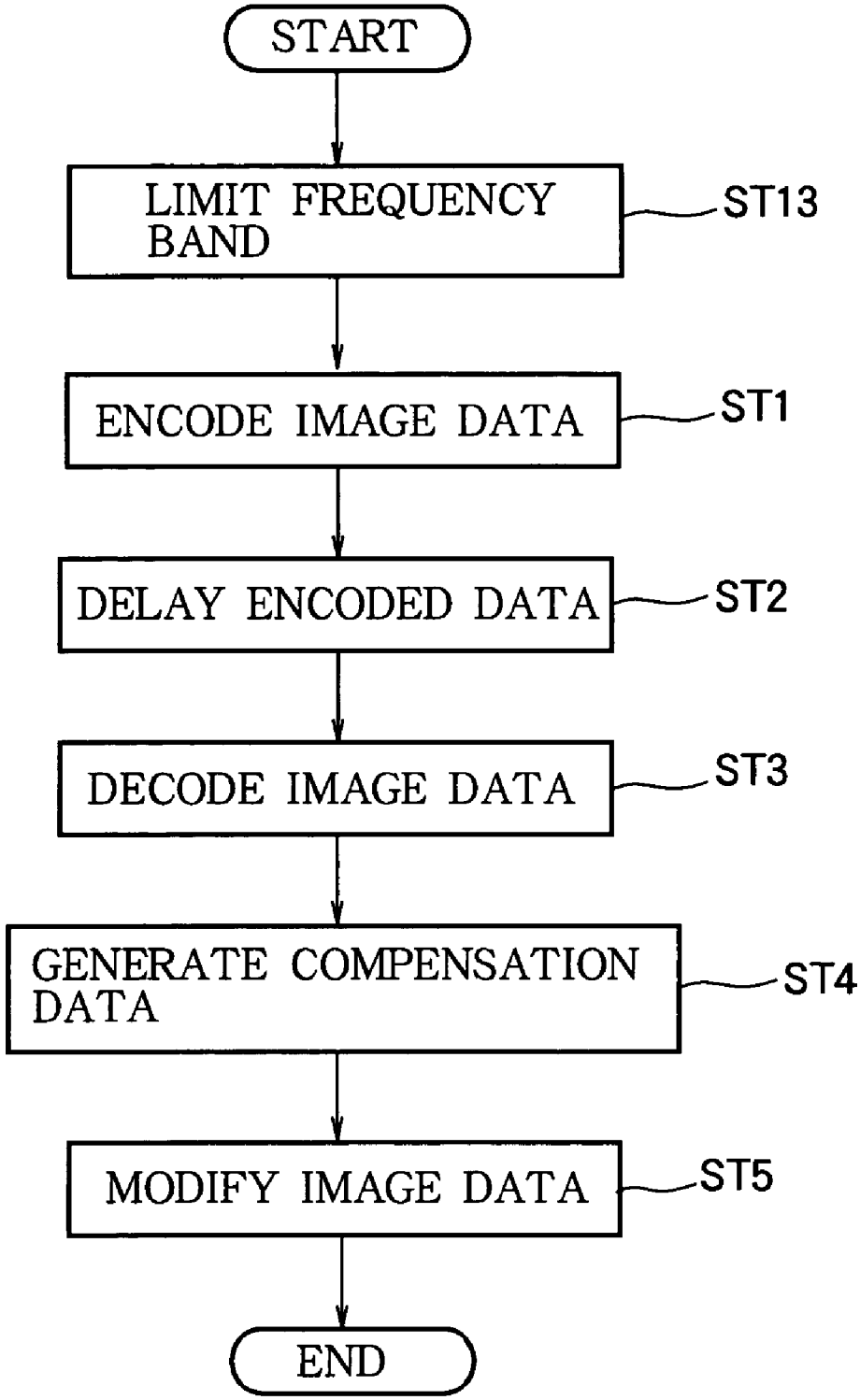
FIG. 59 is a flowchart showing the operation of a liquid-crystal driving circuit according to an eighth embodiment.

FIG. 59 is a flowchart showing the operation of the liquid-crystal driving circuit according to the eighth embodiment in FIG. 60. In the initial frequency band limitation step (St13), the band-limiting unit 41 generates image data Dh1 obtained by limiting a predetermined frequency component of the present image data Di1. In the following image-data encoding step (St1), the band-limited image data Dh1 are encoded. The operations performed in the following steps St2 to St5 are the same as in the first embodiment.

By limiting unnecessary frequency components before encoding the present image data Di1 as described above, it is possible to reduce the encoding error. It thus becomes possible to control the response speed of the liquid crystal more accurately.

A similar effect is obtained if the band-limiting unit 41 comprises a band-pass filter limiting predetermined high-frequency and low-frequency components.

Figure 62:
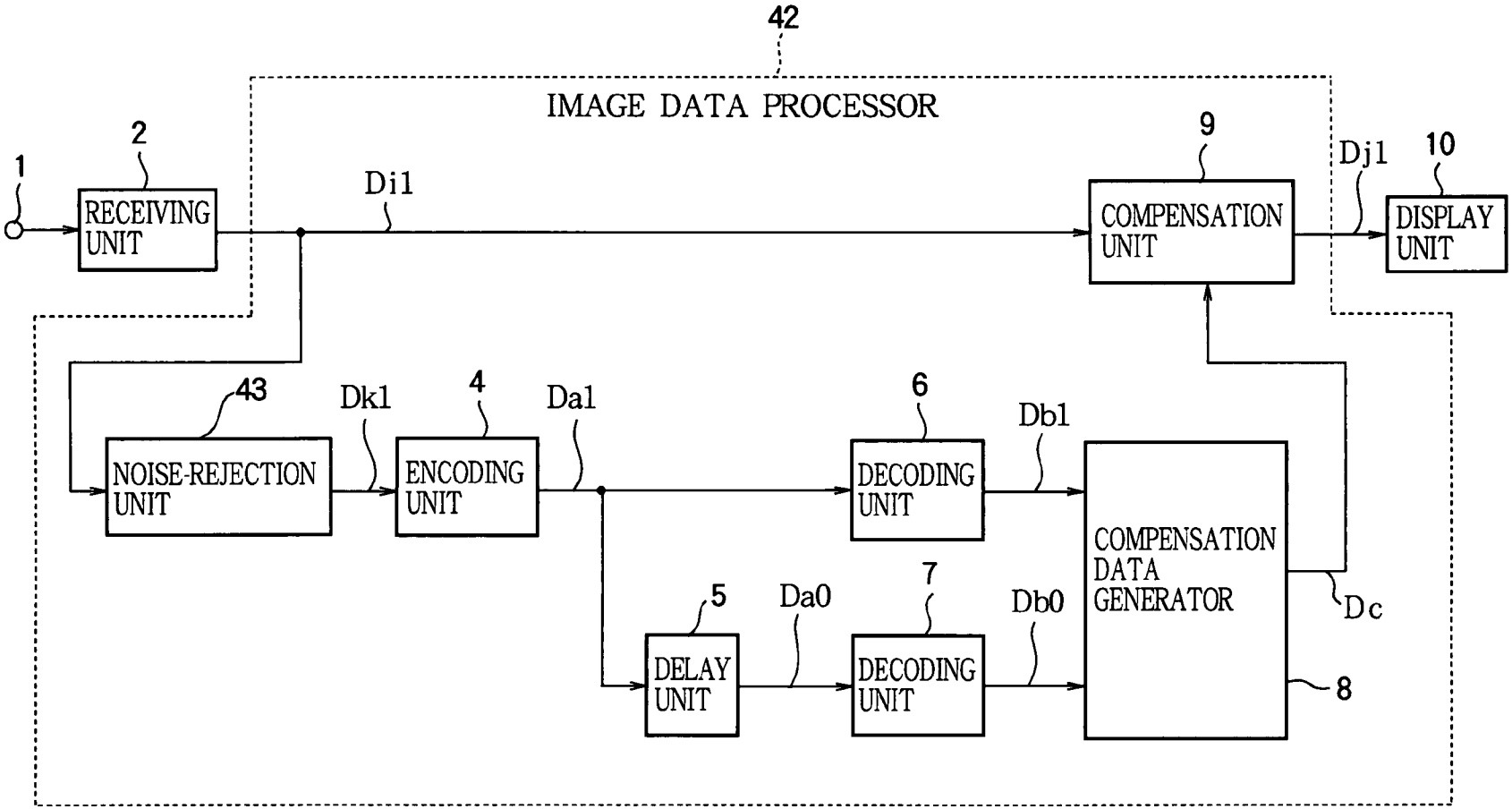
FIG. 62 is a block diagram of a liquid-crystal driving circuit according to the ninth embodiment.

FIG. 62 shows the structure of a liquid-crystal driving circuit according to a ninth embodiment of the invention. A noise-rejection unit 43 attenuates a noise component of the present image data Di1, and generates image data Dk1 without the noise component. The noise component is a high-frequency component with few level changes. An encoding unit 4 encodes the image data Dk1 output from the noise-rejection unit 43, and generates encoded data Da1. The encoding unit 4 and the circuit elements downstream thereof operate as in the first embodiment.

Figure 61:
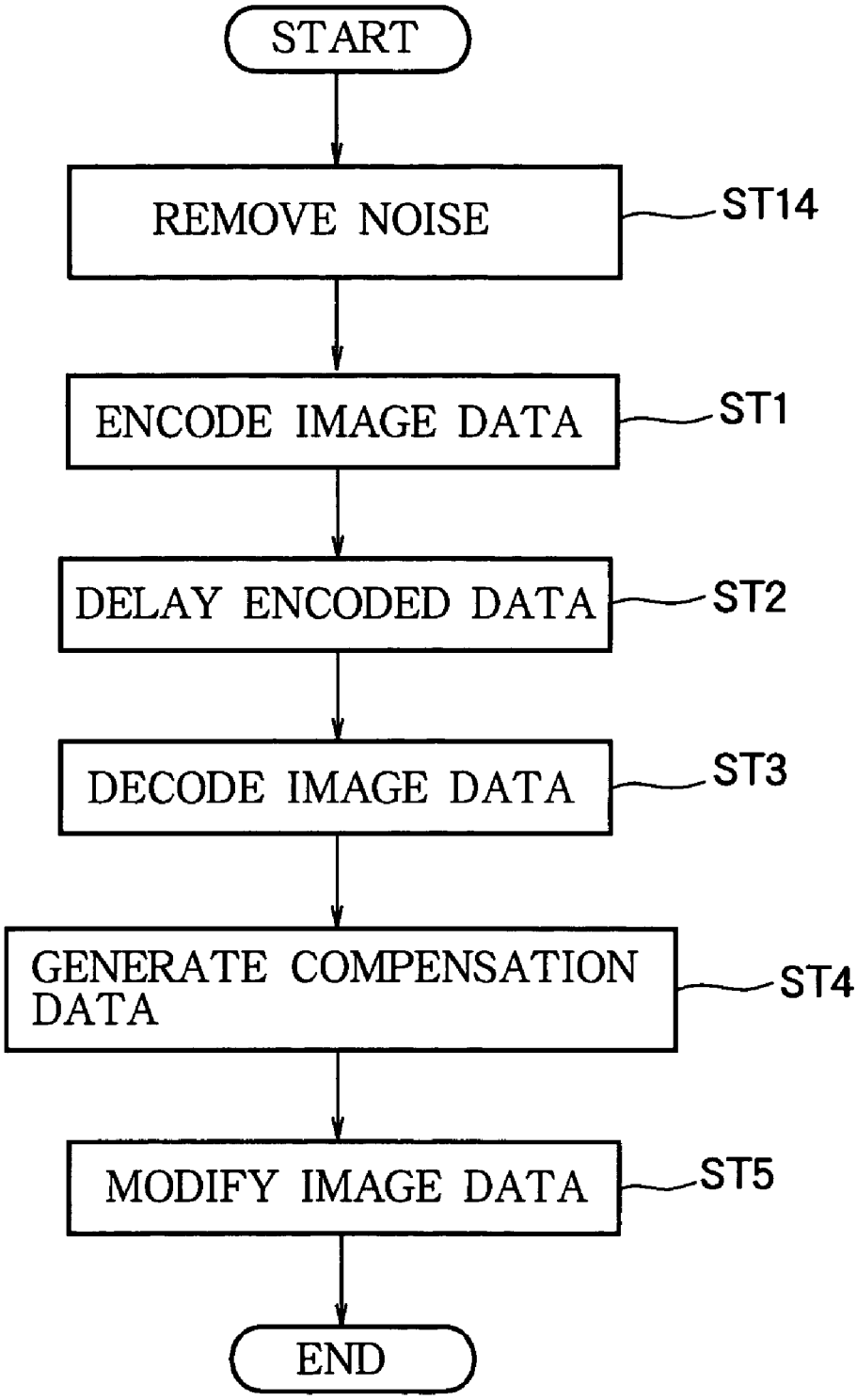
FIG. 61 is a flowchart showing the operation of a liquid-crystal driving circuit according to a ninth embodiment.

FIG. 61 is a flowchart showing the operation of the liquid-crystal driving circuit according to the ninth embodiment in FIG. 62. In the initial noise removal step (St14), the noise-rejection unit 43 generates image data Dk1 obtained by removing a noise component from the present image data Di1. In the second step, which is an image-data encoding step (St1), the image data Dk1 are encoded. The operations performed in the following steps St2 to St5 are the same as in the first embodiment.

By removing a noise component before encoding the present image data Di1 as described above, it is possible to reduce the encoding error. It thus becomes possible to control the response speed of the liquid crystal more accurately.

Figure 64:
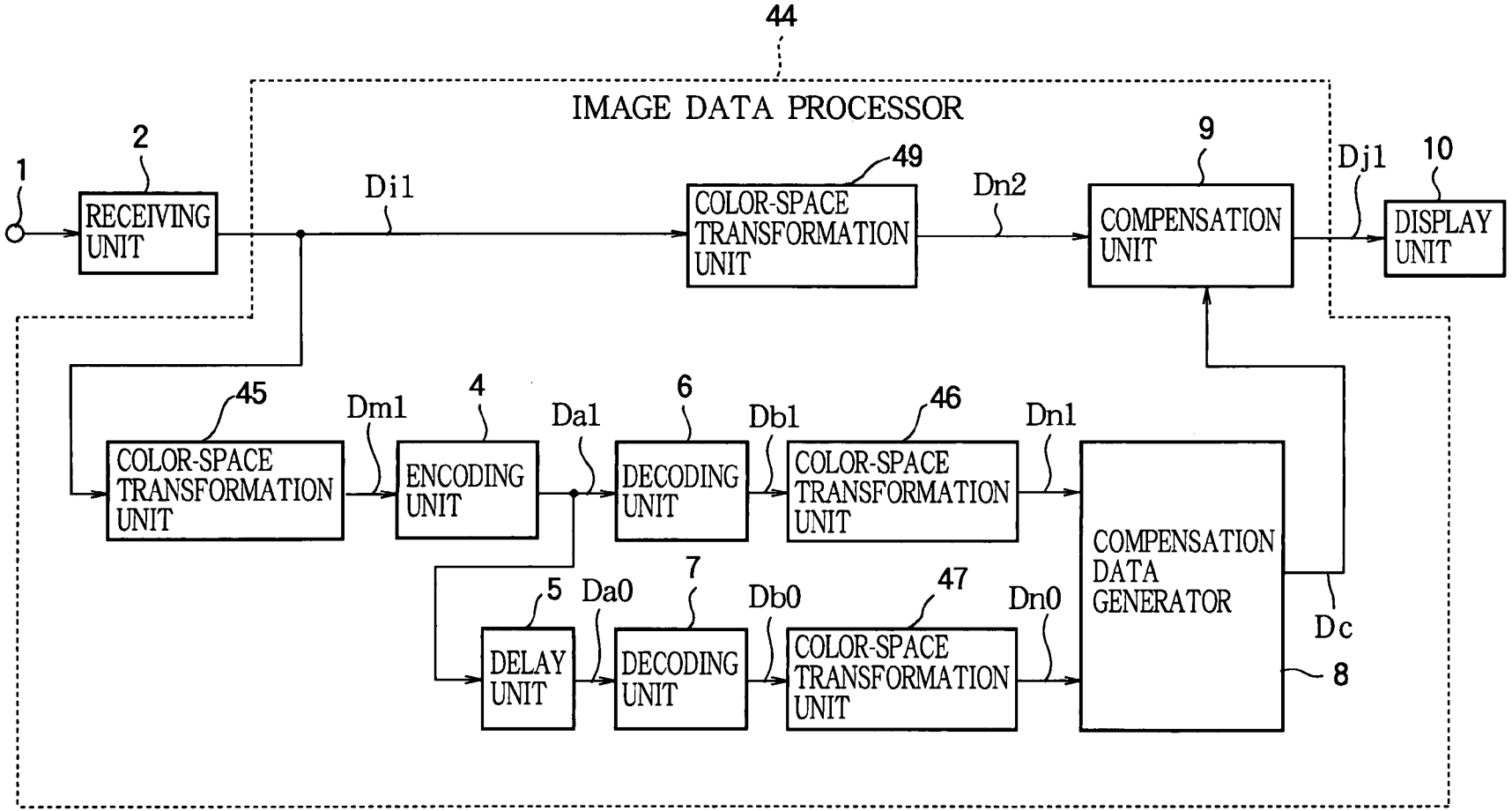
FIG. 64 is a block diagram of a liquid-crystal driving circuit according to the tenth embodiment.

FIG. 64 shows the structure of a liquid-crystal driving circuit according to a tenth embodiment of the invention. The picture signal received by the receiving unit 2 comprises red (R), green (G), and blue (B) image signals. The image data processor 44 in the tenth embodiment includes color-space transformation units 45, 46, 47. The color-space transformation unit 45 converts the RGB present image data Di1 to a Y-C signal comprising a luminance signal (Y) and a chrominance signal (C), and outputs present image data Dm1 for the Y-C signal. An encoding unit 4 encodes the present image data Dm1, and generates encoded data Da1 corresponding to the present image data Dm1. A delay unit 5 delays the encoded data Da1 for one frame interval, thereby generating encoded data Da0 corresponding to the image one frame before the present image. Respective decoding units 6, 7 decode the encoded data Da1 and Da0, thereby generating decoded image data Db1 corresponding to the present image, and decoded data Db0 corresponding to the image one frame before the present image.

The color-space transformation units 46, 47 convert the decoded image data Db1 and Db0 of the Y-C signal comprising luminance and chrominance signals to RGB digital signals, and output RGB image data Dn1 and Dn0. A compensation data generator 8 generates compensation data Dc according to the image data Dn1 and Dn0.

Figure 63:
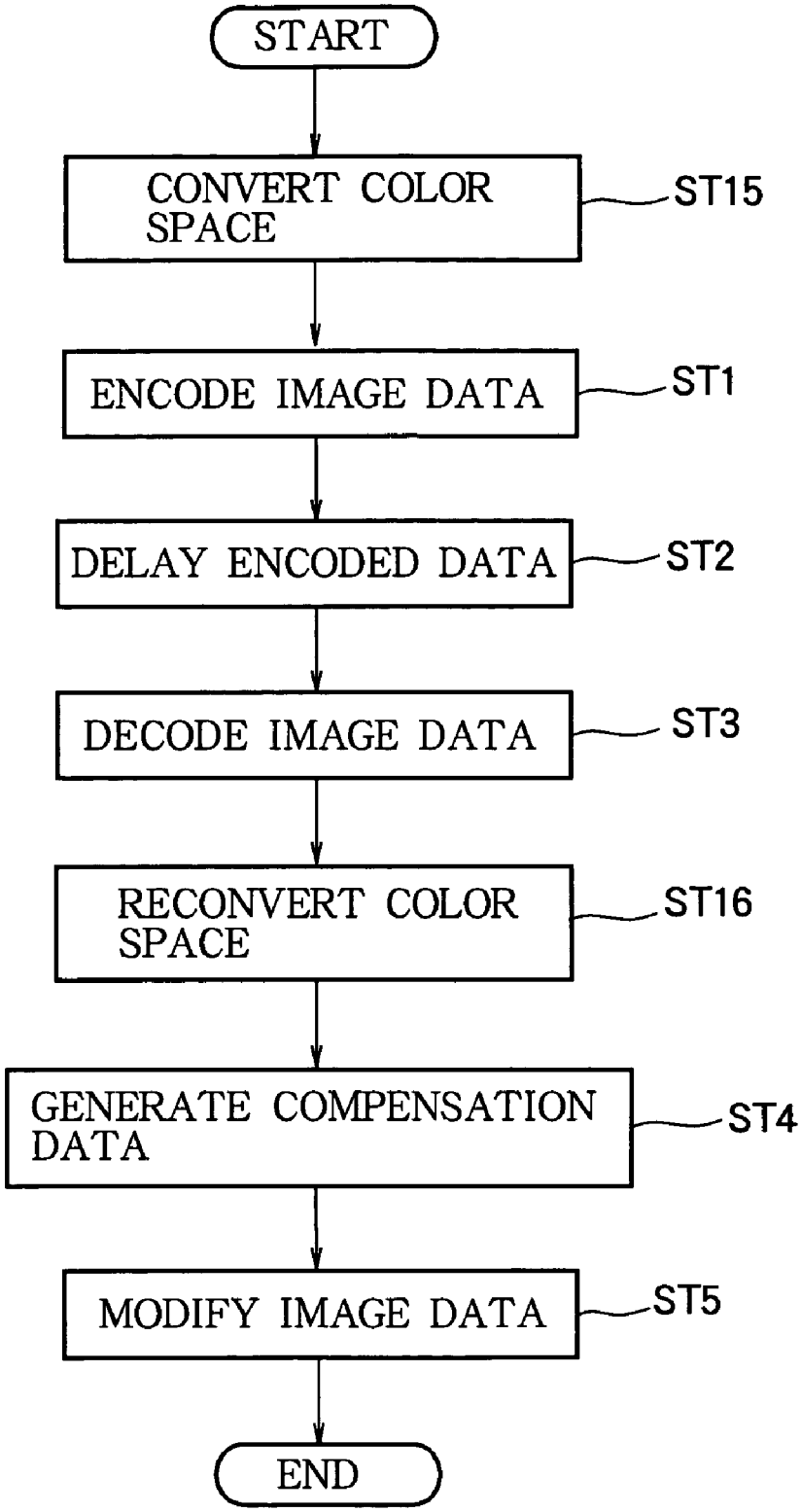
FIG. 63 is a flowchart showing the operation of a liquid-crystal driving circuit according to a tenth embodiment.

FIG. 63 is a flowchart showing the operation of the liquid-crystal driving circuit according to the tenth embodiment in FIG. 64. In the initial first color space conversion step (St15), the color-space transformation unit 45 generates the image data Dm1 by converting the RGB present image data Di1 to a Y-C signal comprising luminance and chrominance signals. In the following image-data encoding step (St1), the encoding unit 4 generates the encoded data Da1 by encoding the image data Dm1. In the encoded data delay step (St2), the delay unit 5 outputs the encoded data Da0 one frame before the encoded data Da1. In the following image data decoding step (St3), the decoding units 6, 7 generate the decoded image data Db1 and Db0 by decoding the encoded data Da1 and the encoded data Da0 one frame before. In the second color space conversion step (St16), the color-space transformation units 46, 47 generate the image data Dn1 and Dn0 by(converting the decoded image data Db1 and Db0 from Y-C signals comprising luminance and chrominance signals to RGB digital signals. In the following compensation data generation step (St4), the compensation data Dc are generated according to the image data Dn1 and Dn0.

By converting the RGB signal to the image data Dm1 of an Y-C signal comprising luminance and chrominance signals as described above, it is possible to increase the encoding ratio (data compression ratio). Thus, it is possible to reduce the memory size of the delay unit 5 needed to delay the encoded data Da1.

The image data processor 44 can be also structured to use different compression ratios for the luminance and chrominance signals. In this case, it is possible to reduce the size of the encoded data Da1 while retaining the information needed to generate the compensation data by lowering the compression ratio of the luminance signal, so as not to lose information, and raising the compression ratio of the chrominance signal.

Figure 65:
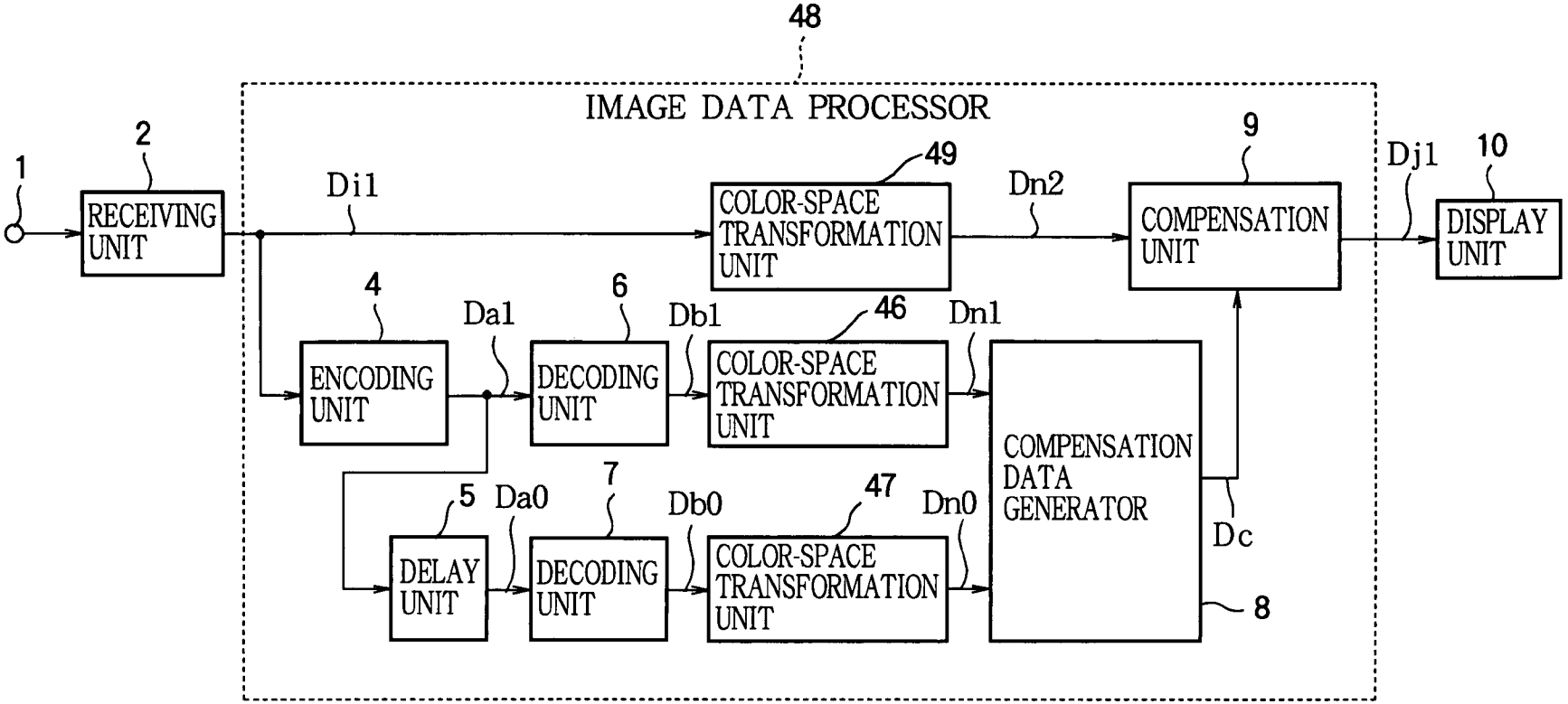
FIG. 65 shows an alternative structure of the liquid-crystal driving circuit according to the tenth embodiment.

FIG. 65 shows an alternative structure of the liquid-crystal driving circuit according to the tenth embodiment. The receiving unit 2 receives the image signal as a Y-C signal comprising a luminance signal and a chrominance signal. In the image data processor 48, a color-space transformation unit 49 generates image data Dn2 by converting the present image data Di1 of the Y-C signal to an RGB digital signal. The color-space transformation units 46, 47 generate decoded image data Dn1 and Dn0 by converting Db1 and Db0 to RGB digital signals.

Figure 66:
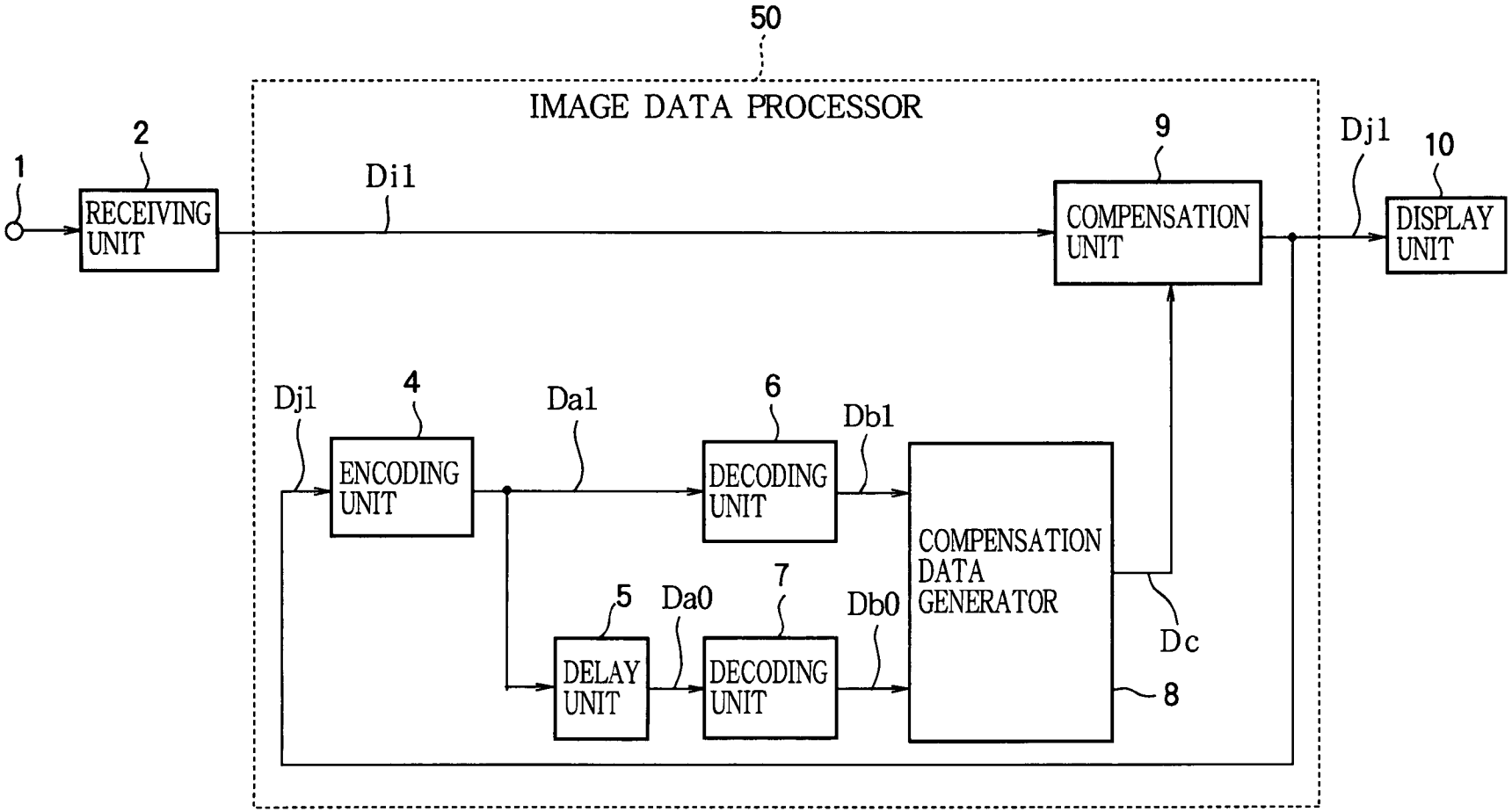
FIG. 66 shows a first structure of a liquid-crystal driving circuit according to an eleventh embodiment.

FIG. 66 shows a first structure of a liquid-crystal driving circuit according to an eleventh embodiment of the invention. In the image data processor 50 according to the eleventh embodiment, the encoding unit 4 generates encoded data Da1 by encoding the image data Dj1 output from the compensation unit 9. A delay unit 5 outputs encoded data Da0 obtained by delaying the encoded data Da1 for one frame interval. Respective decoding units 6, 7 generate decoded image data Db1 and Db0 by decoding the encoded data Da1 and Da0. Decoded image data Db1 correspond to the image data Dj1 output from the compensation unit 9; decoded data Db0 correspond to the image data one frame before the image data Dj1. A compensation data generator 8 generates compensation data Dc according to the decoded image data Db0 and Db1. By modifying the gray levels in the image data Di1 according to the compensation data Dc as in the first embodiment, a compensation unit 9 generates new image data Dj1 corresponding to the present image data Di1, and outputs the image data Dj1 to a display unit 10 and the encoding unit 4.

Figure 67A:
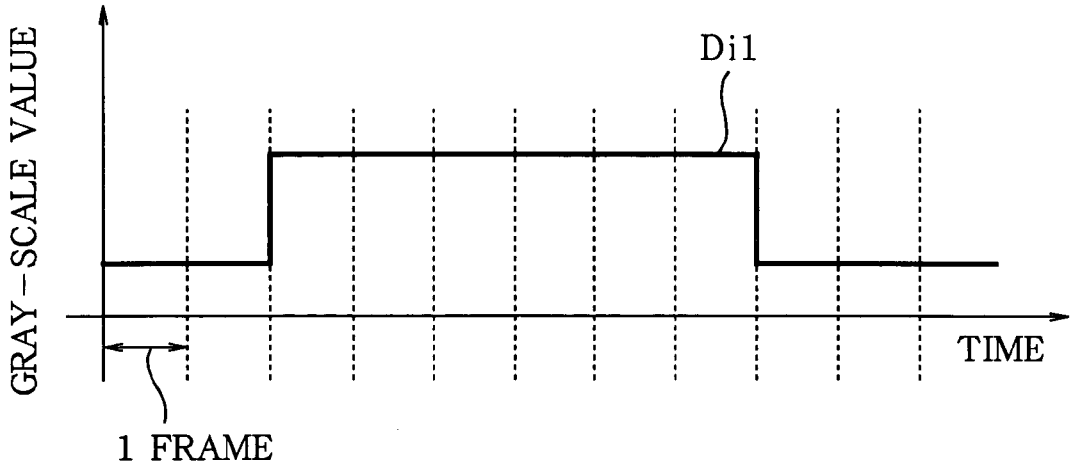
FIGS. 67A, 67B, and 67C illustrate the operation of the eleventh embodiment.
Figure 67B:
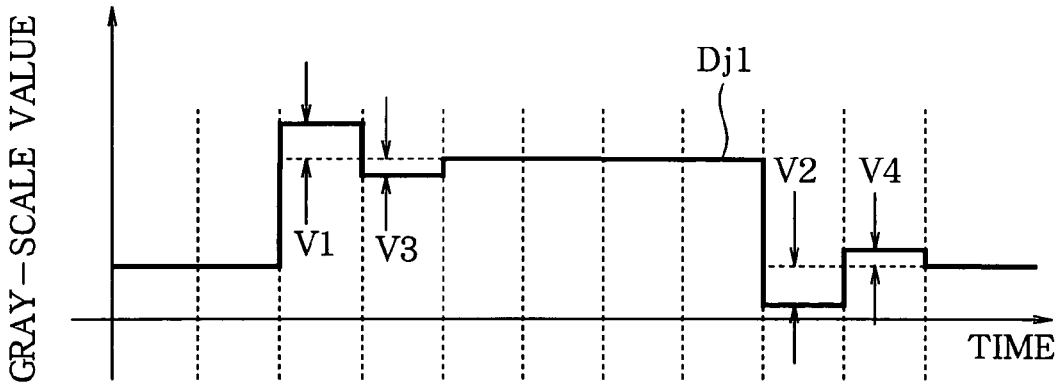
Figure 67C:
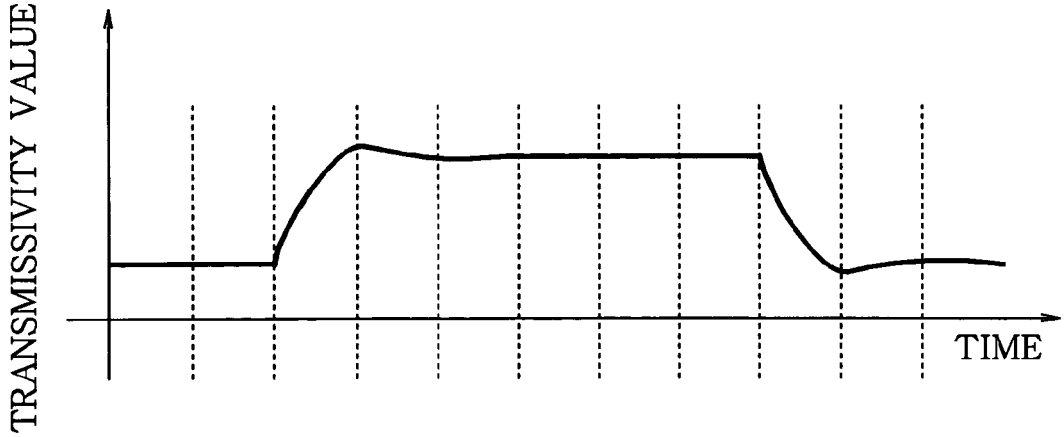

FIGS. 67A, 67B, and 67C illustrate the response characteristics of the liquid crystal in the display unit 10. FIG. 67A shows the value of the present image data Di1 before modification, FIG. 67B shows the value of the modified image data Dj1, and FIG. 67C shows the response characteristics of the liquid crystal when voltage is applied according to the image data Dj1. When the gray-scale value in the present image increases or decreases compared with the value one frame before, compensation values are added to or subtracted from the present image data Di1 according to the compensation data Dc, thereby generating image data Dj1 representing a new image corresponding to the present image, as shown in FIG. 67B. Voltage is applied to the liquid crystal in the display unit 10 according to the image data Dj1, thereby driving the liquid crystal to the predetermined transmissivity value within substantially one frame interval, as shown in FIG. 67C. When the gray-scale value in the present image increases compared with the value one frame before, the gray-scale value in the modified image data Dj1 increases by V1' with respect to the present image data Di1, then decreases by V3 with respect to the present image data Di1 in the next frame, as shown in FIG. 67B. When the gray-scale value in the present image decreases compared with the value one frame before, the gray-scale value in the modified image data Dj1 decreases by V2' with respect to the present image data Di1, then increases by V4 with respect to the present image data Di1 in the next frame. It is thus possible both to increase the speed with which the displayed gray scale changes and to emphasize the change in the gray level, as shown in FIG. 67C.

Figure 68:
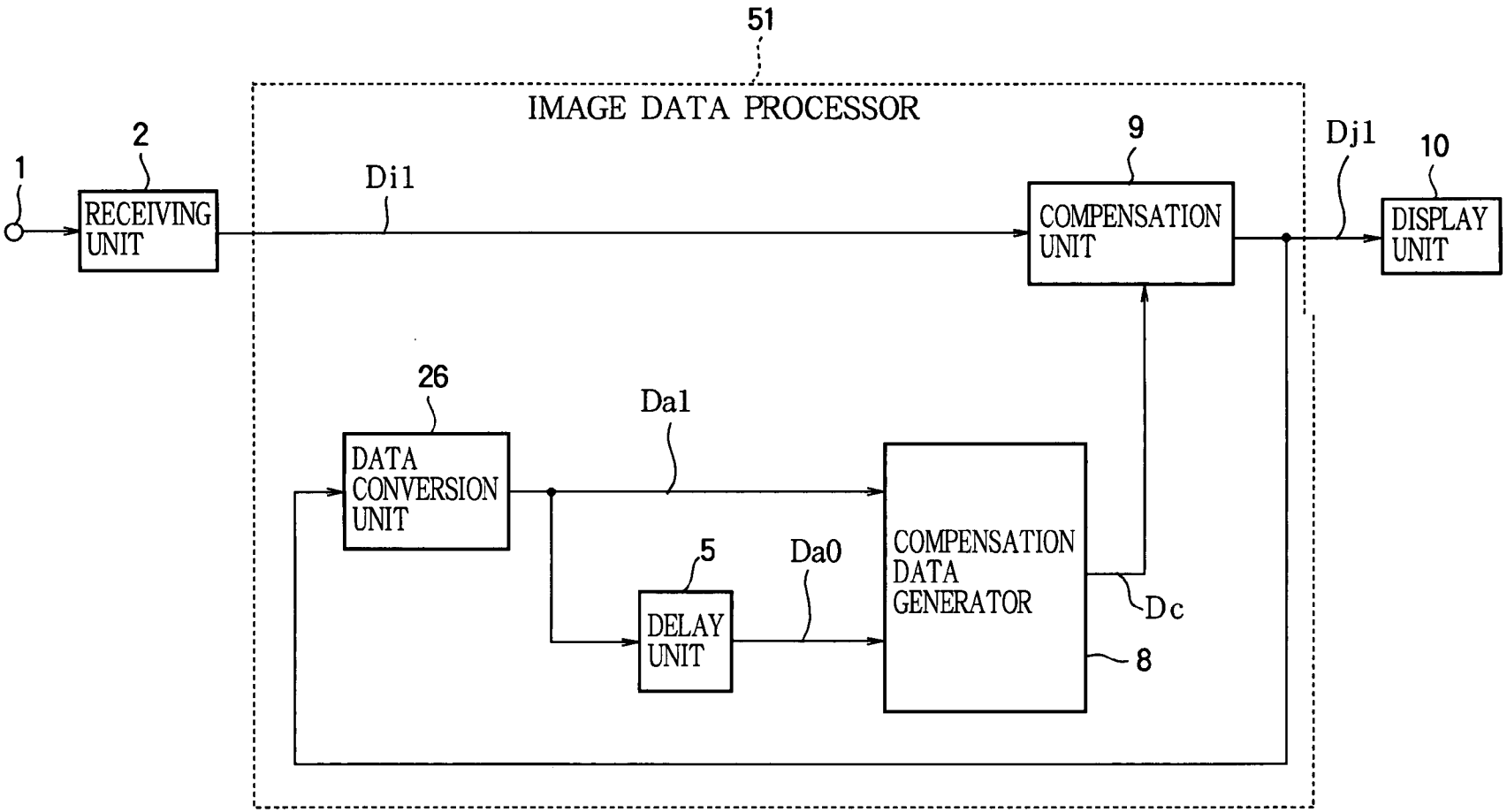
FIG. 68 shows a second structure of the liquid-crystal driving circuit according to the eleventh embodiment.

FIG. 68 shows a second structure of the liquid-crystal driving circuit according to the eleventh embodiment. The data size may be compressed by providing the image data processor 51 with a data conversion unit 26 instead of the encoding unit 4. The data conversion unit 26 converts the number of bits with which the image data Dj1 output from the compensation unit 9 are quantized from eight bits to three bits, for example, as described in the fourth embodiment.

Figure 69:
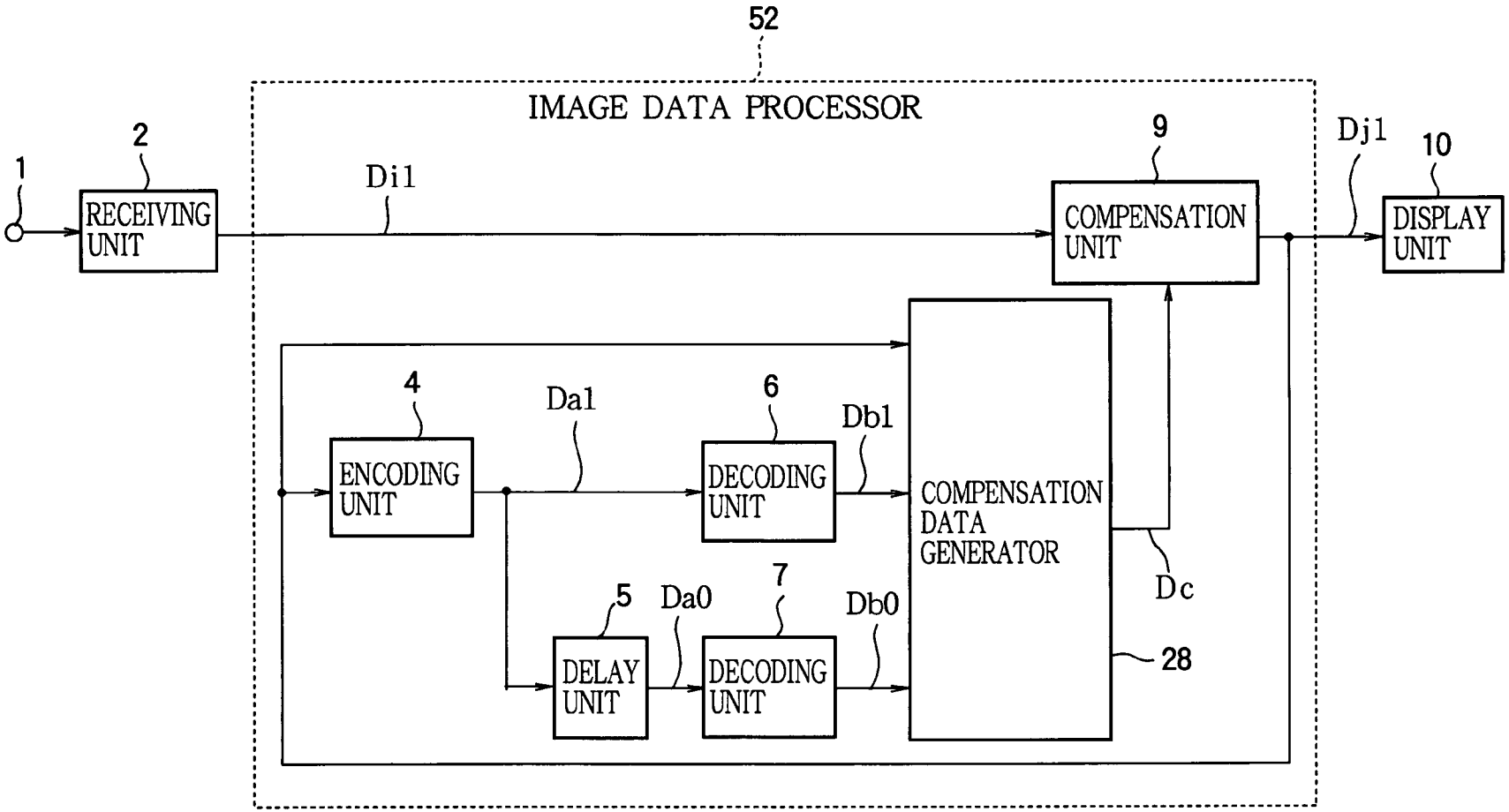
FIG. 69 shows a third structure of the liquid-crystal driving circuit according to the eleventh embodiment.

FIG. 69 shows a third structure of the liquid-crystal driving circuit according to the eleventh embodiment. The compensation data generator 28 in the image data processor 52 may be structured so as to detect the difference between the image data Dj1 output from the compensation unit 9 and the decoded image data Db1, and to limit the magnitude of the compensation in the compensation data Dc according to the detected difference, as described in the fifth embodiment.

Figure 70:
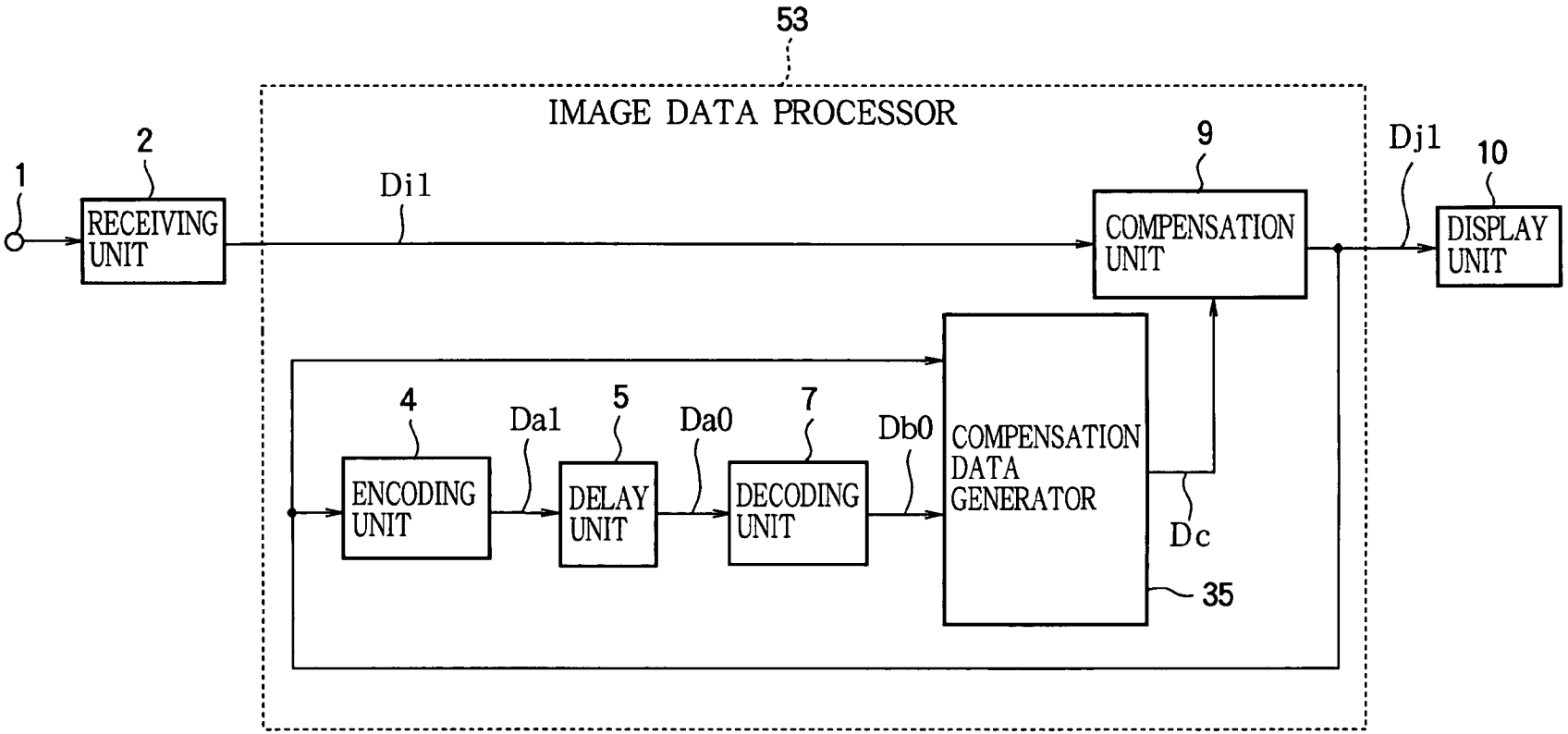
FIG. 70 shows a fourth structure of the liquid-crystal driving circuit according to the eleventh embodiment.

FIG. 70 shows a fourth structure of the liquid-crystal driving circuit according to the eleventh embodiment. The compensation data generator 35 in the image data processor 53 may be structured so as to generate the compensation data Dc according to the image data Dj1 output from the compensation unit 9 and the decoded image data Db0. Effects similar to those in the sixth embodiment are obtained.

Figure 71:
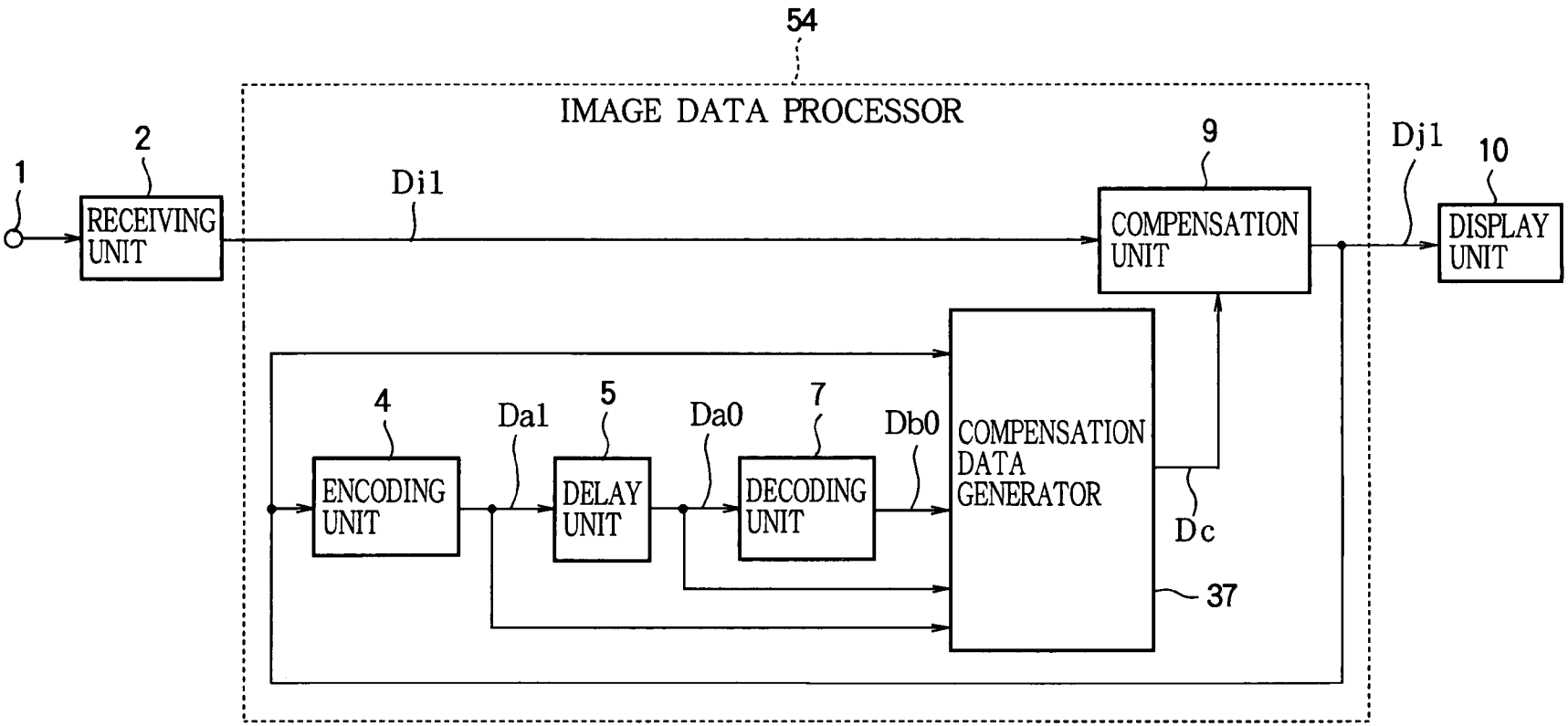
FIG. 71 shows a fifth structure of the liquid-crystal driving circuit according to the eleventh embodiment.
Figure 72:
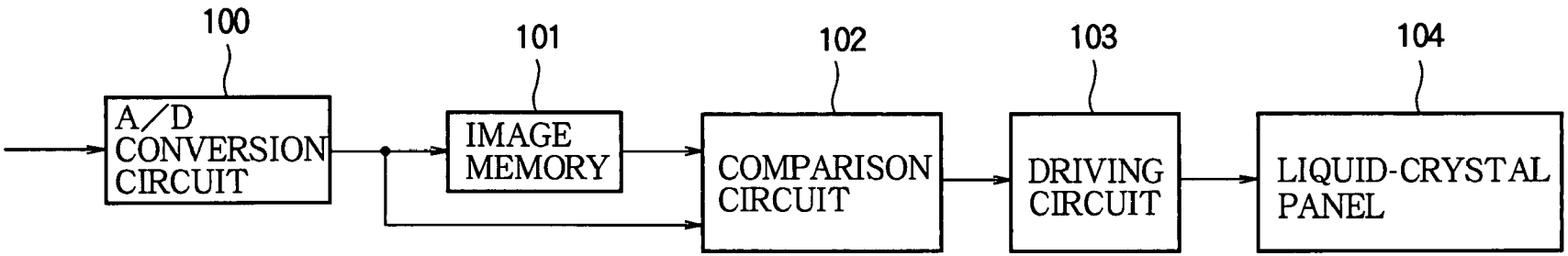
FIG. 72 PRIOR ART
FIG. 72 is a block diagram of a conventional liquid-crystal driving circuit.

FIG. 71 shows a fifth structure of the liquid-crystal driving circuit according to the eleventh embodiment. The compensation data generator 37 in the image data processor 54 may be structured so as to compare the encoded data Da1 with the encoded data Da0 delayed by the delay unit 5, and to limit the magnitude of the compensation in the compensation data Dc when the encoded data Da1 and Da0 are identical, as described in the seventh embodiment.

The invention is not limited to the embodiments and structures described above; those skilled in the art will recognize that further variations are possible within the scope defined by the appended claims.

What is claimed is:

1. An image data processor for a liquid-crystal display that generates image data determining voltages applied to a liquid crystal from gray-scale values of an input image made up of a series of frames, the image processor comprising:

an encoding unit for encoding an input image data of a present frame and outputting an encoded image data;

a first decoding unit for decoding the encoded image data and outputting a first decoded image data corresponding to the present frame;

a delay unit for delaying the encoded image data for an interval corresponding to one frame and outputting a delayed encoded image data;

a second decoding unit for decoding the delayed encoded image data and outputting a second decoded image data corresponding to a previous frame;

a compensation data generator for generating compensation data for adjusting the gray-scale values of the present frame according to the first decoded image data and the second decoded image data; and a compensation unit for generating said image data according to the input image data and the compensation data.

2. The image data processor of claim 1, wherein the compensation data cause the liquid crystal to reach transmissivity values corresponding to the gray-scale values of the input image within substantially one frame interval.

3. The image data processor circuit of claim 1, wherein the compensation data generator includes a data conversion unit for reducing the number of bits of at least one of the first decoded image data and the second decoded image data, and outputting third decoded image data corresponding to the first decoded image data and fourth decoded image data corresponding to the second decoded image data; and a unit for generating the compensation data based on the third decoded image data and the fourth decoded image data.

4. The image data processor of claim 3, wherein the compensation data generator further includes:

a unit for generating an interpolation coefficient from the third decoded image data and the fourth decoded image data; and a compensation data interpolation unit for calculating an interpolated image data and the fourth decoded image data; and a compensation data interpolation unit for calculating an interpolated value of the compensation data using the interpolation coefficient.

5. The image data processor of claim 1, wherein the compensation data generator includes:

an error decision unit for detecting differences between the first decoded image data and the input image data; and a limiting unit for limiting the compensation data according to the detected differences.

6. The image data processor of claim 1, wherein the compensation data generator includes:

an error decision unit for detecting differences between the first decoded image data and the input image data; and a data conversion unit for adding the detected differences to at least one of the first decoded image data and the second image data, and outputting fifth decoded image data corresponding to the first decoded image data and sixth decoded image data corresponding to the second image data; and a unit for generating the compensation data according to the fifth decoded image data and the sixth decoded image data.

7. The image processor of claim 1, further comprising a band-limiting unit for attenuating a predetermined frequency component included in the input image data, wherein the encoding unit encodes the output the band-limiting unit.

8. The image processor of claim 1, further comprising a noise rejection unit for attenuating a noise component included in the input image data, wherein the encodeing unit encodes the outputting the output of the noise rejection unit.

9. A liquid crystal-display device provided with an image data processor of claim 1.

10. An image data processor for liquid-crystal display that generates image data determining voltages applied to a liquid crystal from gray-scale values of an input image made up of a series of frames, the image data processor comprising:

a data conversion unit for reducing the number of bits of an input image data of a present frame, thereby generating a first converted image data corresponding to the present frame;

a delay unit for delaying the first converted image data received directly from the data conversion unit for an interval corresponding to one frame and outputting a second converted image data corresponding to a previous frame;

a compensation data generator for generating compensation data for adjusting the gray-scale values of the present frame according to the first converted image data and the second converted image data; and a compensation unit for generating said image data according to the input image data and the compensation image data.

11. The image processor of claim 10, wherein the compensation data causes the liquid crystal to reach transmissivity values corresponding to the gray-scale values of the input image within substantially one frame interval.

12. A liquid crystal-display device provided with an image data processor of claim 10.

13. An image data processor for a liquid-crystal display that generates image data determining voltages applied to a liquid crystal from gray-scale values of an input image made up of a series of frames, the image data processor comprising:

an encoding unit for encodeing an input image data of a present frame and outputting a first encoded image data;

a delay unit for delaying the first encoded image data for an interval corresponding to one frame and outputting a second encoded image data;

a decoding unit for decoding the second incoded image data and outputting a decoded image data corresponding to a previous frame;

a compensation data generator for generating compensation data for adjusting the gray-scale values of the present frame according to the input image data and the decoded image data; and a compensation unit for generating said image data according to the input image data and the compensation data.

14. The image data processor of claim 13, wherein the compensation data cause the liquid crystal to reach transmissivity values corresponding to the gray-scale values of the input image within substantially one frame interval.

15. The image processor of claim 13, further comprising a limiting unit for setting the value of the compensation data to zero when the first encoded image data and the second encoded image data are substantially identical.

16. A liquid crystal-display device provided with an image data processor of claim 13.

17. An image data processor for a liquid-crystal display that generates image data determining voltages applied to a liquid crystal from gray-scale values of an input image made up of a series of frames, the image data processor comprising:

an encoding unit for encoding the image data of a frame to be displayed on a display unit and outputting an encoded image data;

a first decoding unit for decoding the encoded image data and outputting a first decoded image data corresponding to the frame;

a delay unit for delaying the encoded image for one frame interval and outputting a delayed encoded image data;

a second decoding unit for decodeing the delayed encoded image data and outputting a second decoded image data corresponding to a precious frame;

a compensation data generator for generating compensation data adjusting the gray-scale values of a next frame according to the first decoded image data and the second decoded image data;

a compensation unit for generating the image data which determines the grayscale values of the next frame according to the compensation data and an input image data of the next frame.

18. The image data processor of claim 17, wherein the compensation data cause the liquid crystal to reach transmissivity values corresponding to the gray-scale value of the input image within substantially one frame interval.

19. A liquid crystal-display device provided with an image data processor of claim 17.

20. A method of image data processing for generating image data determining voltages applied to a liquid crystal from grayscale values of an input image data made up of a series of frames, the method comprising:

encoding an input image data of a present frame and outputting an encoded image data;

decoding the encoded image data and outputting a first decoded image data corresponding to the present frame;

delaying the encoded image for an interval corresponding to one frame and outputting a delayed encoded image data;

decoding the delayed encoded image data and outputting a second decoded image data corresponding to a previous frame;

generating compensation data for adjusting the gray-scale values of the present frame according to the first decoded image and the second decoded image; and generating said image data according to the input image data and the compensation data.

21. The method of claim 20, wherein the compensation data is generated by:

reducing the number of bits of at least one of the first decoded image data and the second decoded image data to generate third decoded image data corresponding to the first image data and fourth decoded image data corresponding to the second decoded image data; and generating the compensation data based on the third decoded image data and the fourth decoded image data.

22. The method of claim 20, wherein the compensation data is generated by:

generating an interpolation coefficient from the third decoded image data and the fourth decoded image data; and calculating an interpolated value of the compensation data using the interpolation coefficient.

23. The method of claim 20, wherein the compensation data is generated:

detecting differences between the first decoded image data and the input image data; and limiting the compensation data according to the detected differences.

24. The method of claim 20, wherein the compensation data is generated by:

detecting differences between the first decoded image data and the input image data; and adding the detected differences to at least one of the first decoded image data and the second decoded image data, and outputting fifth decoded image data corresponding to the first decoded image data and sixth decoded image data corresponding to the second decoded image data: and generating the compensation data according to the fifth decoded image data and the sixth decoded image data.

25. The method of claim 20, further comprising attenuating a noise component included in the input image data, wherein the input image data is encoded after attenuating the noise component.

26. A method of image data processing for generating image data determining voltages applied to a liquid crystal from gray-scale values of an input image made up of a series of frames, the method comprising:

reducing the number of bits of an input image data of a present frame, thereby generating a first converted image data corresponding to the present frame;

delaying, directly after being generated, the first converted image data for an interval corresponding to one frame and outputting a second converted image data corresponding to a previous frame;

generating compensation data for adjusting the gray-scale values of the present frame according to the first converted image data and the second converted image data; and generating said image data according to the input image data and the compensation image data.

27. A method of image data processing for generating image data determining voltages applied to a liquid crystal from gray-scale values of an input image made up of a series of frames, the method comprising:

encoding an input image data of a present frame and out putting a first encoded image data;

delaying the first encoded image data for an interval corresponding to one frame and outputting a second encoded image data;

decoding the second encoded image data and outputting a decoded image data corresponding to a previous frame;

generating compensation data for adjusting the gray-scale values of the present frame according to the input image data and the decoded image data; and generating said image data according to the input image data and the compensation data.

28. The method of claim 27, wherein the value of the compensation data is set to zero when the first encoded image data and the second encoded image data are substantially identical.

29. A method of image data processing for generating image data determining voltages applied to a liquid crystal from gray-scale values of an input image made up of a series of frames, the method comprising:

encoding the image data of a frame to be displayed on a display unit and outputting an encoded image data;

decoding the encoded image data and outputting a first decoded image data corresponding to the frame;

delaying the encoded image for one frame interval and outputting a delayed encoded image data;

decoding the delayed encoded image data and outputting a second decoded image data corresponding to a previous frame;

generating compensation data for adjusting the gray-scale values of a next according to the first decoded image data and the second decoded image data;

generating the image data which determines the gray-scale values of the next frame according to the compensation data and an input image data of the next frame.

30. An image data processor for adjusting transmissivity values of liquid crystal comprising:

an encoding unit for encoding an input image data of a present frame and outputting an encoded image data;

a first decoding unit for decoding the encoded image data and outputting a first decoded image data corresponding to the present frame;

a delay unit for delaying the encoded image data for an interval corresponding to one frame and outputting a delayed encoded image data;

a second decoding unit for decoding the delayed encoded image data and outputting a second decoded image data corresponding to a previous frame; and a processing unit for processing the input image data using the first decoded image data and the second decoded image data, wherein the image data processed by the processing unit includes data that changes a transmissivity corresponding to the previous frame to a transimissivity corresponding to the present frame within substantially one frame interval.

31. A liquid crystal-display device provided with an image data processor of claim 30.

32. A method of image data processing for adjusting transmissivity values of liquid crystal comprising:

encoding an input image data of a present frame and outputting an encoded image data;

decoding the encoded image data and outputting a first decoded image data corresponding to the present frame;

delaying the encoded image data for an interval corresponding to one frame and outputting a delayed encoded image data;

decoding the delayed encoded image data and outputting a second decoded image data corresponding to a previous frame;

processing the input image data using the first decoded image and the second decoded image data, wherein the image data processed using the first decoded image and the second decoded image data includes data that changes a transmissivity corresponding to the previous frame to a transimissivity corresponding to the present frame within substantially one frame interval.

33. An image data processor for adjusting transmissivity values_of liquid crystal comprising:

an encoding unit for encoding an input image data of a present frame and outputting an encoded image data;

and a processing unit for processing the input image data using the encoded image data, wherein the image data processed by the processing unit includes data that changes a transmissivity corresponding to the frame prior to the present frame to a transimissivity corresponding to the present frame within substantially one frame interval, the image data processor further including a delay unit for delaying the encoded image data for an interval corresponding to one frame and outputting a second encoded image data, and a decoding unit for decoding the second encoded image data and outputting a decoded image data corresponding to a previous frame, wherein the processing unit processes the input image data using the encoded data and the decoded image data.

34. A liquid crystal-display device provided with an image data processor of claim 33.

35. A method of image data processing for adjusting transmissivity values of liquid crystal comprising:

encoding an input image data of a present frame and outputting an encoded image data;

and processing the input image data using the encoded image data, wherein the image data processed using the encoded image data includes data that changes a transmissivity corresponding to a frame prior to the present frame to a transimissivity corresponding to the present frame within substantially one frame interval, the method further including delaying the encoded image data for an interval corresponding to one frame and outputting a second encoded image data, decoding the second encoded image data and outputting a decoded image data corresponding to a previous frame, wherein the input image data is processed using the encoded data and the decoded image data.

* * * * *